US007758272B2

(12) United States Patent
Tanaka et al.

(10) Patent No.: US 7,758,272 B2
(45) **Date of Patent: *Jul. 20, 2010**

(54) BINDING DEVICE FOR FILES AND BINDERS

(75) Inventors: Kanji Tanaka, Ashiya (JP); Hiroshi Arai, Kawachinagano (JP); Yoshiteru Arimoto, Hannan (JP)

(73) Assignee: Lihit Lab., Inc., Osaka (JP)

( * ) Notice: Subject to any disclaimer, the term of this patent is extended or adjusted under 35 U.S.C. 154(b) by 357 days.

This patent is subject to a terminal disclaimer.

(21) Appl. No.: 11/909,645

(22) PCT Filed: Mar. 24, 2006

(86) PCT No.: PCT/JP2006/306005

§ 371 (c)(1),
(2), (4) Date: Sep. 25, 2007

(87) PCT Pub. No.: WO2006/101202

PCT Pub. Date: Sep. 28, 2006

(65) Prior Publication Data

US 2009/0052979 A1 Feb. 26, 2009

(30) Foreign Application Priority Data

Mar. 25, 2005 (JP) ..... 2005-089439
Sep. 26, 2005 (JP) ..... 2005-278775

(51) Int. Cl.
*B42F 13/20* (2006.01)

(52) U.S. Cl. ..... 402/41

(58) Field of Classification Search ..... 402/19, 402/20, 26, 29, 31–33, 36–42, 70, 43; D19/32, D19/26, 27

See application file for complete search history.

(56) References Cited

U.S. PATENT DOCUMENTS

2003/0044221 A1 3/2003 To et al.
2003/0123923 A1* 7/2003 Koike et al. ..... 402/19
2004/0013464 A1* 1/2004 Cheng ..... 402/31

FOREIGN PATENT DOCUMENTS

DE 1 179 911 B 10/1964
JP 57-24077 U 2/1982
JP 2004-505806 A 2/2004
WO 02/11998 A3 2/2002

OTHER PUBLICATIONS

Official Communication for PCT Application No. PCT/JP2006/306005 mailed on Jun. 20, 2006.
Tanaka et al.; "Binding Device for Files and Binders"; U.S. Appl. No. 11/909,675, filed Sep. 25, 2007.
Translation of the Official Communication issued in counterpart International Applicataion No. PCT/JP2006/306005, mailed on Oct. 4, 2007.

* cited by examiner

*Primary Examiner*—Dana Ross
*Assistant Examiner*—Matthew G Katcoff
(74) *Attorney, Agent, or Firm*—Keating & Bennett, LLP

(57) ABSTRACT

A binding device for files and binders in which rings to be inserted into binding holes of an object to be bound are openably and closeably secured to a base plate so as to be opened and closed by an opening-closing mechanism including a rotationally movable lever. In the binding device, a first ring member and a second ring member are configured such that they are interlocked with the opening-closing mechanism including the lever so as to be opened and closed about respective pivot portions and provided in the lower end thereof by rotationally moving the lever. In addition, the first ring member and the second ring member are secured in an opened state when opened, and the lever is secured such that the first ring member and the second ring member are maintained in the opened state.

6 Claims, 49 Drawing Sheets

BINDING DEVICE FOR FILES AND BINDERS

BACKGROUND OF THE INVENTION

1. Field of the Invention

The present invention relates to a binding device for holding objects to be bound, such as documents, in a file or a binder. In particular, the invention relates to a binding device for files and binders which is suitable for use as a binding device for so-called A-Z files and which holds objects to be bound such as documents using rings that are opened and closed by a mechanism including a lever.

2. Description of the Related Art

Lever arch files called A-Z files are widely known as files configured such that objects to be bound, such as documents, are held in the files by passing rings through respective binding holes provided near an edge of the objects.

Generally, a lever arch file includes a base and two rings which are firmly attached to the base and extend upwardly and which are inserted into respective holes provided in objects to be bound, such as documents. Each of the rings includes an arch portion and a pole-like portion for holding documents when the file is closed. Furthermore, a mechanism for holding the pole-like portion and the arch portion at a closed position is provided. At the closed position, each of the rings forms a closed loop for holding objects to be bound, and therefore the uppermost page in the bound objects is allowed to slide along the rings, whereby the page therebelow can be read. The above-mentioned mechanism is operated by a lever to allow the above-mentioned two portions to be separated away from each other, whereby objects to be bound can be added through the rings and removed from the rings. Moreover, the two portions of each of the rings can be joined again at the closed position by operating the lever.

A conventional lever arch file is disclosed in Published Japanese Translation of PCT International Application No. 2004-505806 (Patent Document 1).

In conventional lever arch files, each of two rings to be inserted into binding holes in objects to be bound, such as paper sheets, includes an arch portion and a pole-like portion for holding the objects to be bound when the files are closed. Such conventional lever arch files are configured such that when objects to be bound such as paper sheets are bound, the objects to be bound are bound in the pole-like portions by passing binding holes of the paper sheets and the like over the ends of the respective pole-like portions. However, since each arch portion has a shape such that the end thereof points downward even when each of the rings is opened, it is very inconvenient to pass the binding holes of a large number of objects to be bound such as paper sheets toward the arch portion side.

Moreover, the opening-closing mechanism including the lever for opening-closing the arch portions is provided in the center of a base to which the two rings are attached and is configured such that each of the rings can be opened and closed by rotationally moving the lever in a direction orthogonal to the opening-closing direction of each of the rings.

However, in this configuration, when the arch portion of each of the rings is opened, the arch portion touches the lever since it is not sufficiently opened.

Moreover, in lever arch files, a binding device is provided not on the spine of the cover but on the side B since when bound paper sheets are present in pole-like portions, the cover on the side B cannot be closed. Thus, the width of the cover of the files is large, and there is an inconvenience that the storage space for the files is large.

SUMMARY OF THE INVENTION

To overcome the problems described above, preferred embodiments of the present invention provide a binding device for files and binders in which rings to be inserted into binding holes of objects to be bound can be sufficiently opened, in which a lever of an opening-closing mechanism for the rings can be sufficiently operated, and which can be attached to the cover of files and binders.

A binding device for files and binders according to a preferred embodiment of the present invention is a binding device for files and binders in which a ring to be inserted into a binding hole of an object to be bound is openably and closeably secured to a base plate so as to be opened and closed by an opening-closing mechanism including a rotationally movable lever. The binding device for files and binders is configured such that a first ring member having a semi-annular binding ring portion and a second ring member having a semi-annular binding ring portion, which define the binding ring, are pivotally supported at respective pivot portions at respective lower ends thereof on the base plate. A junction at an end opposite to the pivot portion of the binding ring portion of the first ring member and a junction at an end opposite to the pivot portion of the binding ring portion of the second ring member are joined together at the center between the pivot portions of the first ring member and the second ring member, whereby the binding ring portion of the first ring member and the binding ring portion of the second ring member form a ring-like shape which defines a closed loop. The first ring member and the second ring member are configured such that they are interlocked with the opening-closing mechanism including the lever so as to be opened and closed about the respective pivot portions provided in the lower ends thereof by rotationally moving the lever. The first ring member and the second ring member are secured in an opened state when opened, and the lever is secured such that the first ring member and the second ring member are maintained in the opened state.

The binding device for files and binders is preferably configured such that the first ring member having the semi-annular binding ring portion and the second ring member having the semi-annular binding ring portion, which define the binding ring, are pivotally supported at the respective pivot portions at the respective lower ends thereof on the base plate. The junction at the end opposite to the pivot portion of the binding ring portion of the first ring member and the junction at the end opposite to the pivot portion of the binding ring portion of the second ring member are joined together at a position between the pivot portions of the first ring member and the second ring member, whereby the binding ring portion of the first ring member and the binding ring portion of the second ring member form the ring-like shape which defines the closed loop. The first ring member and the second ring member are configured such that they are interlocked with the opening-closing mechanism including the lever so as to be opened and closed about the respective pivot portions provided in the lower ends thereof by rotationally moving the lever. The opening-closing mechanism has a pivot member for rotationally moving the lever, and the pivot member is provided with an engaging portion which is engaged on the base plate side when the lever is rotationally moved to a position at which the binding rings are opened.

The first ring member and the second ring member, and/or the opening-closing mechanism including the lever are preferably configured such that the first ring member and the second ring member are stopped in a state in which the first and second ring members are half-opened at a position between an opened position and a closed position.

In the binding device according to this preferred embodiment, at least one of a resilient member and a pushing-up member for rotationally moving and simultaneously opening the first ring member and the second ring member having the binding ring is provided.

The pivot member of the opening-closing mechanism preferably includes an engaging portion which is to be engaged with the base plate and which is provided in a surface which is located on a lower side when the binding ring is brought into an opened position, and wherein the engaging portion is configured so as to be engaged with the resilient member for rotationally moving and opening the first ring member and the second ring member when the binding ring is brought into the opened position.

Preferably, an upper binding ring portion and a lower binding ring portion, each defining the binding ring portion, are connected through a connection portion to each other at the respective pivot portions in the lower ends thereof so as to be opposed to each other. Each of the pivot portions is provided so as to protrude in a direction substantially orthogonal to an opening-closing direction of the binding ring portion. The connection portion is connected to the pivot portion of the upper binding ring portion and the pivot portion of the lower binding ring portion and has a curved portion which is configured so as to be curved toward the junction side as the curved portion approaches the center of the connection portion. The curved portion is provided with a change point of the lever of the opening-closing mechanism, and the pivot member of the opening-closing mechanism is configured such that the lever is stopped at the change point when the lever is brought into a closed position of the binding ring and/or into a half-opened position of the binding ring.

The pivot member of the opening-closing mechanism preferably includes a securing portion which is to be secured to the base plate and which is provided in a surface which is located on a lower side when the binding ring is brought into a closed position. The securing portion is configured to be secured to the resilient member for rotationally moving and opening the first ring member and the second ring member when the binding ring is brought into the closed position.

A binding device for files and binders according to preferred embodiments of the present invention is a binding device for files and binders in which a ring to be inserted into a binding hole of an object to be bound is openably and closeably secured to a base plate so as to be opened and closed by an opening-closing mechanism including a rotationally movable lever. In this binding device for files and binders, a first ring member having a semi-annular binding ring portion and a second ring member having a semi-annular binding ring portion, which define the binding ring, are pivotally supported at respective pivot portions at respective lower ends thereof on the base plate. Furthermore, a junction at an end opposite to the pivot portion of the binding ring portion of the first ring member and a junction at an end opposite to the pivot portion of the binding ring portion of the second ring member are joined together at the center between the pivot portions of the first ring member and the second ring member, whereby the binding ring portion of the first ring member and the binding ring portion of the second ring member form a ring-like shape which defines a closed loop. Moreover, the first ring member and the second ring member are configured such that they are interlocked with the opening-closing mechanism including the lever so as to be opened and closed about the respective pivot portions provided in the lower ends thereof by rotationally moving the lever. In addition, the first ring member and the second ring member are secured in an opened state when opened, and the lever is secured such that the first ring member and the second ring member are maintained in the opened state. Therefore, bound objects such as paper sheets can be positioned at the approximate center of the binding ring portions, and the binding ring portions can be sufficiently opened. Furthermore, the lever of the opening-closing mechanism for the ring can be sufficiently operated without being disturbed by the binding ring portions. In addition, the ring members are prevented from being accidentally closed when paper sheets bound in the ring members are removed or when paper sheets are bound in the ring members. Therefore, the binding device can be handled with ease during binding operation of paper sheet.

According to a preferred embodiment, a binding device is provided in which the ring to be inserted into the binding hole of an object to be bound are openably and closeably secured to the base plate so as to be opened and closed by the opening-closing mechanism including the rotationally movable lever. In this binding device, the first ring member having the semi-annular binding ring portion and the second ring member having the semi-annular binding ring portion, which define the binding ring, are pivotally supported at the respective pivot portions at the respective lower ends thereof on the base plate. Furthermore, the junction at the end opposite to the pivot portion of the binding ring portion of the first ring member and the junction at the end opposite to the pivot portion of the binding ring portion of the second ring member are joined together at a position between the pivot portions of the first ring member and the second ring member, whereby the binding ring portion of the first ring member and the binding ring portion of the second ring member form the ring-like shape which defines the closed loop. Moreover, the first ring member and the second ring member are configured such that they are interlocked with the opening-closing mechanism including the lever so as to be opened and closed about the respective pivot portions provided in the lower ends thereof by rotationally moving the lever. In addition, the opening-closing mechanism has a pivot member for rotationally moving the lever, and the pivot member is provided with an engaging portion which is engaged on the base plate side when the lever is rotationally moved to a position at which the binding rings are opened. Therefore, the ring members are prevented from being accidentally closed when paper sheets bound in the ring members are removed or when paper sheets are bound in the ring members. Thus, the binding device can be handled with ease during binding operation of paper sheet.

According to another preferred embodiment, the first ring member and the second ring member, and/or the opening-closing mechanism including the lever are provided such that the first ring member and the second ring member are stopped in a state in which the first and second ring members are half-opened at a position between an opened position and a closed position. Therefore, when the binding ring is opened, the lever is prevented from being burst open completely due to the weight of paper sheets bound in the ring members or due to the action of the resilient member, and therefore, is prevented from hitting other objects.

Preferably, at least one of a resilient member and a pushing-up member for rotationally moving and simultaneously opening the first ring member and the second ring member having the binding ring is provided. Therefore, the binding ring of the first ring member and the second ring member can be opened through at least one of the resilient member and a pulling-up member.

The pivot member of the opening-closing mechanism has an engaging portion which is to be engaged with the base plate and which is provided in a surface which is located on a lower side when the binding rings are brought into an opened position. In addition, the engaging portion is arranged so as to be engaged with the resilient member for rotationally moving and opening the first ring member and the second ring member when the binding ring is brought into the opened position. Therefore, a downward force, which is exerted by the curved portion of the first ring member and the curved portion of the second ring member when the first ring member and the second ring member are moved in the closing direction, is held by the engaging portion through the resilient member, whereby the opened state of the lever can be maintained.

Preferably, an upper binding ring portion and a lower binding ring portion each defining the binding ring portion are connected through a connection portion to each other at the respective pivot portions in the lower ends thereof so as to be opposed to each other. Furthermore, each of the pivot portions is provided so as to protrude in a direction orthogonal to an opening-closing direction of the binding ring portion. The connection portion is connected to the pivot portion of the upper binding ring portion and the pivot portion of the lower binding ring portion and has a curved portion which is configured so as to be curved toward the junction side as the curved portion approaches the center of the connection portion. In addition, the curved portion is provided with a change point of the lever of the opening-closing mechanism, and the pivot member of the opening-closing mechanism is arranged such that the lever is stopped at the change point when the lever is brought into at least one of a closed position of the binding ring and a half-opened position of the binding ring. Therefore, by rotationally moving the lever of the opening-closing mechanism, the first ring member and the second ring member can be rotationally moved about the respective pivot portions to close the binding ring portions or to bring the binding ring portions into a half-opened state, and these states can be maintained stably.

The pivot member of the opening-closing mechanism preferably includes a securing portion which is to be secured to the base plate and which is provided in a surface which is located on a lower side when the binding ring is brought into a closed position. In addition, the securing portion is configured so as to be secured to the resilient member for rotationally moving and opening the first ring member and the second ring member when the binding ring is brought into the closed position. Therefore, the closed state of the binding rings can be reliably maintained.

The above and other objects, features and advantages of this invention will become more readily apparent from the following description of best modes for carrying out the invention in conjunction with the accompanying drawings.

DETAILED DESCRIPTION OF PREFERRED EMBODIMENTS

Figure 1:
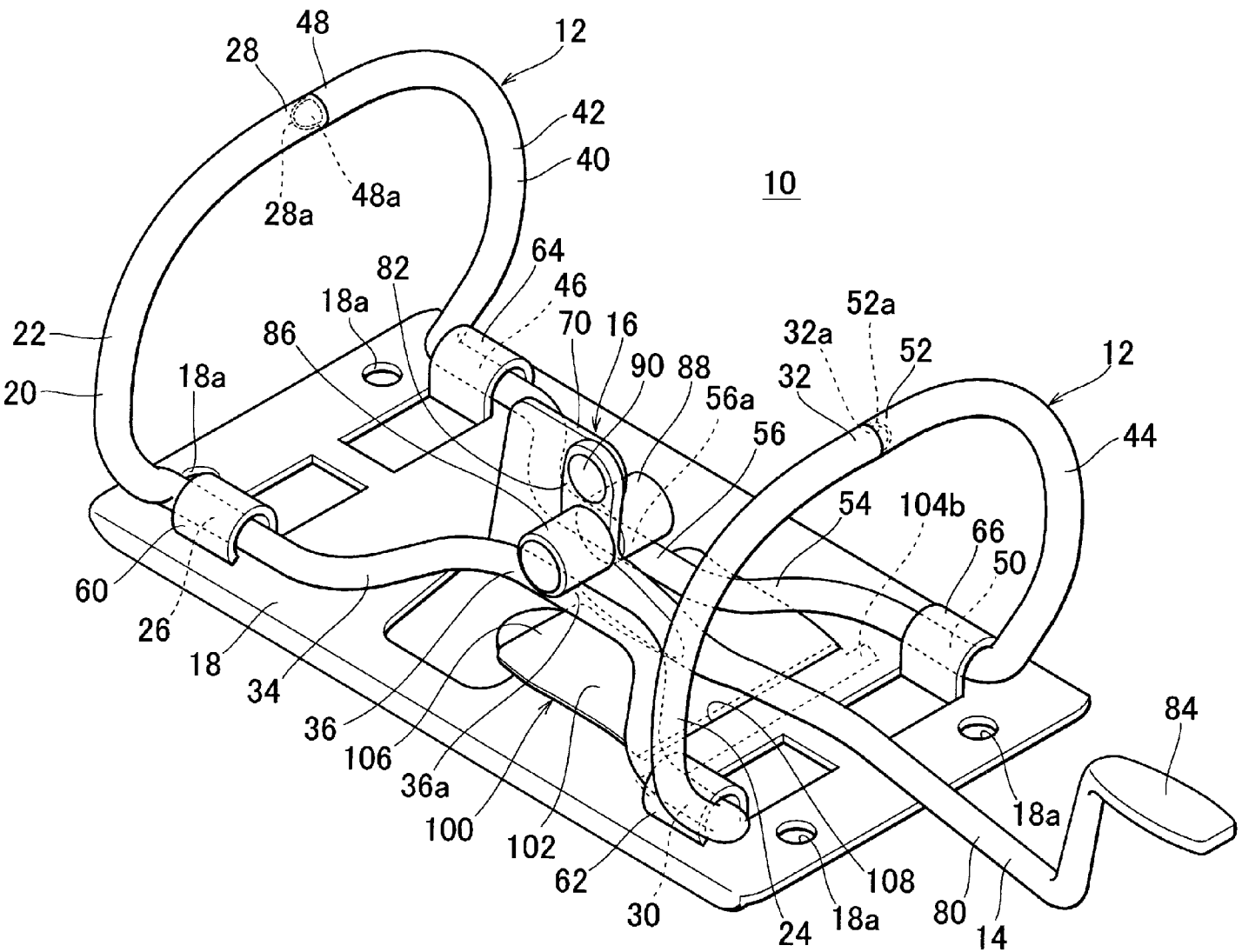
FIG. 1 is a perspective view of a binding device of a preferred embodiment of the present invention.

FIG. 1 is a perspective view of a binding device of a preferred embodiment of the present invention.

Figure 2:
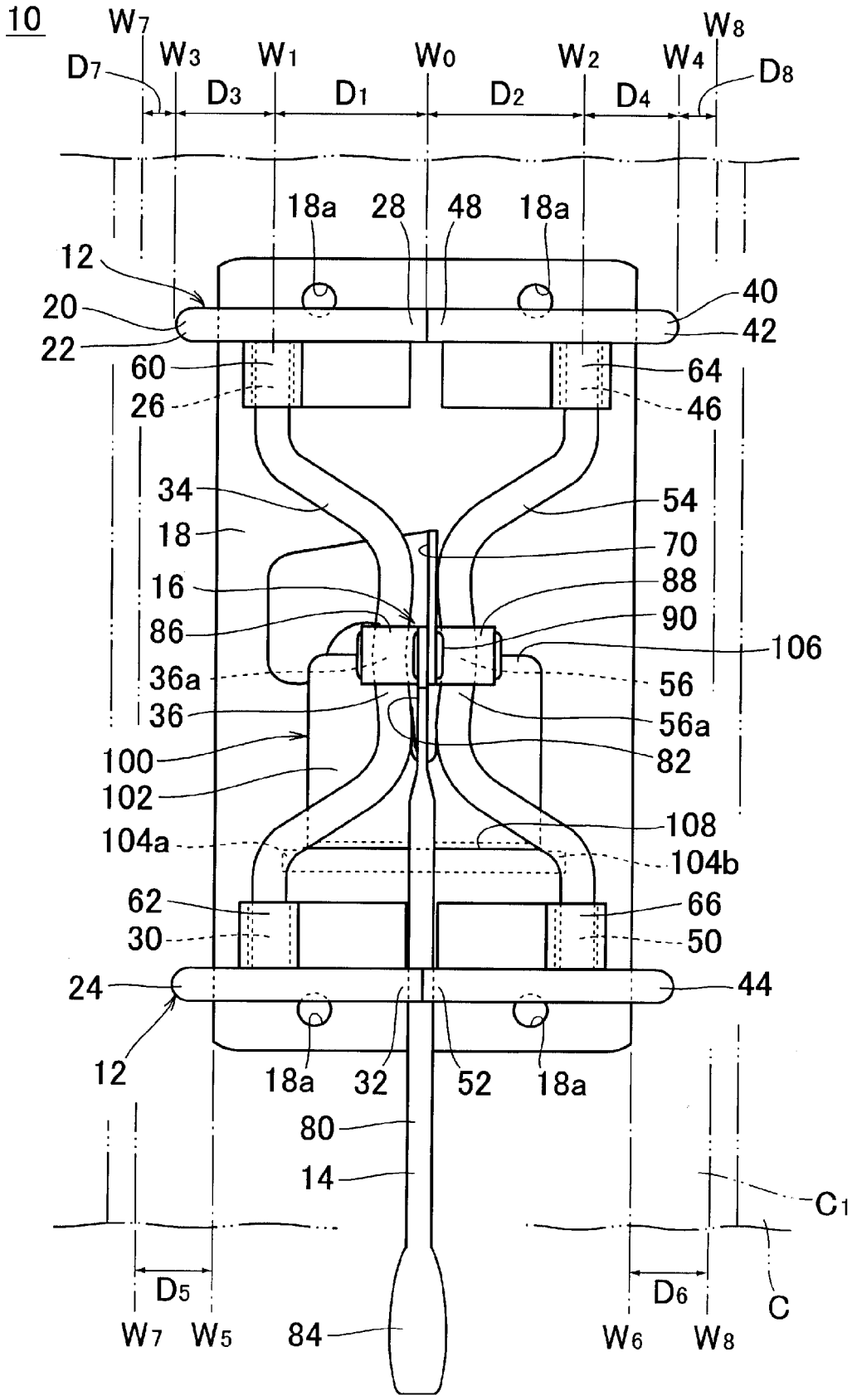
FIG. 2 is a plan view of the binding device shown in FIG. 1.

FIG. 2 is a plan view of the binding device shown in FIG. 1.

Figure 3:
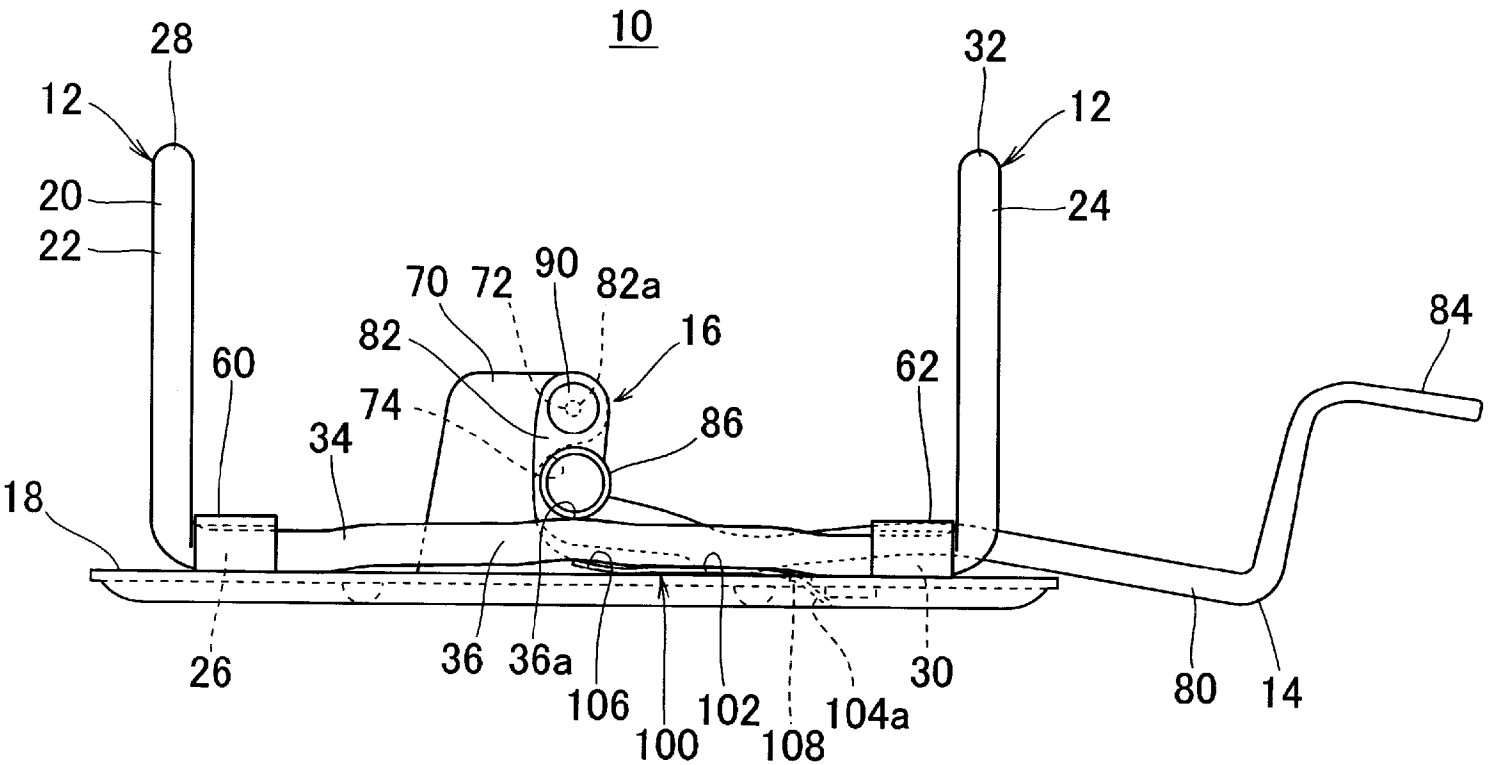
FIG. 3 is a left side view of the binding device shown in FIG. 1.

FIG. 3 is a left side view of the binding device shown in FIG. 1.

Figure 4:
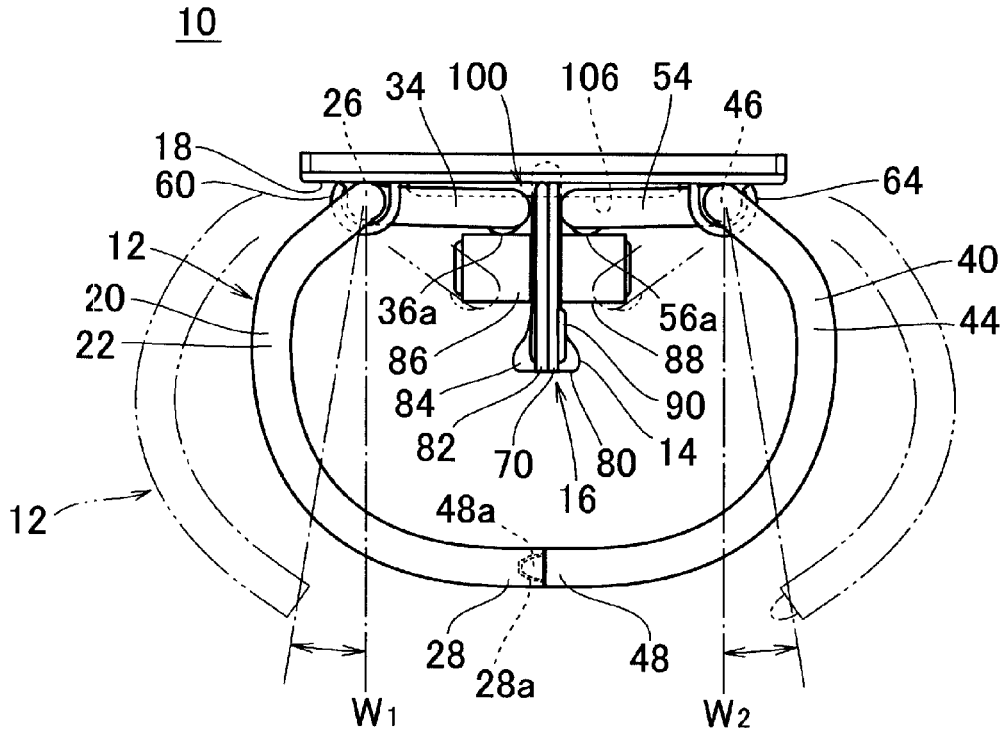
FIG. 4 is a rear view of the binding device shown in FIG. 1.

FIG. 4 is a rear view of the binding device shown in FIG. 1.

Figure 5:
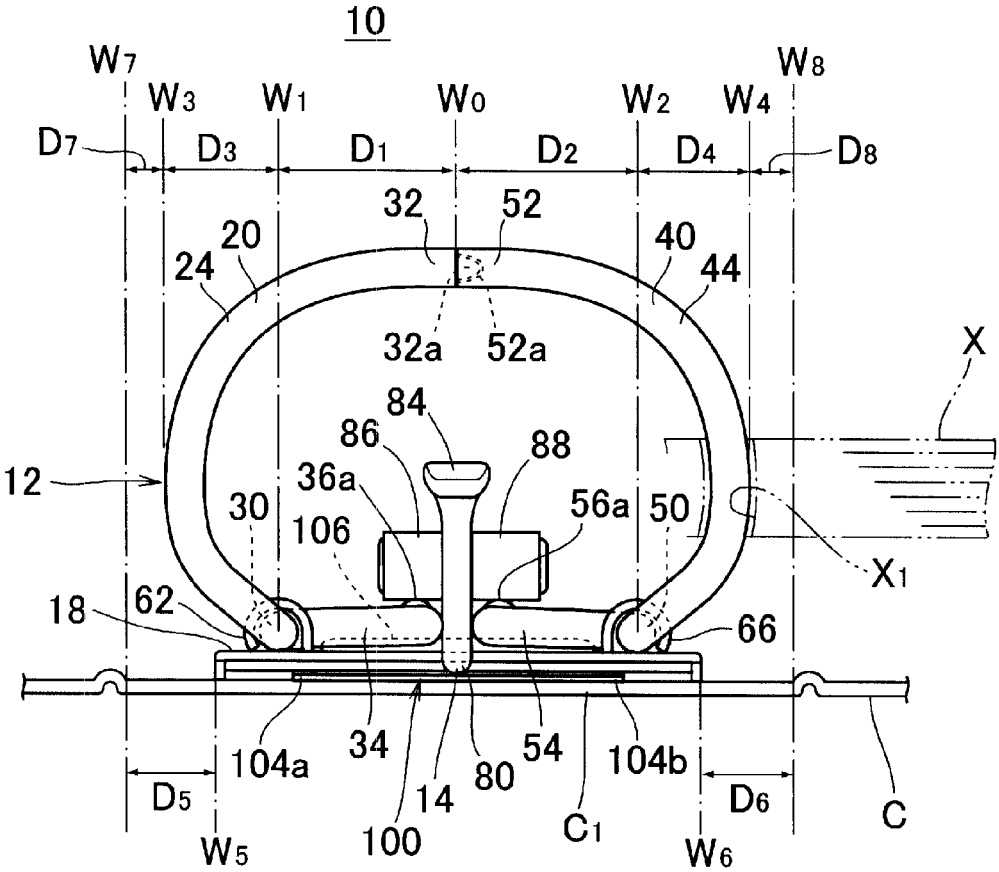
FIG. 5 is a front view of the binding device shown in FIG. 1.

FIG. 5 is a front view of the binding device shown in FIG. 1.

Figure 6:
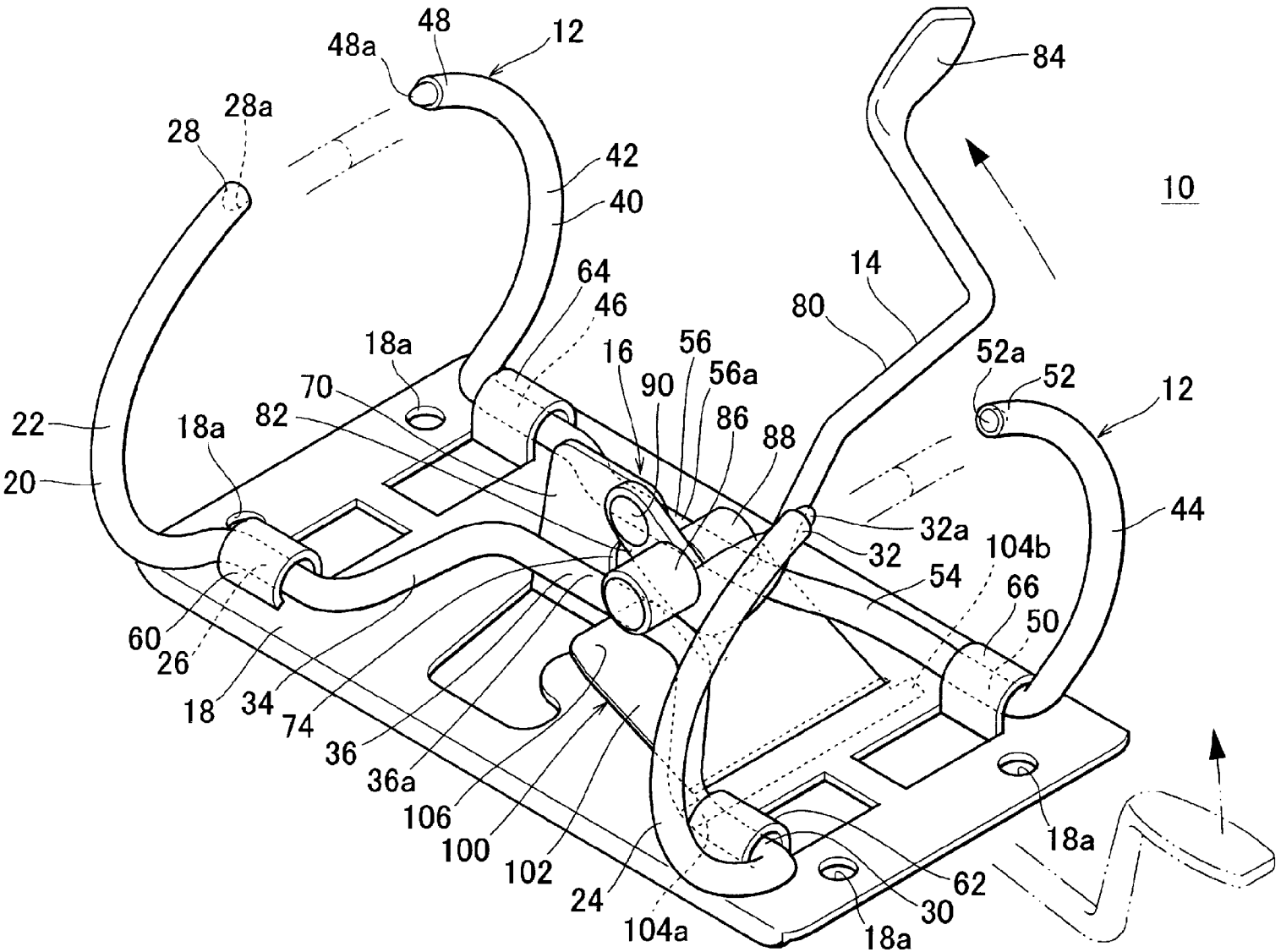
FIG. 6 is a perspective view illustrating the operating state of the binding device shown in FIG. 1.

FIG. 6 is a perspective view illustrating the operating state of the binding device shown in FIG. 1.

Figure 7:
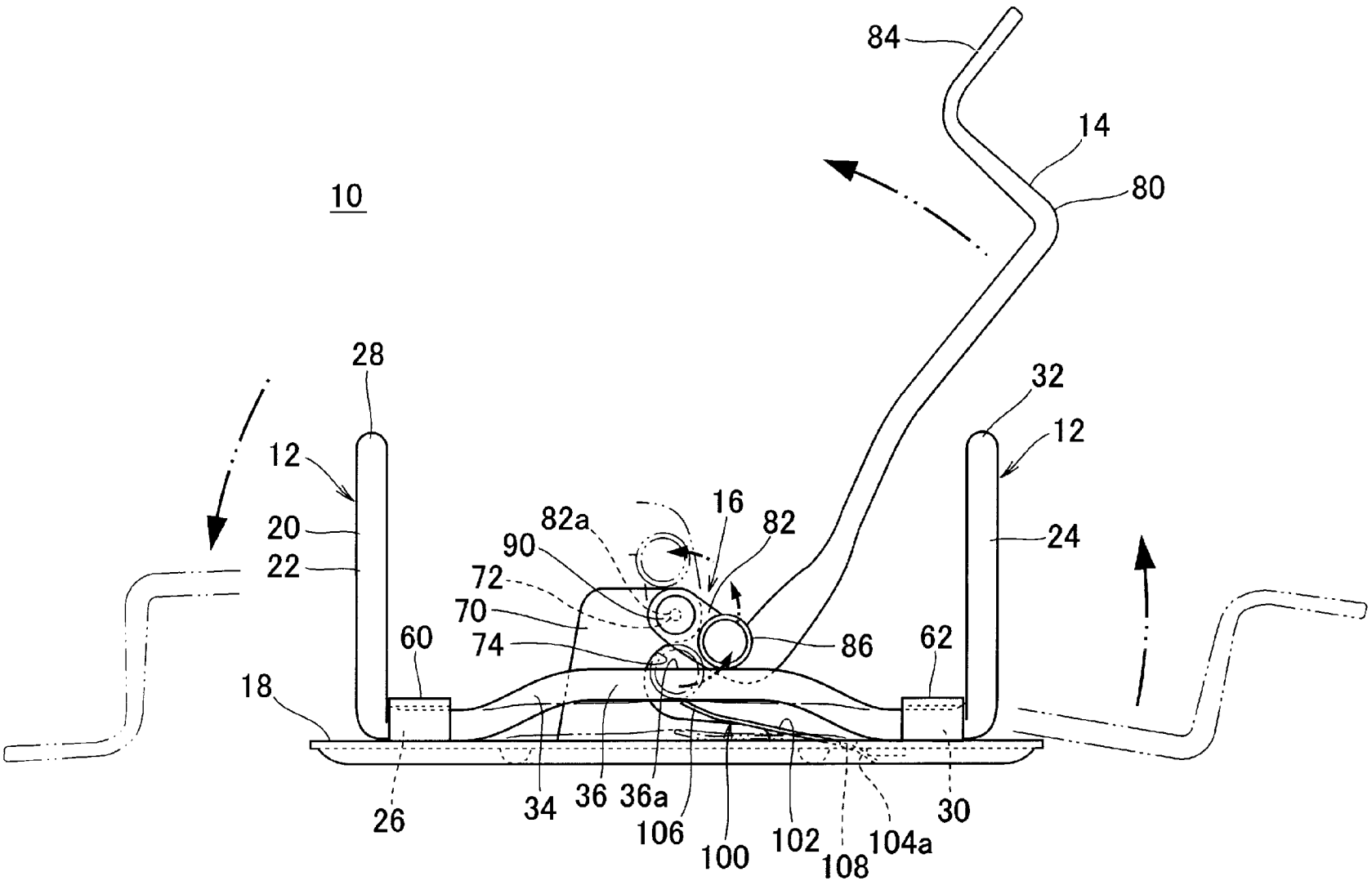
FIG. 7 is a left side view illustrating the operating state of the binding device shown in FIG. 1.

FIG. 7 is a left side view illustrating the operating state of the binding device shown in FIG. 1.

Figure 8:
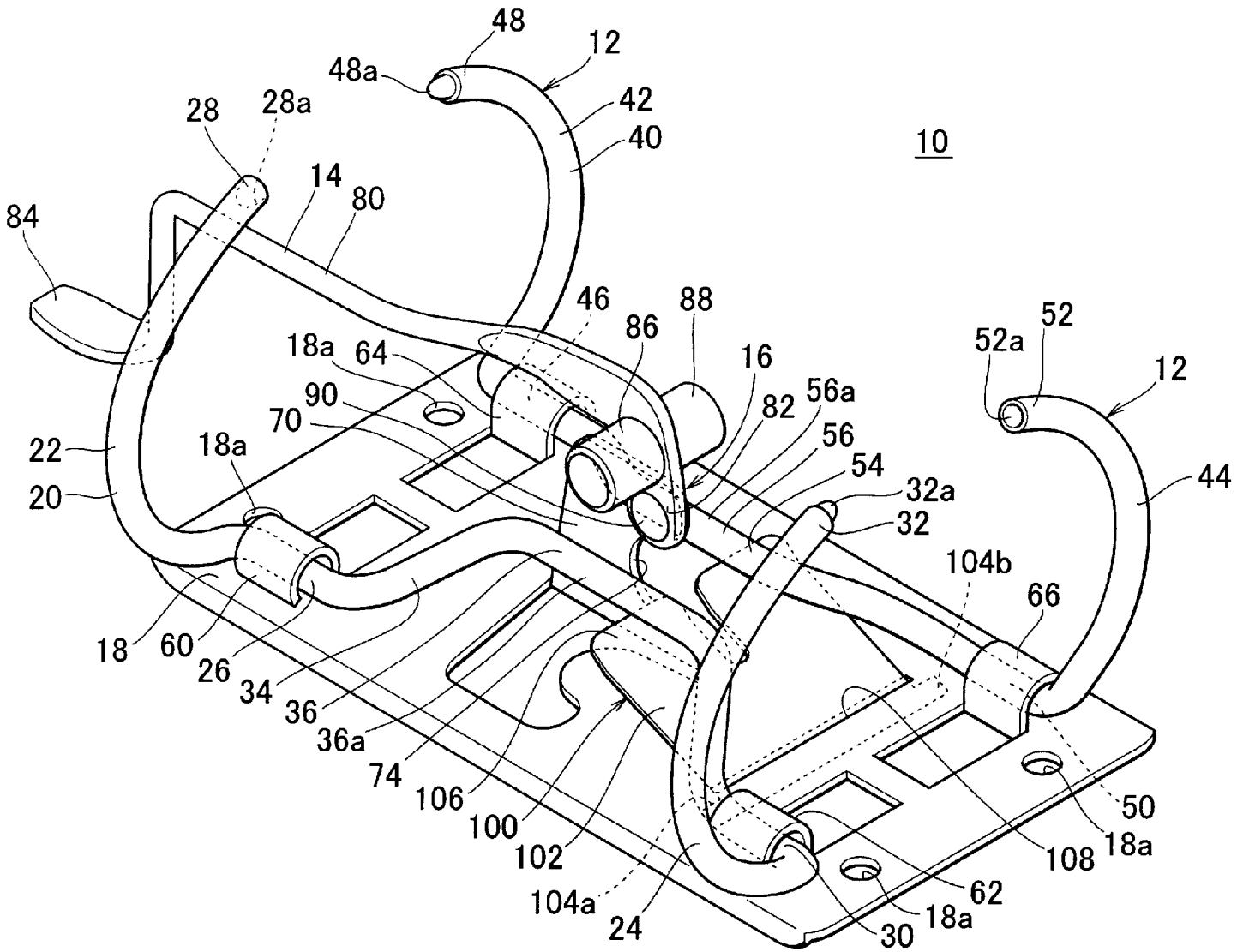
FIG. 8 is a perspective view illustrating the operating state of the binding device shown in FIG. 1.

FIG. 8 is a perspective view illustrating the operating state of the binding device shown in FIG. 1.

Figure 9:
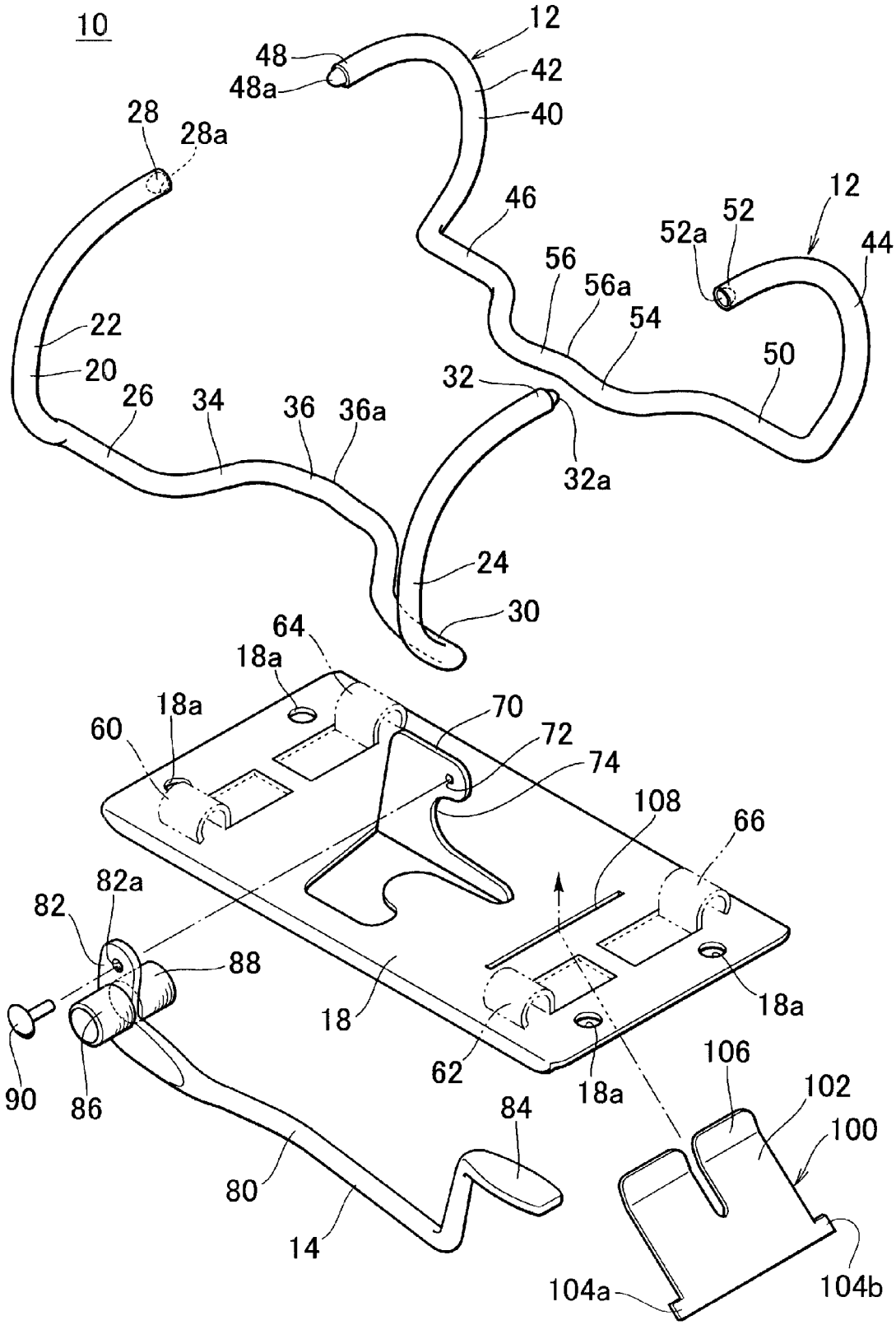
FIG. 9 is an exploded perspective view being a right side view of the binding device shown in FIG. 1.
Figure 10:
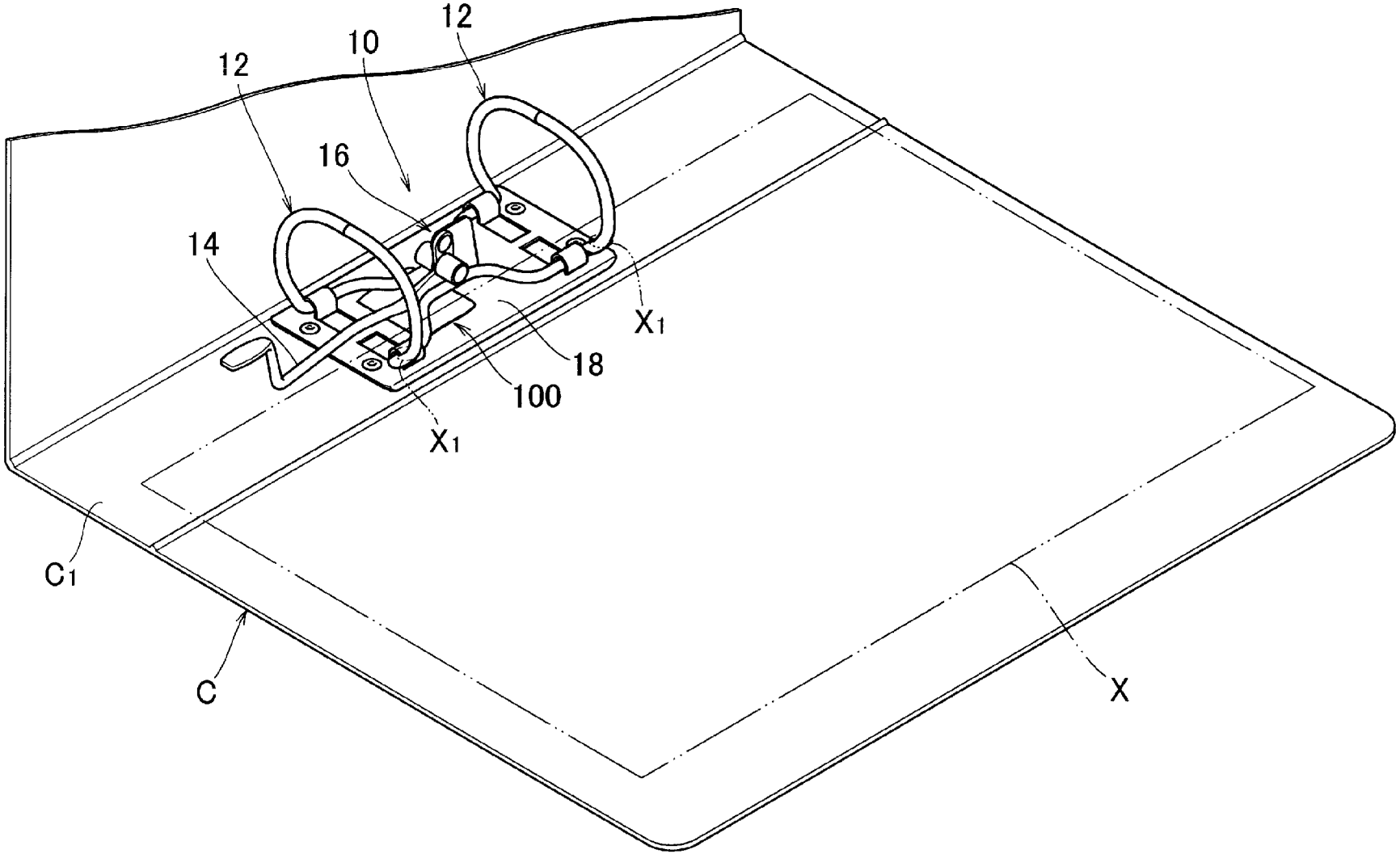
FIG. 10 is a perspective view of a file in which the binding device shown in FIG. 1 is used.

FIG. 9 is an exploded perspective view being a right side view of the binding device shown in FIG. 1.

A binding device 10 is a binding device for files and binders, and in particular, is a binding device for use in A-Z files. In this binding device 10, binding rings 12 to be inserted into binding holes $X_1$ of an object X to be bound such as a paper sheet are openably and closeably secured to a base plate 18 so as to be rotationally opened and closed in its tangential direction about pivots near the base plate 18 by means of an opening-closing mechanism 16 including a rotationally movable lever 14.

The binding device 10 includes a pair of a first ring member 20 and a second ring member 40. The first ring member 20 and the second ring member 40 are each integrally formed by bending a cylindrical metal wire and are formed substantially symmetrically.

The binding ring 12 in the first ring member 20 and the binding ring 12 in the second ring member 40 are rotationally moved in the tangential direction of the binding ring 12, so that they are moved in a direction from a closed position at which a closed loop is formed toward an opened position at which the loop is separated or in the opposite direction (an opening-closing direction).

The first ring member 20 has a semi-annular upper binding ring portion 22 defining the binding ring 12 and a semi-annular lower binding ring portion 24 defining the binding ring 12. A pivot portion 26 is provided at the lower end of the upper binding ring portion 22, and a junction 28 is provided at the upper end thereof. A pivot portion 30 is provided at the lower end of the lower binding ring portion 24, and another junction 32 is provided at the upper end thereof, as in the upper binding ring portion 22.

The junction 28 has a recess 28*a* provided at the end thereof, and the other junction 32 has a projection 32*a* protruding from the end thereof.

The upper binding ring portion 22 and the lower binding ring portion 24 are connected so as to be opposed to each other through a connection portion 34 between the pivot portion 26 at the lower end of the upper binding ring portion 22 and the pivot portion 30 at the lower end of the lower binding ring portion 24.

Each of the pivot portions 26 and 30 is provided so as to protrude in a direction orthogonal to the opening-closing direction of the upper binding ring portion 22 and the lower binding ring portion 24. Specifically, the pivot portion 26 is provided so as to protrude toward the lower binding ring portion 24, and the pivot portion 30 is provided so as to protrude toward the upper binding ring portion 22.

The connection portion 34 is connected to the pivot portion 26 of the upper binding ring portion 22 and the pivot portion 30 of the lower binding ring portion 24. The connection portion 34 has a curved portion 36 which is configured so as to be curved and protrude toward the junction 28 of the upper binding ring portion 22 and the junction 32 of the lower binding ring portion 24 as the curved portion 36 approaches the center of the connection portion 34.

The curved portion 36 has irregularities provided on the upper surface thereof so as to be provided with the change point of the lever 14 of the opening-closing mechanism 16.

The second ring member 40 has a semi-annular upper binding ring portion 42 defining the binding ring 12 and a semi-annular lower binding ring portion 44 defining the binding ring 12. A pivot portion 46 is provided at the lower end of the upper binding ring portion 42, and a junction 48 is provided at the upper end thereof. A pivot portion 50 is provided at the lower end of the lower binding ring portion 44, and a junction 52 is provided at the upper end thereof, as in the upper binding ring portion 42.

The junction 48 has a projection 48*a* extending from the end thereof, and the junction 52 has a recess 52*a* drilled in the end thereof.

The upper binding ring portion 42 and the lower binding ring portion 44 are connected so as to be opposed to each other through a connection portion 54 between the pivot portion 46 at the lower end of the upper binding ring portion 42 and the pivot portion 50 at the lower end of the lower binding ring portion 44.

Each of the pivot portions 46 and 50 is provided so as to protrude in a direction orthogonal to the opening-closing direction of the upper binding ring portion 42 and the lower binding ring portion 44. Specifically, the pivot portion 46 is provided so as to protrude toward the lower binding ring portion 44, and the pivot portion 50 is provided so as to protrude toward the upper binding ring portion 42.

The connection portion 54 is connected to the pivot portion 46 of the upper binding ring portion 42 and the pivot portion 50 of the lower binding ring portion 44. The connection portion 54 has a curved portion 56 which is configured so as to be curved and protrude toward the junction 48 of the upper binding ring portion 42 and the junction 52 of the lower binding ring portion 44 as the curved portion 56 approaches the center of the connection portion 54.

The curved portion 56 has irregularities provided on the upper surface thereof so as to be provided with the change point of the lever 14 of the opening-closing mechanism 16.

The upper binding ring portion 22 and the lower binding ring portion 24 of the first ring member 20 have the pivot portion 26 and the pivot portion 30, respectively, provided near the left edge of the base plate 18. Furthermore, the upper binding ring portion 22 and the lower binding ring portion 24 have the junction 28 and the junction 32, respectively, which are provided at the respective ends opposite to the pivot portions 26 and 30, respectively, and which are provided near the center in the width direction of the base plate 18. Moreover, the upper binding ring portion 42 and the lower binding ring portion 44 of the second ring member 40 have the pivot portion 46 and the pivot portion 50, respectively, provided near the right edge of the base plate 18. The upper binding ring portion 42 and the lower binding ring portion 44 have the junction 48 and the junction 52, respectively, which are provided at the respective ends opposite to the pivot portions 46 and 50, respectively, and which are provided near the center in the width direction of the base plate 18.

$D_1$ is the length between a perpendicular plane $W_1$ which passes through the pivot portions 26 and 30 and a perpendicular plane $W_0$ which passes through the connected junctions 48 and 52. $D_2$ is the length between a perpendicular plane $W_2$ which passes through the junctions 28 and 32 and the perpendicular plane $W_0$ which passes through the connected junctions 48 and 52. The length $D_1$ is equal to the length $D_2$ (see FIGS. 2 and 5).

$D_3$ is the length between a perpendicular plane $W_3$ which passes through the leftmost edge of the upper binding ring portion 22 and the lower binding ring portion 24 and the perpendicular plane $W_1$ which passes through the pivot portions 26 and 30. $D_4$ is the length between a perpendicular plane $W_4$ which passes through the rightmost edge of the upper binding ring portion 42 and the lower binding ring portion 44 and the perpendicular plane $W_2$ which passes through the pivot portions 46 and 50. The length $D_3$ is equal to the length $D_4$ (see FIGS. 2 and 5).

The length between the perpendicular plane $W_3$ which passes through the leftmost edge of the upper binding ring portion 22 and the lower binding ring portion 24 and a perpendicular plane $W_5$ which passes through the leftmost edge of the base plate 18 is equal to the length between the perpendicular plane $W_4$ which passes through the rightmost edge of the upper binding ring portion 42 and the lower binding ring portion 44 and a perpendicular plane $W_6$ which passes through the rightmost edge of the base plate 18 (see FIGS. 2 and 5).

The binding rings 12 in the first ring member 20 and the second ring member 40 are each formed into a horizontally elongated ellipsoidal ring shape. Specifically, in the central portion between the pivot portion 26 of the first ring member 20 and the pivot portion 46 of the second ring member 40, i.e., near the widthwise center of the base plate 18, the junction 28 of the first ring member 20 is joined to the junction 48 of the second ring member 40, and the recess 28*a* is engaged with the projection 48*a*, whereby a horizontally elongated ellipsoidal ring shape is formed which defines a closed loop. In addition, the junction 32 of the first ring member 20 is joined to the junction 52 of the second ring member 40, and the projection 32*a* is engaged with the recess 52*a*, whereby a horizontally elongated ellipsoidal ring shape is formed which defines the closed loop.

Specifically, in the binding rings 12, the upper binding ring portions 22 and 42 form a downwardly opened C-shaped ring, and the lower binding ring portions 24 and 44 form a downwardly opened C-shaped ring, whereby a vertical pair of binding rings are provided.

The curved portion 36 of the connection portion 34 of the first ring member 20 and the curved portion 56 of the connection portion 54 of the second ring member 40 are curved so as to be brought close to each other near the center of the base plate 18. The curved portions 36 and 56 extend substantially parallel to each other in the lengthwise direction of the base plate 18, and an appropriate gap for disposing the opening-closing mechanism 16 is provided between the connection portion 34 of the first ring member 20 and the connection portion 54 of the second ring member 40.

Pivot receivers 60 and 62 for pivotally supporting the pivot portions 26 and 30, respectively, of the first ring member 20 and pivot receivers 64 and 66 for pivotally supporting the pivot portions 46 and 50, respectively, of the second ring member 40 are provided in respective four corners of the base plate 18.

Specifically, the pivot portion 26, the junction 28, the pivot portion 30, and the junction 32 are provided in the base plate 18 so that the junctions 48 and 52 can be joined on the perpendicular plane $W_0$ which passes through the center between the perpendicular plane $W_5$ passing through the left edge of the base plate 18 and the perpendicular plane $W_6$ passing through the right edge of the base plate 18.

In the base plate 18 of this preferred embodiment, each of the pivot receivers 60, 62, 64, and 66 is formed by punching the base plate 18 to form a substantially rectangular U-shaped tongue and curling the punched tongue.

The opening-closing mechanism 16 for the binding rings 12 is provided in the center of the base plate 18.

In this preferred embodiment, the opening-closing mechanism 16 is provided with a lever shaft receiver 70 formed by punching the base plate 18 in the substantial center thereof and bending the punched portion upward.

A shaft hole 72 is drilled in the upper portion of the lever shaft receiver 70, and a recess 74 for allowing the motion of the lever 14 is formed below the shaft hole 72. The lever 14 is rotatably secured to the shaft hole 72 as described later.

The lever 14 includes a substantially linear lever body 80, a rod member 82 which is bent upward at the upper end (the far side) of the lever body 80 and which protrudes in a direction orthogonal to the lever body 80, and a substantially L-shaped operation portion 84 which is bent upward at the lower end (the near side) of the lever body 80 and protrudes in a direction orthogonal to the lever body 80.

A shaft hole 82*a* is drilled in the rod member 82. Furthermore, a first securing portion 86 which rolls on the curved portion 36 of the connection portion 34 of the first ring member 20 and a second securing portion 88 which rolls on the curved portion 56 of the connection portion 54 of the second ring member are rotatably secured to a bent portion which is located directly below the shaft hole 82*a* and at which the lever body 80 and the rod member 82 are connected to each other.

The lever 14 is configured so as to be capable of rotatably moving in a direction orthogonal to the opening-closing direction of the binding rings 12 in the first ring member 20 and the binding rings 12 in the second ring member 40 through a pivot 90 inserted into the shaft hole 82*a* of the rod member 82 and into the shaft hole 72 of the lever shaft receiver 70 of the base plate 18.

The curved portion 36 of the first ring member 20 and the curved portion 56 of the second ring member 40 have an upward swelling projection 36*a* and an upward swelling projection 56*a*, respectively, each provided near a portion below the shaft hole 72 of the lever shaft receiver 70. The projections 36*a* and 56*a* are provided such that the first securing portion 86 and the second securing portion 88 of the lever 14 climb over the change point of the lever mechanism when lowered to the lowermost position.

The first securing portion 86 of the lever 14 is configured so as to roll on the curved portion 36 of the first ring member 20, and the second securing portion 88 of the lever 14 is configured so as to roll on the curved portion 56 of the second ring member 40. Each of the first securing portion 86 and the second securing portion 88 is configured so as to rotationally move about the pivot 90 from a horizontal position (a state in which the binding rings 12 are closed) in a direction orthogonal to the opening-closing direction of the binding ring 12.

The opening-closing mechanism 16 is provided with an urging member 100 which urges the binding rings 12 in an opening direction.

The urging member 100 is defined by a plate spring including a substantially rectangular urging member main body 102, securing portions 104*a* and 104*b* which protrude horizontally from the lower end of the urging member main body 102, and a pressing portion 106 which is bent at the upper end of the urging member main body 102 and extends upward.

The urging member main body 102 of the urging member 100 passes through an elongated hole 108 which is drilled in the width direction of the base plate 18 and provided on a side below the lever shaft receiver 70 (the near side) of the base plate 18. The lower edge of the urging member 100 is inserted into an elongated hole 108 drilled in the base plate 18, and the urging member 100 is secured through the securing portions 104*a* and 104*b*. The pressing portion 106 on the upper edge abuts on the lower portion of the curved portion 36 of the first ring member 20 (a portion lower than the change point of the lever (a portion on the near side)) and abuts on the lower portion of the curved portion 56 of the second ring member 40 (a portion lower than the change point of the lever (a portion on the near side)). Hence, the urging member 100 urges the curved portions 36 and 56 upward.

The first ring member 20 is opened about the pivot portions 26 and 30 in a counterclockwise direction through the urging force of the urging member 100, and the second ring member 40 is opened about the pivot portions 46 and 50 in a clockwise direction through the urging force.

In a state in which the binding rings 12 in the first ring member 20 and the second ring member 40 are opened, the lever 14 is moved upward, and the first securing portion 86 and the second securing portion 88 roll on the curved portion 36 of the first ring member 20 and the curved portion 56 of the second ring member 40, respectively, and move toward the lower side (the near side). Therefore, the first securing portion 86 and the second securing portion 88 do not push down the curved portion 36 of the first ring member 20 and the curved portion 56 of the second ring member 40, respectively. Furthermore, the curved portion 36 of the first ring member 20 and the curved portion 56 of the second ring member 40 are pushed upward by the urging force of the urging member 100.

Thus, the junction 28 of the first ring member 20 and the junction 48 of the second ring member 40 are moved in mutually separating directions, and the junction 32 of the first ring member 20 and the junction 52 of the second ring member 40 are moved in mutually separating directions. The binding rings 12 in the first ring member 20 are opened about 20 degrees from a perpendicular line passing through the pivot portions 26 and 30, and the binding rings 12 in the second ring member 40 are opened about 20 degrees from a perpendicular line passing through the pivot portions 46 and 50 (see FIG. 4). Specifically, the first ring member 20 is opened by being rotated in a counterclockwise direction, and the second ring member 40 is opened by being rotated in a clockwise direction.

When the upper binding ring portion 22 and the lower binding ring portion 24 of the first ring member 20 and the upper binding ring portion 42 and the lower binding ring portion 44 of the second ring member 40 are opened, an operation area for the lever 14 is opened. Then, the lever 14 can pass between the binding rings 12 in the first ring member 20 and the second ring member 40 and can be rotationally moved until reaching the upper side (the far side) of the base plate 18. Hence, the lever 14 can be secured in a horizontal state in which the lever 14 comes close to the upper surface of the base plate 18.

Therefore, the upper binding ring portion 42 of the second ring member 40 and the lower binding ring portion 44 of the second ring member 40 can be inserted into binding holes $X_1$ of an object X to be bound such as a paper sheet without being disturbed by the lever 14, whereby the object X to be bound can be inserted.

After the object X to be bound is inserted, when the lever 14 is rotationally moved toward the lower side (the near side), the first securing portion 86 and the second securing portion 88 again push down the curved portion 36 of the first ring member 20 and the curved portion 56 of the second ring member 40, respectively. Then, when the lever 14 is pushed down against the urging force of the urging member 100, the lever 14 is secured in a position beyond the change point, and the binding rings 12 in the first ring member 20 and the second ring member 40 are secured in place.

This binding device 10 is attached to a spine $C_1$ of a cover C of a file by inserting rivets or other suitable fastening members through respective four attaching holes 18*a* provided in the base plate 18.

The distance $D_5$ between the perpendicular plane $W_5$ passing through the left edge of the base plate 18 secured to the spine $C_1$ of the cover C of the file and a perpendicular plane $W_7$ passing through a folding line on the left edge of the spine $C_1$ of the cover C of the file is equal to the distance $D_6$ between the perpendicular plane $W_8$ passing through the right edge of the base plate 18 and a perpendicular plane $W_6$ passing through a folding line on the right edge of the spine $C_1$ of the cover C of the file.

This invention is not limited to the above-described preferred embodiment, and various modifications may be made within the spirit of this invention. For example, this invention may be modified as shown in FIGS. 11 to 16.

Figure 11:
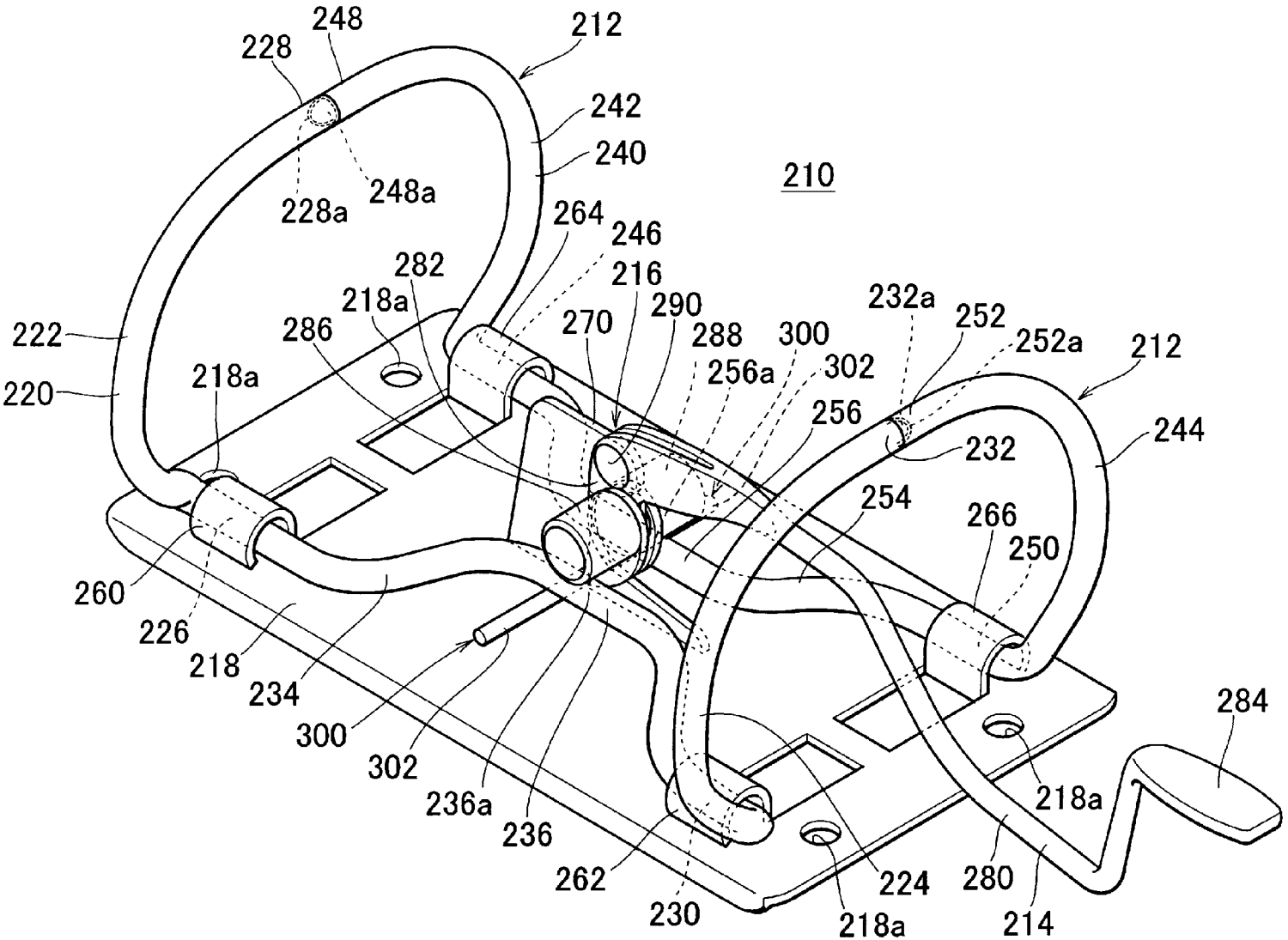
FIG. 11 is a perspective view of a binding device of another preferred embodiment of the present invention.
Figure 12:
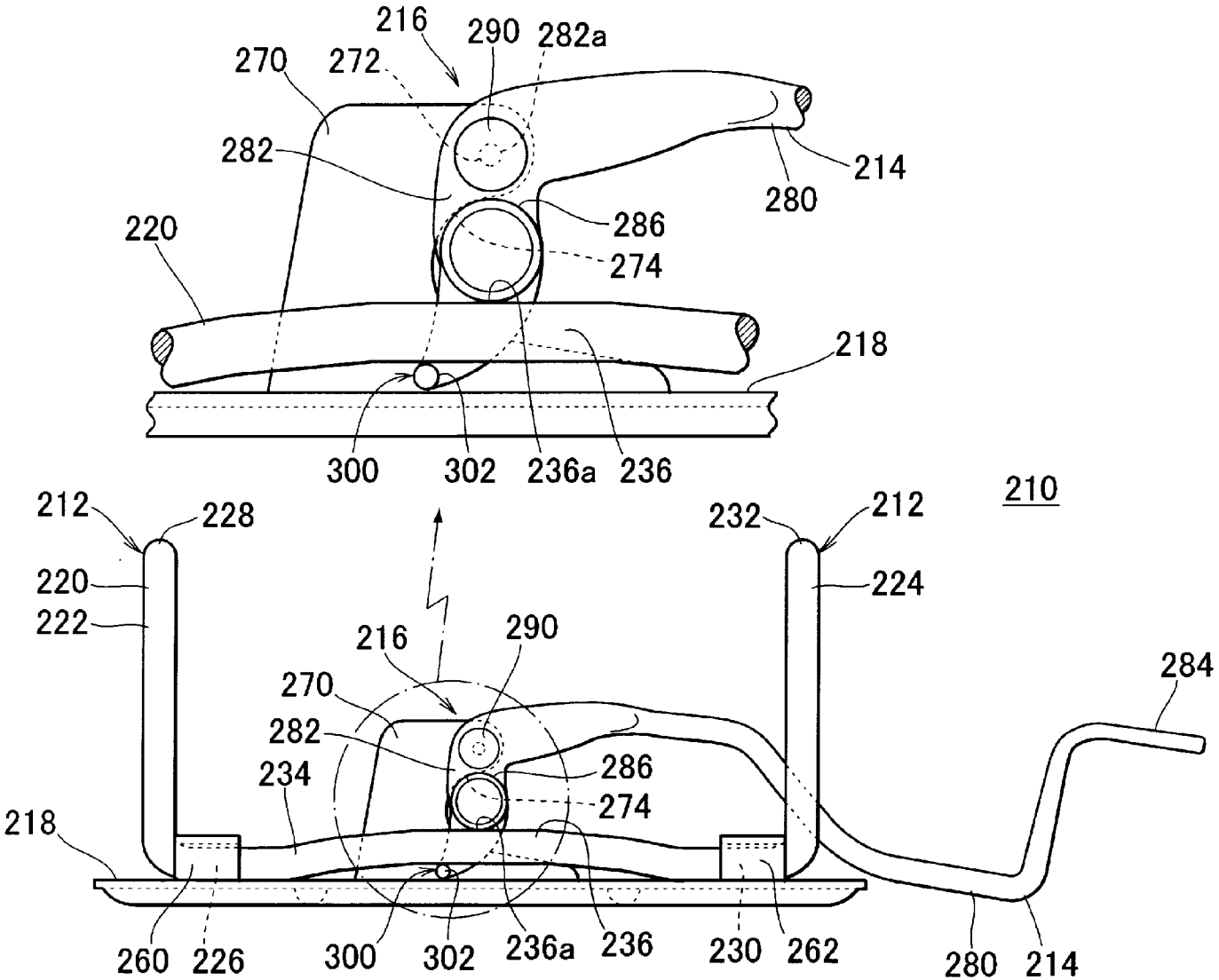
FIG. 12 is a set of left side views illustrating the operating state of the binding device shown in FIG. 11.
Figure 13:
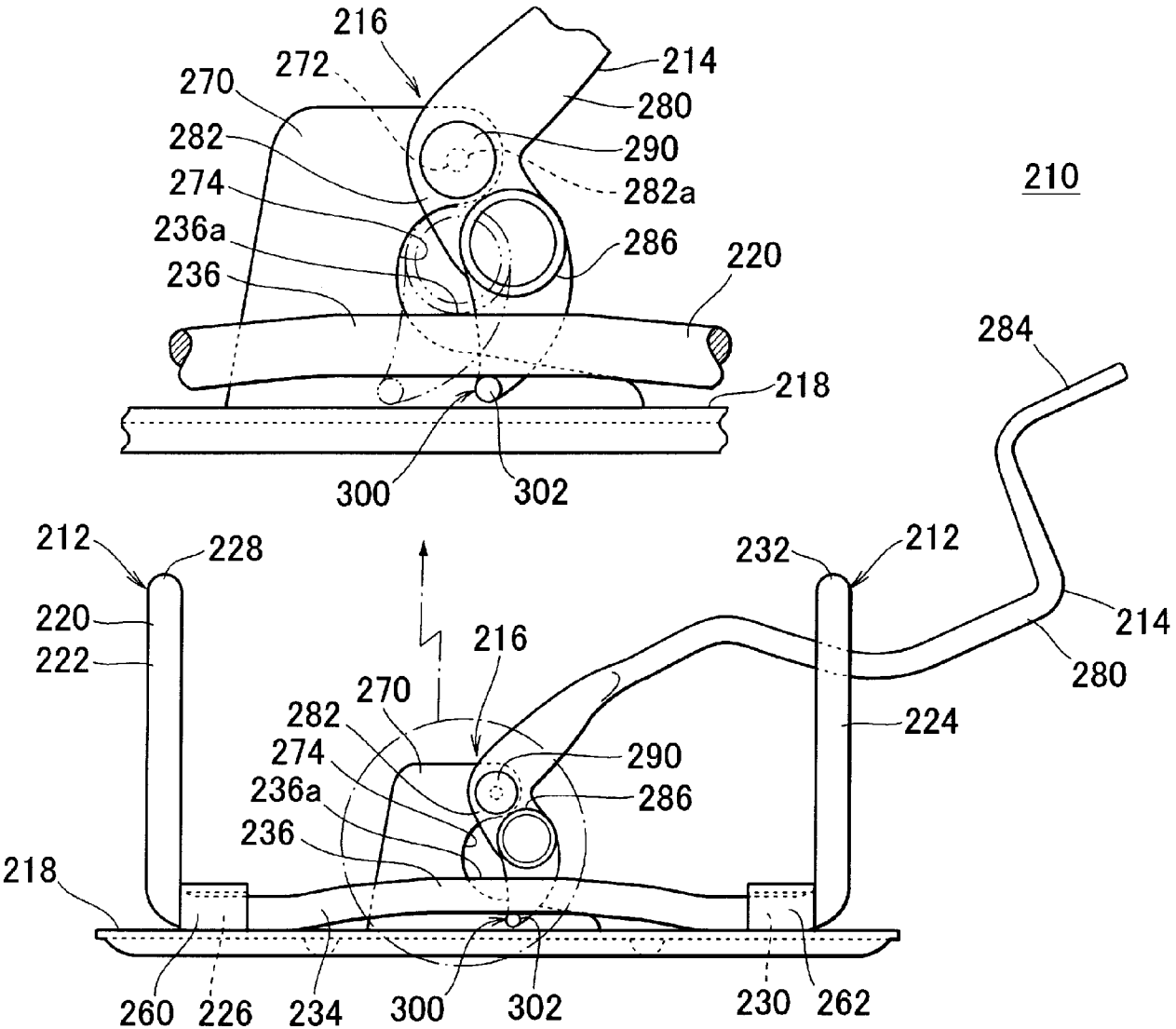
FIG. 13 is a set of left side views illustrating the operating state of the binding device shown in FIG. 11.
Figure 14:
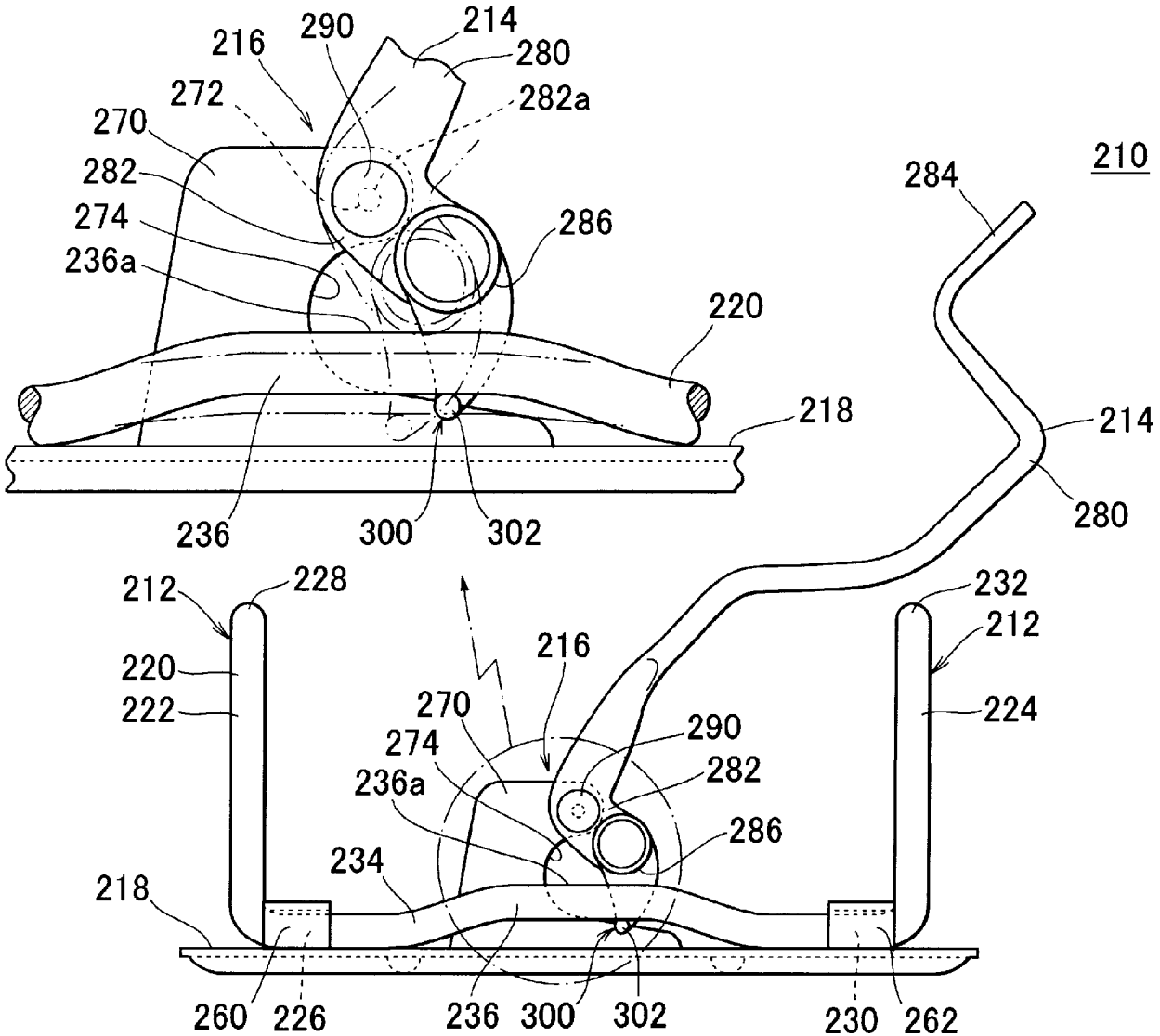
FIG. 14 is a set of left side views illustrating the operating state of the binding device shown in FIG. 11.
Figure 15:
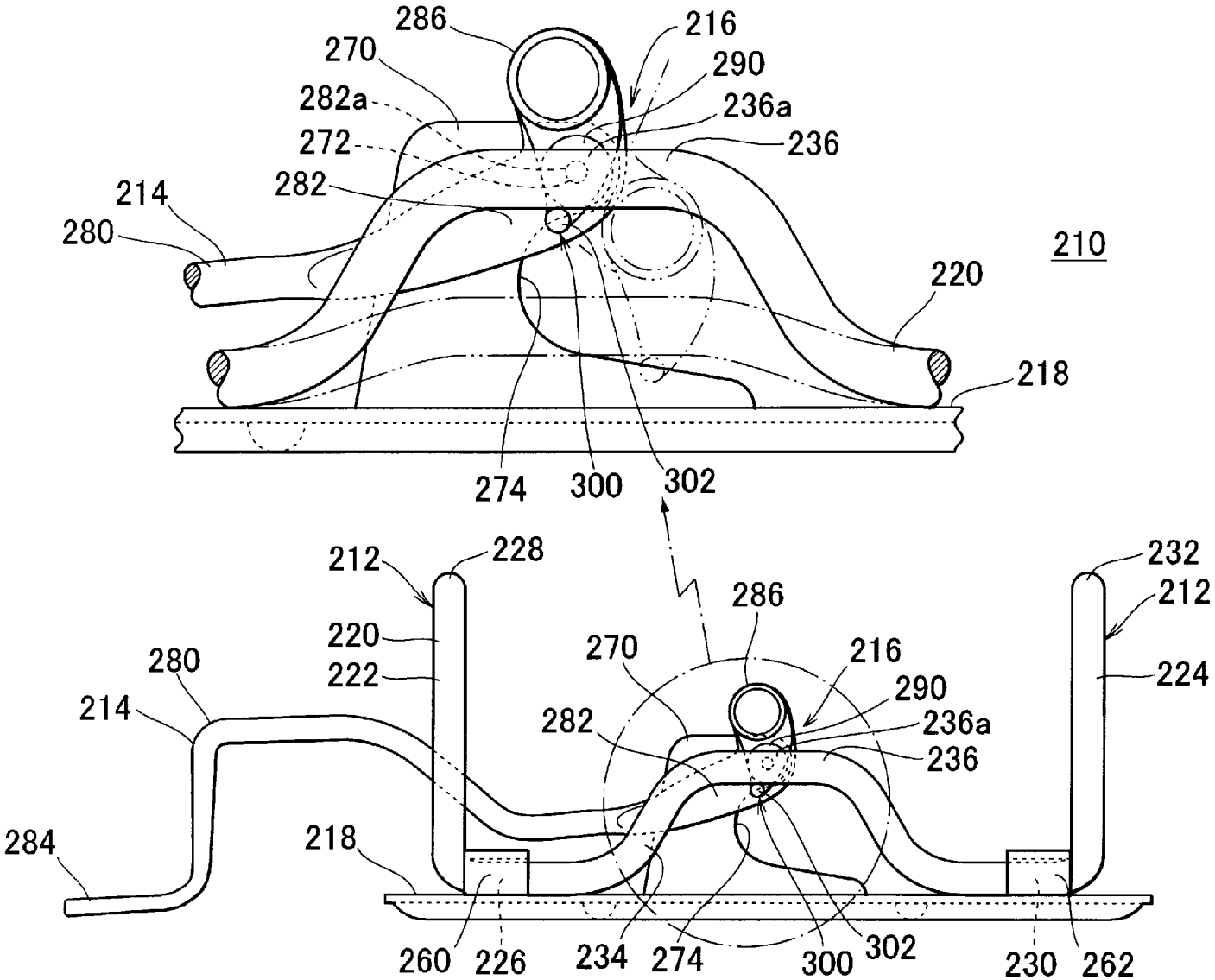
FIG. 15 is a set of left side views illustrating the operating state of the binding device shown in FIG. 11.

FIG. 11 is a perspective view of a binding device of another preferred embodiment of this invention.

FIGS. 12 to 15 are left side views illustrating the operating state of the binding device shown in FIG. 11.

Figure 16:
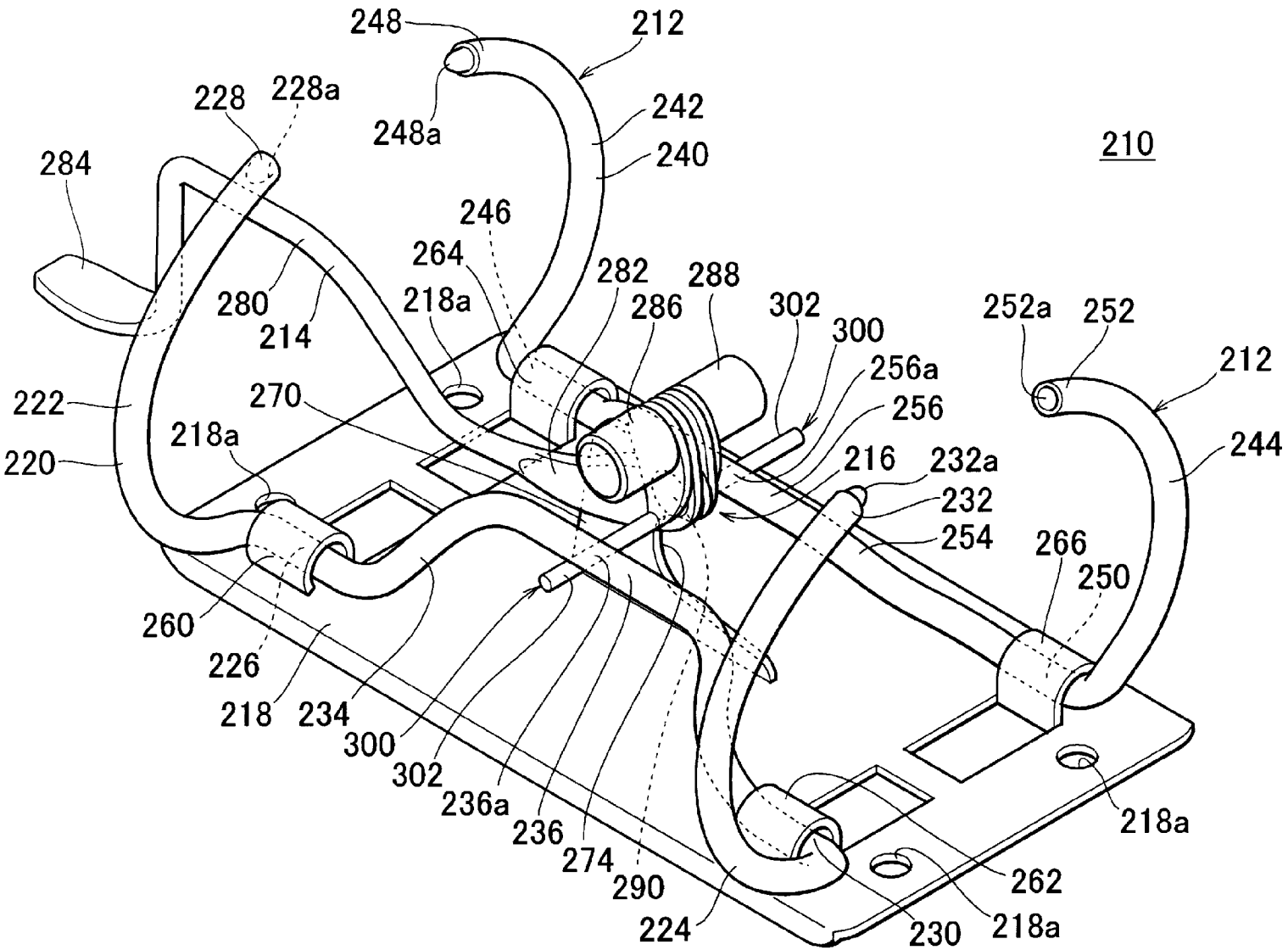
FIG. 16 is a perspective view illustrating the operating state of the binding device shown in FIG. 11.

FIG. 16 is a perspective view illustrating the operating state of the binding device shown in FIG. 11.

A binding device 210 has a configuration similar to that of the binding devise for files and binders shown in FIG. 1, and in particular, is a binding device for use in A-Z files. In this binding device 210, binding rings 212 to be inserted into binding holes $X_1$ of an object X to be bound such as a paper sheet are openably and closeably secured to a base plate 218 so as to be rotationally opened and closed in its tangential direction about pivots near the base plate 218 by means of an opening-closing mechanism 216 including a rotationally movable lever 214.

The binding device 210 includes a pair of a first ring member 220 and a second ring member 240. The first ring member 220 and the second ring member 240 are each integrally formed by bending a cylindrical metal wire and are formed substantially symmetrically.

The binding rings 212 in the first ring member 220 and the binding rings 212 in the second ring member 240 are rotationally moved along the tangential direction of the binding rings 212, so that they are moved in a direction from a closed position at which a closed loop is formed toward an opened position at which the loop is separated or in the opposite direction (an opening-closing direction).

The first ring member 220 has a semi-annular upper binding ring portion 222 defining the binding ring 212 and a semi-annular lower binding ring portion 224 defining the binding ring 212. A pivot portion 226 is provided at the lower end of the upper binding ring portion 222, and a junction 228 is provided at the upper end thereof. A pivot portion 230 is provided at the lower end of the lower binding ring portion 224, and a junction 232 is provided at the upper end thereof, as in the upper binding ring portion 222.

The junction 228 has a recess 228*a* provided at the end thereof, and the junction 232 has a projection 232*a* protruding from the end thereof.

The upper binding ring portion 222 and the lower binding ring portion 224 are connected so as to be opposed to each other through a connection portion 234 between the pivot portion 226 at the lower end of the upper binding ring portion 222 and the pivot portion 230 at the lower end of the lower binding ring portion 224.

Each of the pivot portions 226 and 230 is provided so as to protrude in a direction orthogonal to the opening-closing direction of the upper binding ring portion 222 and the lower binding ring portion 224. Specifically, the pivot portion 226 is provided so as to protrude toward the lower binding ring portion 224, and the pivot portion 230 is provided so as to protrude toward the upper binding ring portion 222.

The connection portion 234 is connected to the pivot portion 226 of the upper binding ring portion 222 and the pivot portion 230 of the lower binding ring portion 224. The connection portion 234 has a curved portion 236 which is configured so as to be curved and protrude toward the junction 228 of the upper binding ring portion 222 and the junction 232 of the lower binding ring portion 224 as the curved portion 236 approaches the center of the connection portion 234.

The curved portion 236 has irregularities provided on the upper surface thereof so as to be provided with the change point of the lever 214 of the opening-closing mechanism 216.

The second ring member 240 has a semi-annular upper binding ring portion 242 defining the binding ring 212 and a semi-annular lower binding ring portion 244 defining the binding ring 212. A pivot portion 246 is provided at the lower end of the upper binding ring portion 242, and a junction 248 is provided at the upper end thereof. A pivot portion 250 is provided at the lower end of the lower binding ring portion 224, and a junction 252 is provided at the upper end thereof, as in the upper binding ring portion 242.

The junction 248 has a projection 248*a* extending from the end thereof, and the junction 252 has a recess 252*a* drilled in the end thereof.

The upper binding ring portion 242 and the lower binding ring portion 244 are connected so as to be opposed to each other through a connection portion 254 between the pivot portion 246 at the lower end of the upper binding ring portion 242 and the pivot portion 250 at the lower end of the lower binding ring portion 244.

Each of the pivot portions 246 and 250 is provided so as to protrude in a direction orthogonal to the opening-closing direction of the upper binding ring portion 242 and the lower binding ring portion 244. Specifically, the pivot portion 246 is provided so as to protrude toward the lower binding ring portion 244, and the pivot portion 250 is provided so as to protrude toward the upper binding ring portion 242.

The connection portion 254 is connected to the pivot portion 246 of the upper binding ring portion 242 and the pivot portion 250 of the lower binding ring portion 244. The connection portion 254 has a curved portion 256 which is configured so as to be curved and protrude toward the junction 248 of the upper binding ring portion 242 and the junction 252 of the lower binding ring portion 244 as the curved portion 256 approaches the center of the connection portion 254.

The curved portion 256 has irregularities provided on the upper surface thereof so as to be provided with the change point of the lever 214 of the opening-closing mechanism 216.

The upper binding ring portion 222 and the lower binding ring portion 224 of the first ring member 220 have the pivot portion 226 and the pivot portion 230, respectively, provided near the left edge of the base plate 218. Furthermore, the upper binding ring portion 222 and the lower binding ring portion 224 have the junction 228 and the junction 232, respectively, which are provided at the respective ends opposite to the pivot portions 226 and 230, respectively, and which are provided near the center in the width direction of the base plate 218. Moreover, the upper binding ring portion 242 and the lower binding ring portion 244 of the second ring member 240 have the pivot portions 246 and 250, respectively, provided near the right edge of the base plate 218. The upper binding ring portion 242 and the lower binding ring portion 244 have the junction 248 and the junction 252, respectively, which are provided at the respective ends opposite to the pivot portions 246 and 250, respectively and which are provided near the center in the width direction of the base plate 218.

The binding rings 212 in the first ring member 220 and the second ring member 240 are each formed into a horizontally elongated ellipsoidal ring shape. Specifically, in the central portion between the pivot portion 226 of the first ring member 220 and the pivot portion 246 of the second ring member 240, i.e., near the widthwise center of the base plate 218, the junction 228 of the first ring member 220 is joined to the junction 248 of the second ring member 240, and the recess 228*a* is engaged with the projection 248*a*, whereby a horizontally elongated ellipsoidal ring shape is formed which defines a closed loop. In addition, the junction 232 of the first ring member 220 is joined to the junction 252 of the second ring member 240, and the projection 232*a* is engaged with the recess 252*a*, whereby a horizontally elongated ellipsoidal ring shape is provided which defines the closed loop.

Specifically, in the binding rings 212, the upper binding ring portion 222 and the upper binding ring portion 242 form a downwardly opened C-shaped ring, and the lower binding ring portion 224 and the lower binding ring portion 244 form a downwardly opened C-shaped ring, whereby a vertical pair of binding rings are provided.

The curved portion 236 of the connection portion 234 of the first ring member 220 and the curved portion 256 of the connection portion 254 of the second ring member 240 are curved so as to be brought close to each other near the center of the base plate 218. The curved portions 236 and 256 extend substantially parallel to each other in the lengthwise direction of the base plate 218, and an appropriate gap for disposing the opening-closing mechanism 216 is provided between the connection portion 234 of the first ring member 220 and the connection portion 254 of the second ring member 240.

Pivot receivers 260 and 262 for pivotally supporting the pivot portions 226 and 230, respectively, of the first ring member 220 and pivot receivers 264 and 266 for pivotally supporting the pivot portions 246 and 250, respectively, of the second ring member 240 are provided in respective four corners of the base plate 218.

In the base plate 218 of this preferred embodiment, each of the pivot receivers 260, 262, 264, and 266 is formed by punching the base plate 218 to form a substantially rectangular U-shaped tongue and curling the punched tongue.

The opening-closing mechanism 216 for the binding rings 212 is provided in the center of the base plate 218.

In this preferred embodiment, the opening-closing mechanism 216 is provided with a lever shaft receiver 270 formed by punching the base plate 218 in the substantial center thereof and bending the punched portion upward.

A shaft hole 272 is drilled in the upper portion of the lever shaft receiver 270, and a recess 274 for allowing the motion of the lever 214 is provided below the shaft hole 272. The lever 214 is rotatably secured to the shaft hole 272 as described later.

The lever 214 includes a substantially linear lever body 280, a rod member 282 which is bent downward at the upper end (the far side) of the lever body 280 and protrudes in a direction orthogonal to the lever body 280, and a substantially L-shaped operation portion 284 which is bent upward at the lower end (the near side) of the lever body 280 and protrudes in a direction orthogonal to the lever body 280.

A shaft hole 282*a* is drilled in the rod member 282. Furthermore, a first securing portion 286 which rolls on the curved portion 236 of the connection portion 234 of the first ring member 220 and a second securing portion 288 which rolls on the curved portion 256 of the connection portion 254 of the second ring member are rotatably secured to a bent portion which is located directly below the shaft hole 282*a* and at which the lever body 280 and the rod member 282 are connected to each other.

The lever 214 is configured so as to be capable of rotatably moving in a direction orthogonal to the opening-closing direction of the binding rings 212 in the first ring member 220 and the binding rings 212 in the second ring member 240 through a pivot 290 inserted into the shaft hole 282*a* of the rod member 282 and into the shaft hole 272 of the lever shaft receiver 270 of the base plate 218.

The curved portion 236 of the first ring member 220 and the curved portion 256 of the second ring member 240 have an upward swelling projection 236*a* and an upward swelling projection 256*a*, respectively, each provided near a portion below the shaft hole 272 of the lever shaft receiver 270. The projections 236*a* and 256*a* are provided such that the first securing portion 286 and the second securing portion 288 of the lever 214 climb over the change point of the lever mechanism when lowered to the lowermost position.

The first securing portion 286 of the lever 214 is configured so as to roll on the curved portion 236 of the first ring member 220, and the second securing portion 288 of the lever 214 is configured so as to roll on the curved portion 256 of the second ring member 240. Each of the first securing portion 286 and the second securing portion 288 is configured so as to rotationally move about the pivot 290 from a horizontal position (a state in which the binding rings 212 are closed) in a direction orthogonal to the opening-closing direction of the binding ring 212.

The opening-closing mechanism 216 is provided with a pushing-up member 300 which urges the binding rings 212 in an opening direction.

The pushing-up member 300 has a pushing-up rod 302 provided at a position abutting on the lower portions of the curved portion 236 of the first ring member 220 and the second ring member 240. The pushing-up rod 302 is provided in the lower end of the rod member 282 so as to protrude below the curved portions 236 and 256.

When the lever 214 is rotationally moved about the pivot 290 in order to bring the binding rings 212 from a closed state to an opened state, the pushing-up rod 302 of the pushing-up member 300 is moved from the front side (the far side) to the rear side (the near side) and is raised as the rod member 282 is rotationally moved and pushes up the curved portions 236 and 256.

The first ring member 220 is opened about the pivot portions 226 and 230 in a counterclockwise direction by the pushing-up force of the pushing-up member 300, and the second ring member 240 is opened about the pivot portions 246 and 250 in a clockwise direction by the pushing-up force.

In a state where the binding rings 212 in the first ring member 220 and the second ring member 240 are opened, the lever 214 is moved upward, and the first securing portion 286 and the second securing portion 288 roll on the curved portion 236 of the first ring member 220 and the curved portion 256 of the second ring member 240, respectively, and move toward the lower side (the near side). Therefore, the first securing portion 286 and the second securing portion 288 do not push down the curved portion 236 of the first ring member 220 and the curved portion 256 of the second ring member 240, respectively. Furthermore, the curved portion 236 of the first ring member 220 and the curved portion 256 of the second ring member 240 are pushed upward by the urging force of the pushing-up member 300.

Thus, the junction 228 of the first ring member 220 and the junction 248 of the second ring member 240 are moved in mutually separating directions, and the junction 232 of the first ring member 220 and the junction 252 of the second ring member 240 are moved in mutually separating directions. The binding rings 212 in the first ring member 220 are opened about 20 degrees from a perpendicular line passing through the pivot portions 226 and 230, and the binding rings 212 in the second ring member 240 are opened about 20 degrees from a perpendicular line passing through the pivot portions 246 and 250. Specifically, the first ring member 220 is opened by being rotated in a counterclockwise direction, and the second ring member 240 is opened by being rotated in a clockwise direction.

When the upper binding ring portion 222 and the lower binding ring portion 224 of the first ring member 220 and the upper binding ring portion 242 and the lower binding ring portion 244 of the second ring member 240 are opened, an operation area for the lever 214 is opened. Then, the lever 214 can pass between the binding rings 212 in the first ring member 220 and the second ring member 240 and can be rotationally moved until reaching the upper side (the far side) of the base plate 218. Hence, the lever 214 can be secured in a horizontal state in which the lever 214 comes close to the upper surface of the base plate 218.

Therefore, the upper binding ring portion 242 of the second ring member 240 and the lower binding ring portion 244 of the second ring member 240 can be inserted into binding holes $X_1$ of an object X to be bound such as a paper sheet without being disturbed by the lever 214, whereby the object X to be bound can be inserted.

After the object X to be bound is inserted, when the lever 214 is rotationally moved toward the lower side (the near side), the first securing portion 286 and the second securing portion 288 again push down the curved portion 236 of the first ring member 220 and the curved portion 256 of the second ring member 240, respectively. Then, when the lever 214 is pushed down against the urging force of the pushing-up member 300, the lever 214 is secured in a position beyond the change point, and the binding rings 212 in the first ring member 220 and the second ring member 240 are secured in place.

This binding device 210 is attached to a spine $C_1$ of a cover C of a file by inserting rivets or other suitable fasteners through respective four attaching holes 218*a* provided in the base plate 218.

Moreover, this invention can be modified as shown in FIGS. 17 to 28.

Figure 17:
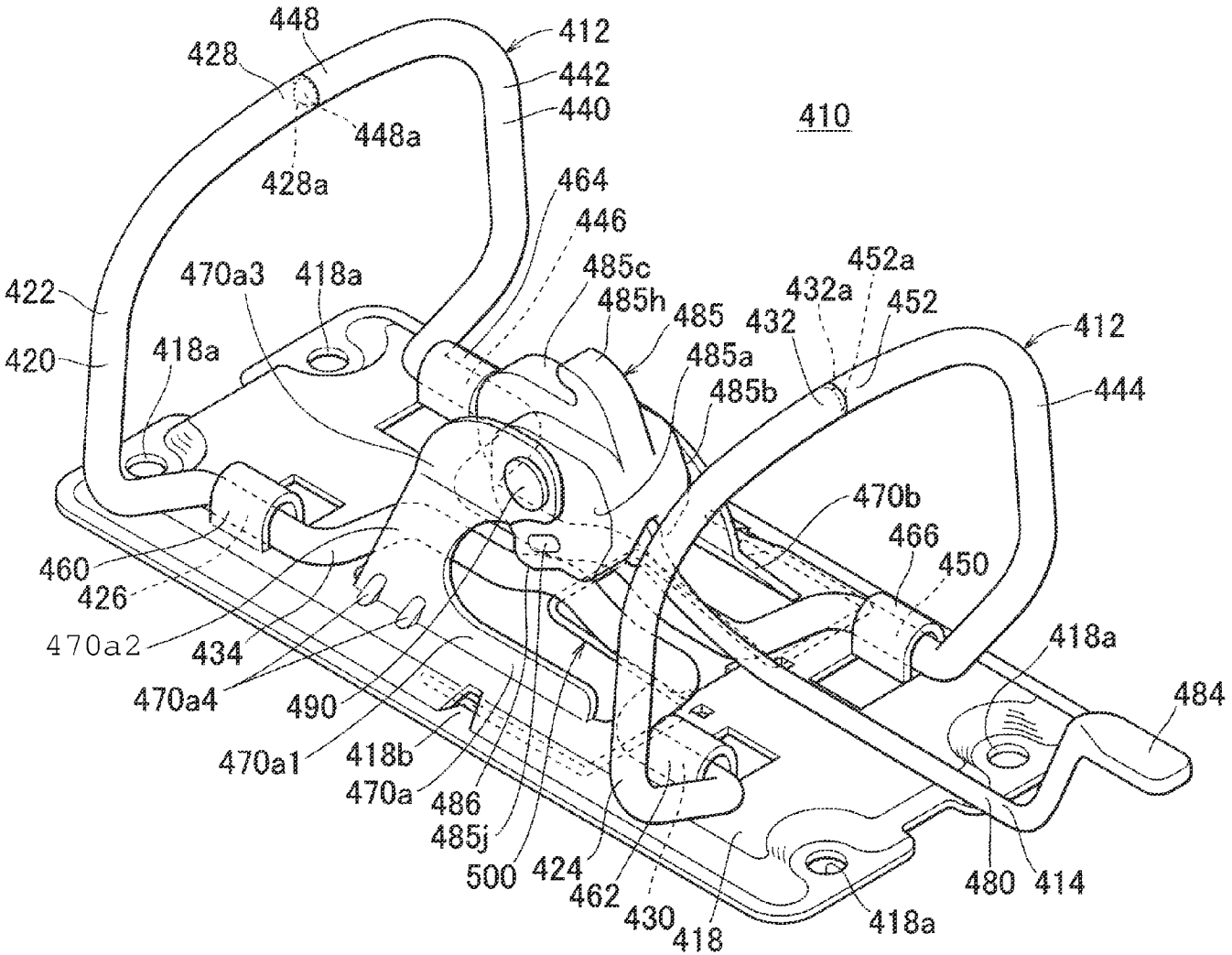
FIG. 17 is a perspective view of a binding device of another preferred embodiment of the present invention.

FIG. 17 is a perspective view of a binding device of another preferred embodiment of this invention.

Figure 18:
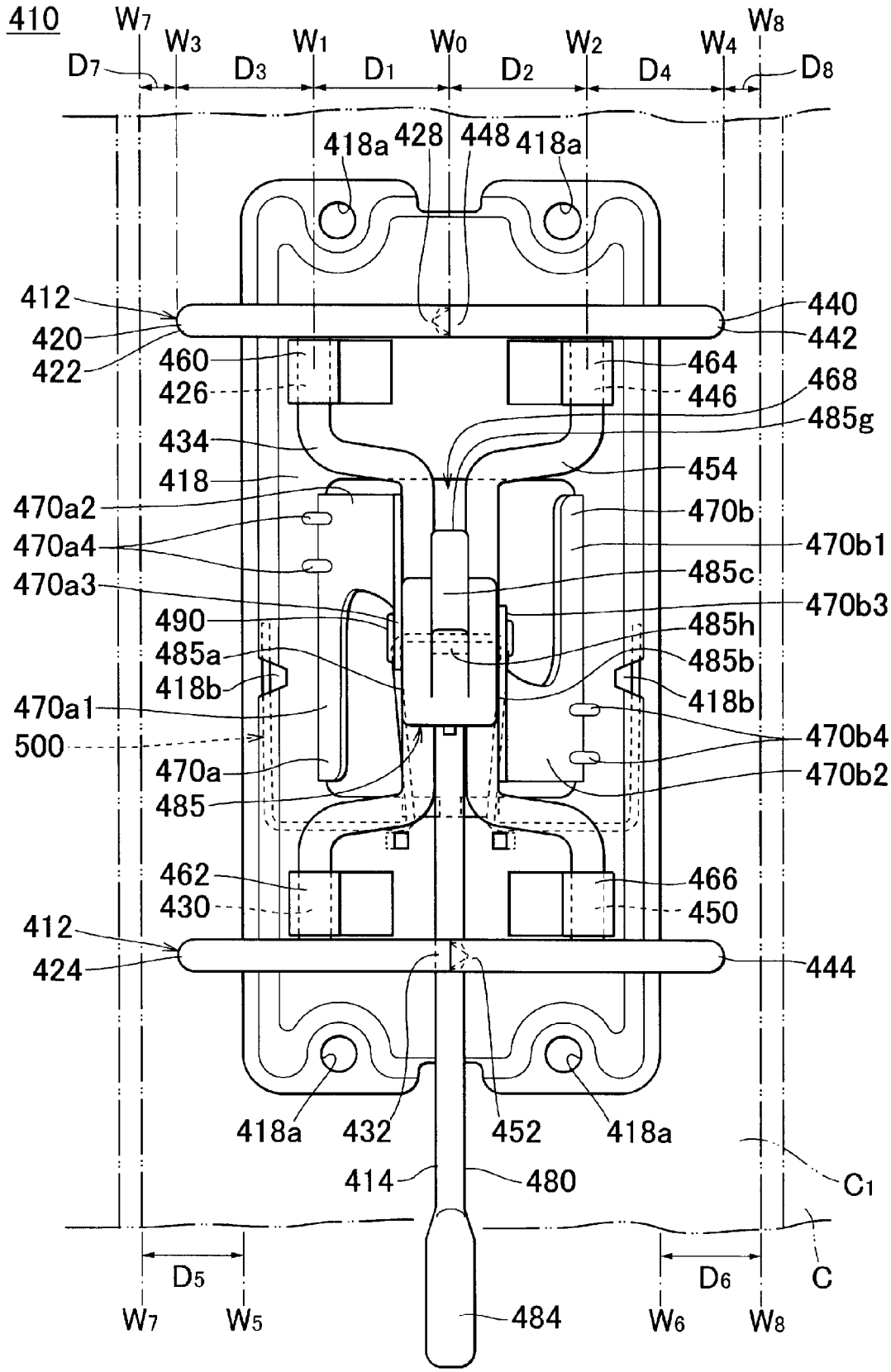
FIG. 18 is a plan view of the binding device shown in FIG. 17.

FIG. 18 is a plan view of the binding device shown in FIG. 17.

Figure 19:
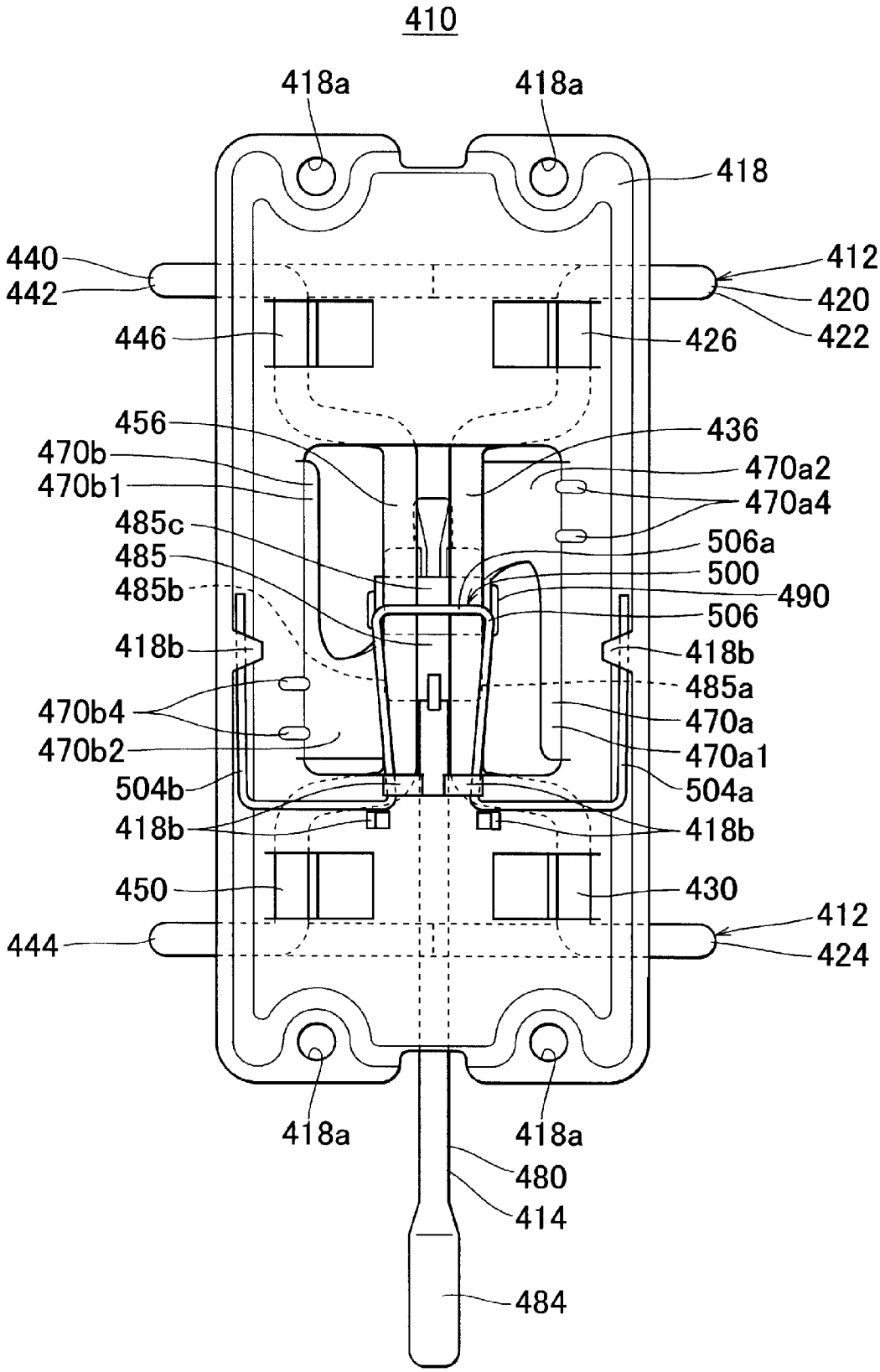
FIG. 19 is a rear view of the binding device (in a state in which binding rings are closed) shown in FIG. 17.
Figure 20:
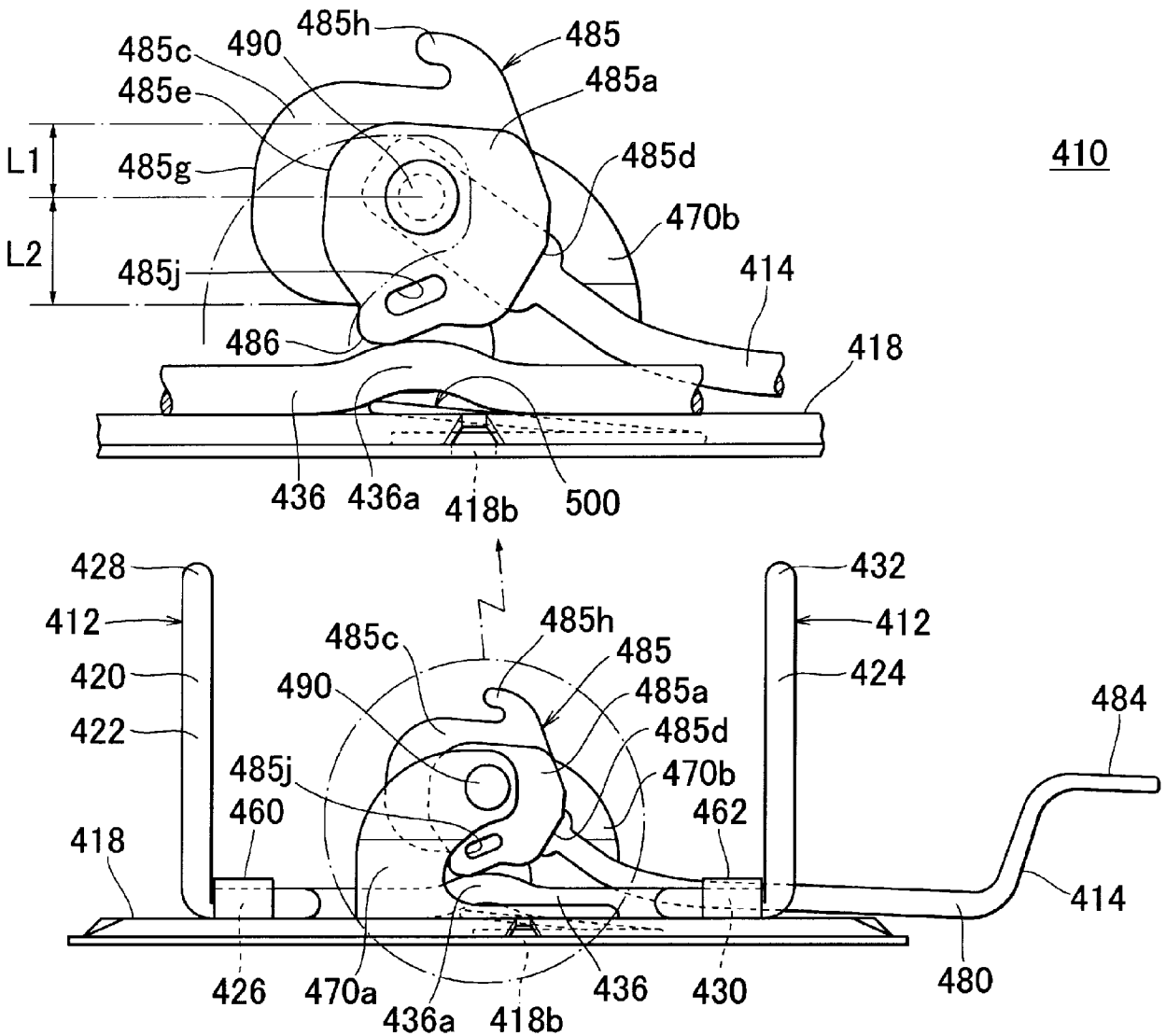
FIG. 20 is a set of left side views illustrating the operating state of the binding device (in a state in which the binding rings are closed) shown in FIG. 17.

FIG. 19 is a rear view of the binding device shown in FIG. 17.

FIGS. 20 to 23 are left side views illustrating the operating state of the binding device shown in FIG. 17.

Figure 24:
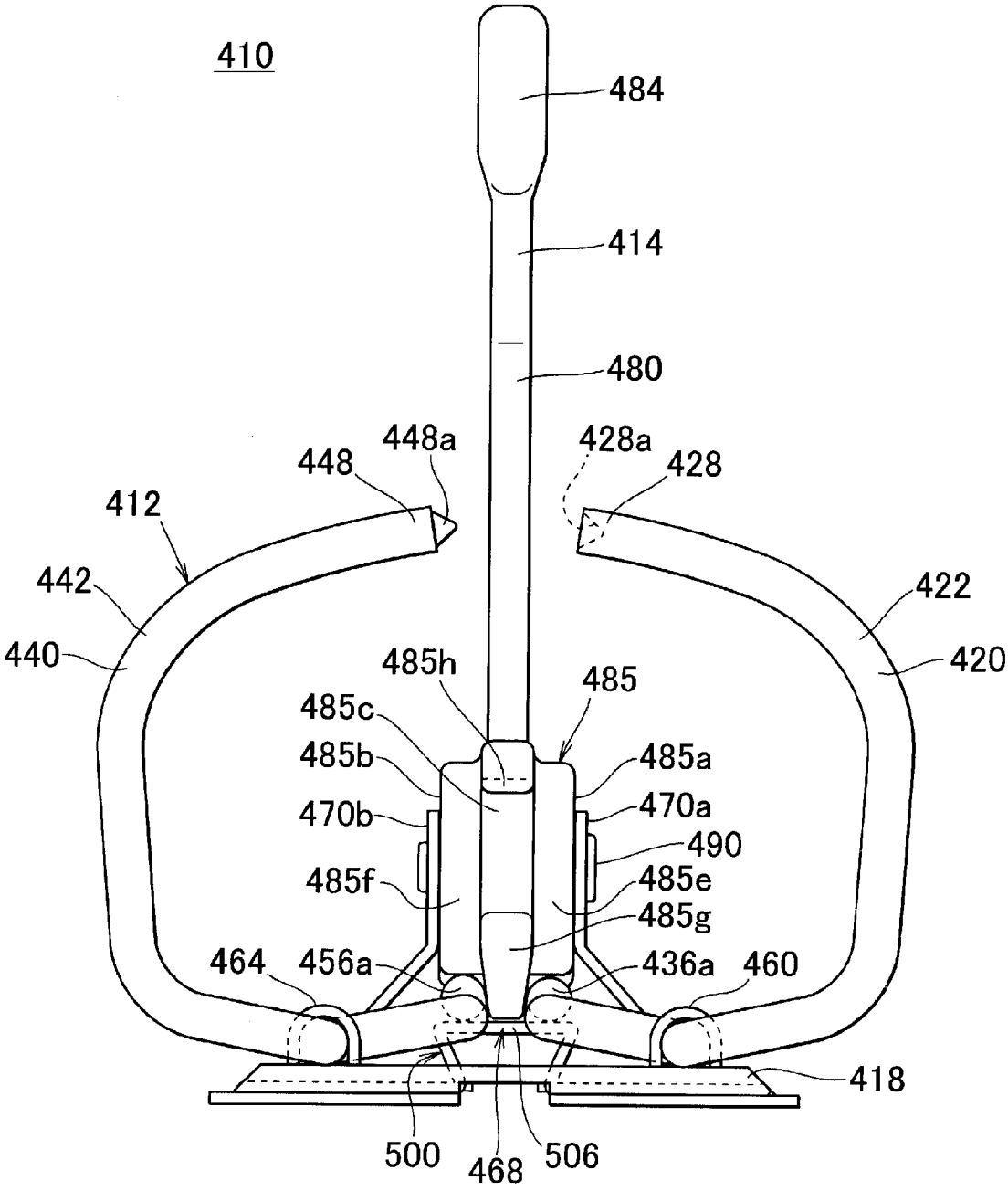
FIG. 24 is a front view illustrating the operating state of the binding device (in a state in which the binding rings start opening) shown in FIG. 17.
Figure 25:
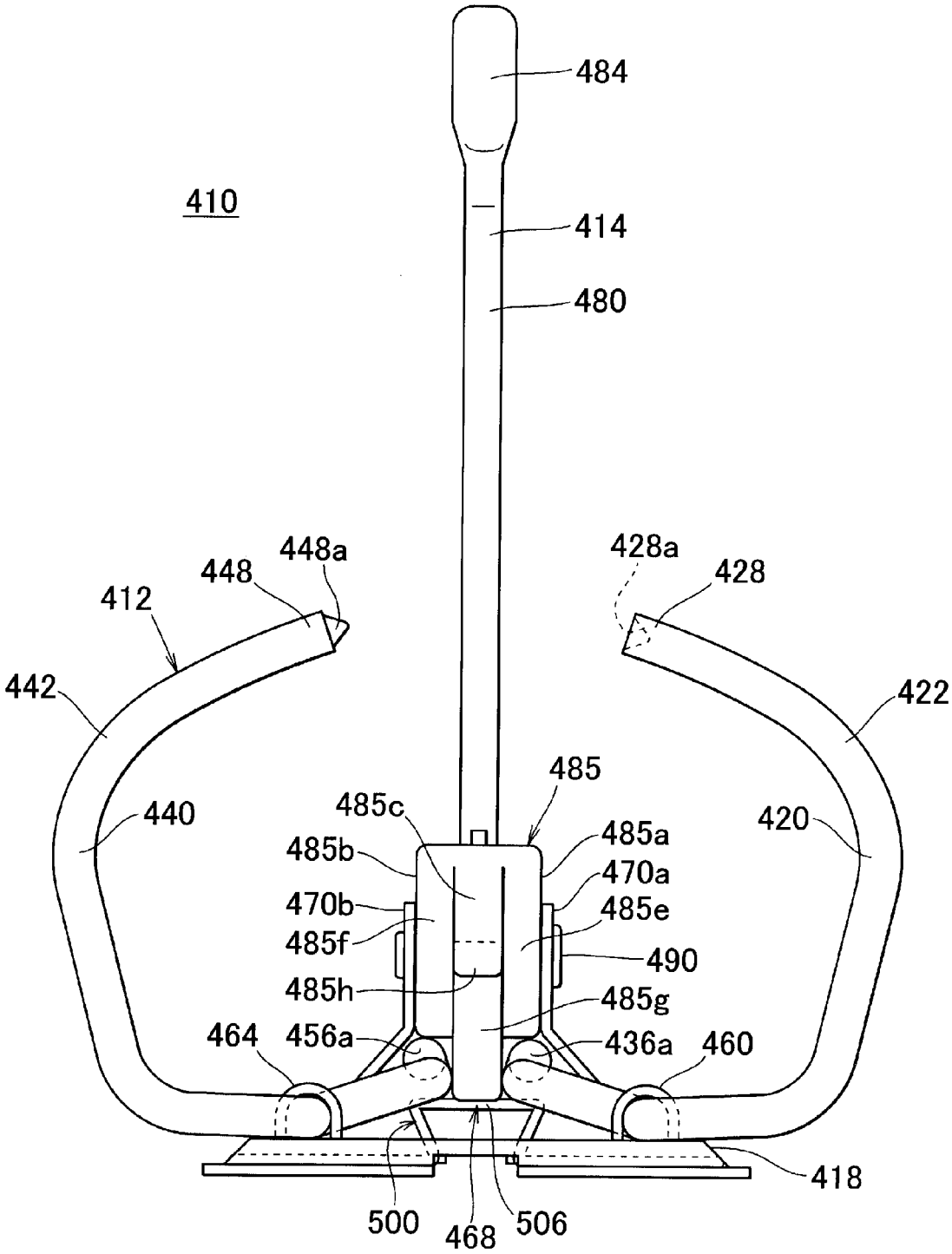
FIG. 25 is a front view illustrating the operating state of the binding device (in a state in which the lever is rotated to a midpoint) shown in FIG. 17.

FIGS. 24 and 25 are front views illustrating the operating state of the binding device shown in FIG. 17.

Figure 26:
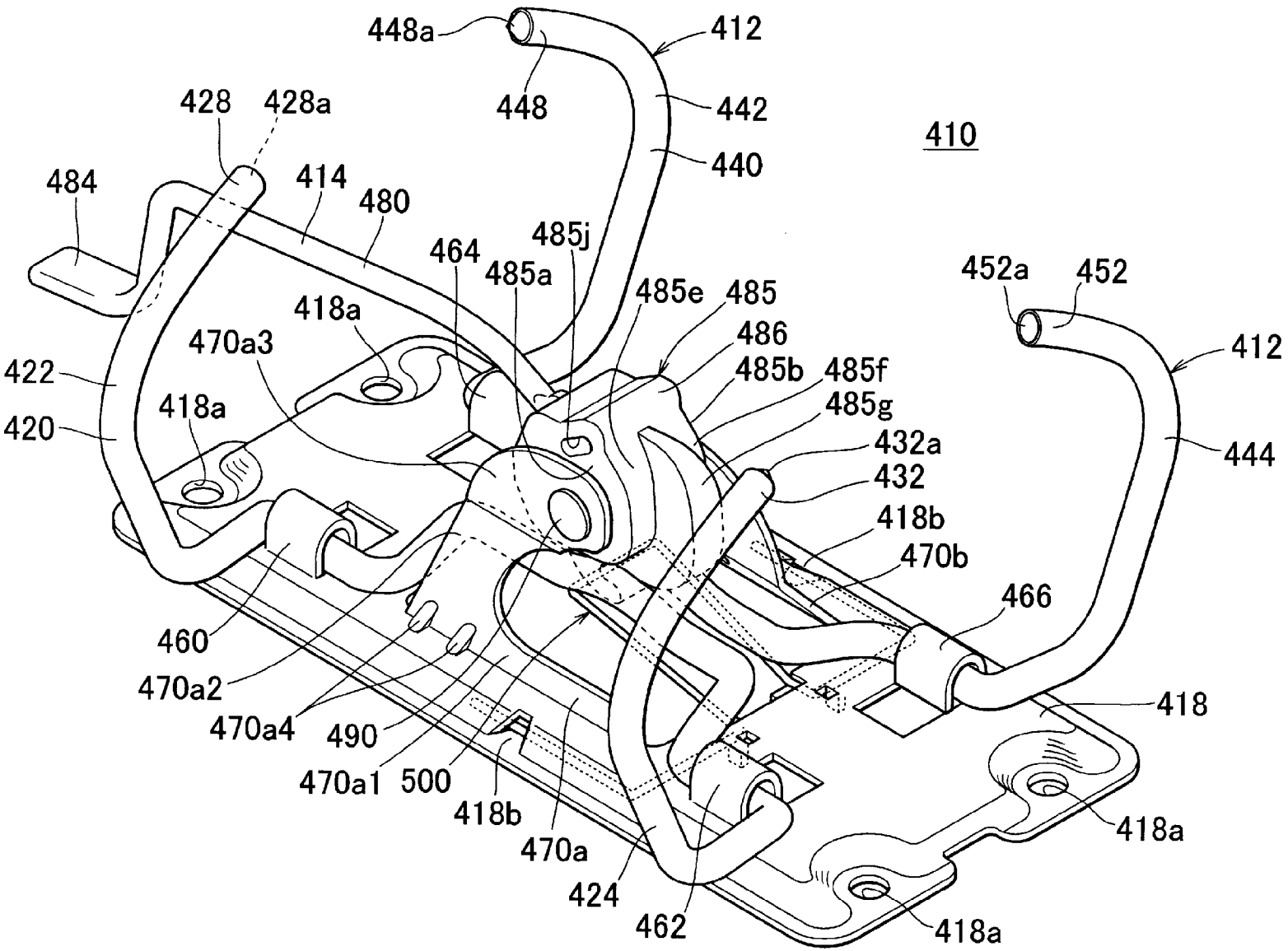
FIG. 26 is a perspective view illustrating the operating state of the binding device (in a state in which the binding rings are opened) shown in FIG. 17.

FIG. 26 is a perspective view illustrating the operating state of the binding device shown in FIG. 17.

Figure 27:
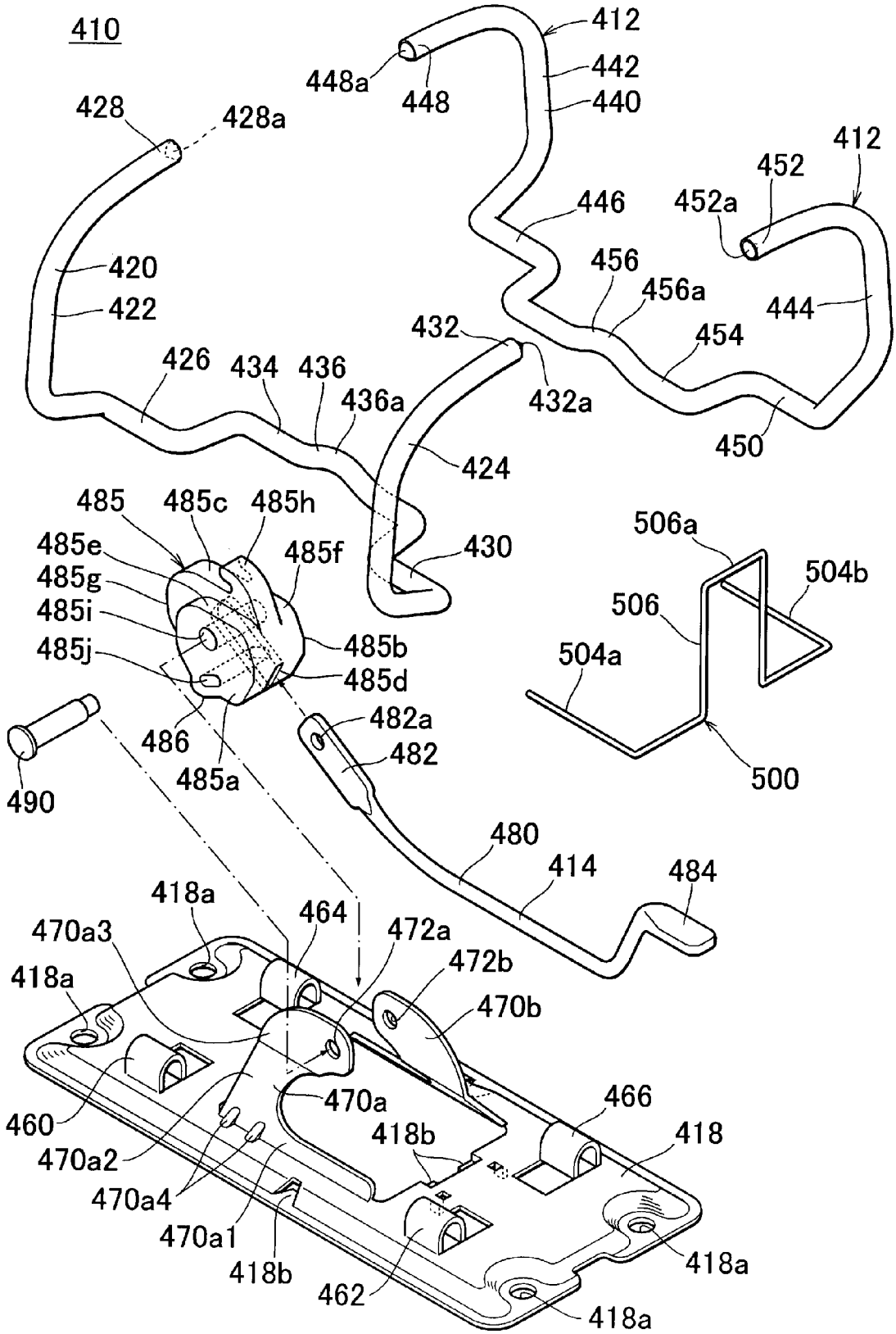
FIG. 27 is an exploded perspective view of the binding device shown in FIG. 17.

FIG. 27 is an exploded perspective view of the binding device shown in FIG. 17.

Figure 28:
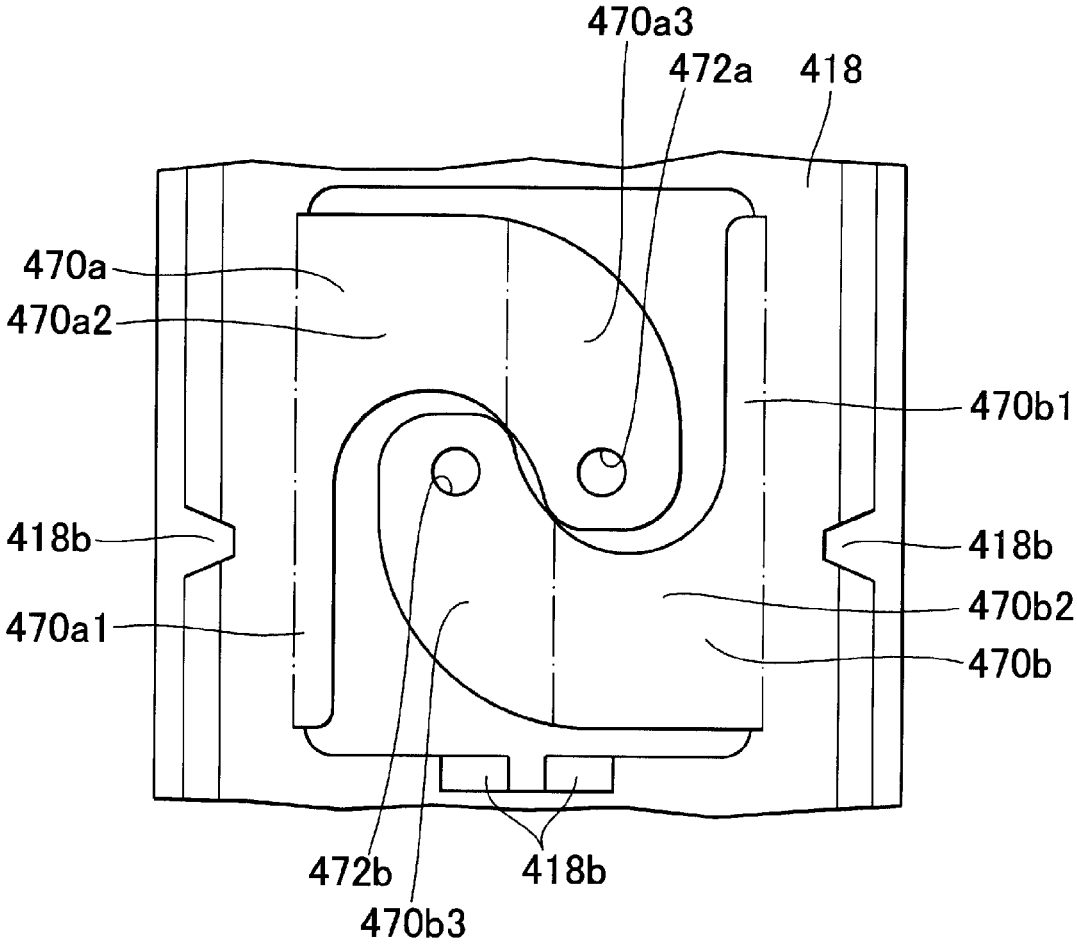
FIG. 28 is a plan view of a base plate of the binding device shown in FIG. 17 before machining.

FIG. 28 is a plan view of a base plate of the binding device shown in FIG. 17 before machining.

A binding device 410 is a binding device for files and binders and particularly is a binding device for use in A-Z files. In this binding device 410, binding rings 412 to be inserted into binding holes $X_1$ of an object X to be bound such as a paper sheet are openably and closeably secured to a base plate 418 so as to be rotationally opened and closed in its tangential direction about pivots near the base plate 418 by an opening-closing mechanism 416 including a rotationally movable lever 414.

The binding device 410 includes a pair of a first ring member 420 and a second ring member 440. The first ring member 420 and the second ring member 440 are each integrally formed by bending a cylindrical metal wire and are formed substantially symmetrically.

The binding rings 412 in the first ring member 420 and the binding rings 412 in the second ring member 440 are rotationally moved along the tangential direction of the binding rings 412, so that they are moved in a direction from a closed position at which a closed loop is formed toward an opened position at which the loop is separated or in the opposite direction (an opening-closing direction).

The first ring member 420 has a semi-annular upper binding ring portion 422 defining the binding rings 412 and a semi-annular lower binding ring portion 424 defining the binding rings 412. A pivot portion 426 is provided at the lower end of the upper binding ring portion 422, and a junction 428 is provided at the upper end thereof. A pivot portion 430 is provided at the lower end of the lower binding ring portion 424, and a junction 432 is provided at the upper end thereof, as in the upper binding ring portion 422.

The junction 428 has a recess 428*a* provided at the end thereof, and the junction 432 has a projection 432*a* protruding from the end thereof.

The upper binding ring portion 422 and the lower binding ring portion 424 are connected so as to be opposed to each other through a connection portion 434 between the pivot portion 426 at the lower end of the upper binding ring portion 422 and the pivot portion 430 at the lower end of the lower binding ring portion 424.

Each of the pivot portions 426 and 430 is provided so as to protrude in a direction orthogonal to the opening-closing direction of the upper binding ring portion 422 and the lower binding ring portion 424. Specifically, the pivot portion 426 is provided so as to protrude toward the lower binding ring portion 424, and the pivot portion 430 is provided so as to protrude toward the upper binding ring portion 422.

The connection portion 434 is connected to the pivot portion 426 of the upper binding ring portion 422 and the pivot portion 430 of the lower binding ring portion 424. The connection portion 434 has a curved portion 436 which is formed so as to be curved and protrude toward the junction 428 of the upper binding ring portion 422 and the junction 432 of the lower binding ring portion 424 as the curved portion 436 approaches the center of the connection portion 434.

The curved portion 436 has irregularities provided on the upper surface thereof so as to be provided with the change point of the lever 414 of the opening-closing mechanism 416.

The second ring member 440 has a semi-annular upper binding ring portion 442 defining the binding ring 412 and a semi-annular lower binding ring portion 444 defining the binding ring 412. A pivot portion 446 is provided at the lower end of the upper binding ring portion 442, and a junction 448 is provided at the upper end. A pivot portion 450 is provided at the lower end of the lower binding ring portion 424, and a junction 452 is provided at the upper end, as in the upper binding ring portion 442.

The junction 448 has a projection 448*a* provided at the end thereof, and the junction 452 has a recess 452*a* provided at the end thereof.

The upper binding ring portion 442 and the lower binding ring portion 444 are connected so as to be opposed to each other through a connection portion 454 between the pivot portion 446 at the lower end of the upper binding ring portion 442 and the pivot portion 450 at the lower end of the lower binding ring portion 444.

Each of the pivot portions 446 and 450 is provided so as to protrude in a direction orthogonal to the opening-closing direction of the upper binding ring portion 442 and the lower binding ring portion 444. Specifically, the pivot portion 446 is provided so as to protrude toward the lower binding ring portion 444, and the pivot portion 450 is provided so as to protrude toward the upper binding ring portion 442.

The connection portion 454 is connected to the pivot portion 446 of the upper binding ring portion 442 and the pivot portion 450 of the lower binding ring portion 444. The connection portion 454 has a curved portion 456 which is configured so as to be curved and protrude toward the junction 448 of the upper binding ring portion 442 and the junction 452 of the lower binding ring portion 444 as the curved portion 456 approaches the center of the connection portion 454.

The curved portion 456 has irregularities provided on the upper surface thereof so as to be provided with the change point of the lever 414 of the opening-closing mechanism 416.

The upper binding ring portion 422 and the lower binding ring portion 424 of the first ring member 420 have the pivot portion 426 and the pivot portion 430, respectively, provided near the left edge of the base plate 418. Furthermore, the upper binding ring portion 422 and the lower binding ring portion 424 have the junction 428 and the junction 432, respectively, which are provided at the respective ends opposite to the pivot portions 426 and 430, respectively, and which are provided near the center in the width direction of the base plate 418. Moreover, the upper binding ring portion 442 and the lower binding ring portion 444 of the second ring member 440 have the pivot portion 446 and the pivot portion 450, respectively, provided near the right edge of the base plate 418. The upper binding ring portion 442 and the lower binding ring portion 444 have the junction 448 and the junction 452, respectively, which are provided at the respective ends opposite to the pivot portions 446 and 450, respectively, and which are provided near the center in the width direction of the base plate 418.

$D_1$ is the length between a perpendicular plane $W_1$ which passes through the pivot portions 426 and 430 and a perpendicular plane $W_0$ which passes through the connected junctions 448 and 452. $D_2$ is the length between a perpendicular plane $W_2$ which passes through the junction 428 and the junction 432 and the perpendicular plane $W_0$ which passes through the junctions 432 and 448 and the connected junction 452. The length $D_1$ is equal to the length $D_2$.

$D_3$ is the length between a perpendicular plane $W_3$ which passes through the leftmost edge of the upper binding ring portion 422 and the lower binding ring portion 424 and the perpendicular plane $W_1$ which passes through the pivot portions 426 and 430. $D_4$ is the length between a perpendicular plane $W_4$ which passes through the rightmost edge of the upper binding ring portion 442 and the lower binding ring portion 444 and the perpendicular plane $W_2$ which passes through the pivot portions 446 and 450. The length $D_3$ is equal to the length $D_4$.

The length between the perpendicular plane $W_3$ which passes through the leftmost edge of the upper binding ring portion 422 and the lower binding ring portion 424 and a perpendicular plane $W_5$ which passes through the leftmost edge of the base plate 418 is equal to the length between the perpendicular plane $W_4$ which passes through the rightmost edge of the upper binding ring portion 442 and the lower binding ring portion 444 and a perpendicular plane $W_6$ which passes through the rightmost edge of the base plate 418.

The binding rings 412 in the first ring member 420 and the second ring member 440 are each formed into a horizontally elongated ellipsoidal ring shape. Specifically, in the central portion between the pivot portions 426 and 430 of the first ring member 420 and the pivot portions 446 and 450 of the second ring member 440, i.e., near the widthwise center of the base plate 418, the junction 428 of the first ring member 420 is joined to the junction 448 of the second ring member 440, and the recess 428*a* is engaged with the projection 448*a*, whereby a horizontally elongated ellipsoidal ring shape is formed which defines a closed loop. In addition to this, the junction 432 of the first ring member 420 is joined to the junction 452 of the second ring member 440, and the projection 432*a* is engaged with the recess 452*a*, whereby a horizontally elongated ellipsoidal ring shape is formed which defines the closed loop.

Specifically, in the bindings ring 412, the upper binding ring portion 422 and the upper binding ring portion 442 define a downwardly opened C-shaped ring, and the lower binding ring portion 424 and the lower binding ring portion 444 define a downwardly opened C-shaped ring, whereby a vertical pair of binding rings are provided.

The curved portion 436 of the connection portion 434 of the first ring member 420 and the curved portion 456 of the connection portion 454 of the second ring member 440 come close to each other near the central portion of the base plate 418 and are arranged in substantially parallel to each other. Furthermore, the curved portions 436 and 456 are bent such that a gap portion 468 is provided therebetween. The curved portions 436 and 456 extend substantially parallel to each other in the lengthwise direction of the base plate 418, and an appropriate gap for disposing the opening-closing mechanism 416 is provided between the connection portion 434 of the first ring member 420 and the connection portion 454 of the second ring member 440.

Pivot receivers 460 and 462 for pivotally supporting the pivot portions 426 and 430, respectively, of the first ring member 420 and pivot receivers 464 and 466 for pivotally supporting the pivot portions 446 and 450, respectively, of the second ring member 440 are provided in respective four corners of the base plate 418.

Specifically, the pivot portion 426, the junction 428, the pivot portion 430, and the junction 432 are provided in the base plate 418 such that the junctions 448 and 452 are joined on the perpendicular plane $W_0$ which passes through the center between the perpendicular plane $W_5$ passing through the left edge of the base plate 418 and the perpendicular plane $W_6$ passing through the right edge of the base plate 418.

In the base plate 418 of this preferred embodiment, each of the pivot receivers 460, 462, 464, and 466 is formed by punching the base plate 418 to form a substantially rectangular U-shaped tongue, bending the punched tongue upwardly from the lower side of the base plate 418, and curling the bent tongue.

The opening-closing mechanism 416 for the binding rings 412 is provided in the center of the base plate 418.

In this preferred embodiment, the opening-closing mechanism 416 is provided with a lever shaft receiver 470 including a left-right pair of opposed shaft receivers formed by punching the base plate 418 in the substantial center thereof and bending the punched portions upward so as to be erected parallel to each other.

The lever shaft receiver 470 is defined by an erected arch shaped first shaft-receiving portion 470*a* and an erected arch shaped second shaft-receiving portion 470*b* which stand on the base plate 418 in parallel to each other. The first shaft-receiving portion 470*a* and the second shaft-receiving portion 470*b* are provided so as to be opposed to each other on parallel lines lying on the opposite side-edge sides of the lengthwise centerline (corresponding to $W_0$) of the single-plate-like base plate 418 with an appropriate distance from the lengthwise centerline. Furthermore, the first shaft-receiving portion 470*a* and the second shaft-receiving portion 470*b* are arranged so as to be point symmetric with respect to the center of the centerline.

A more detailed description is given below. First and second ends of a base portion 470*a*1 of the first shaft-receiving portion 470*a* and first and second ends of a base portion 470*b*1 of the second shaft-receiving portion 470*b* are erected from the base plate 418 so as to be equally spaced from the lengthwise centerline of the base plate 418 and to be separated by the same distance from the lengthwise center of the base plate 418. In the first shaft-receiving portion 470*a* and the second shaft-receiving portion 470*b*, both the base portions 470*a*1 and 470*b*1 extend in the lengthwise direction. The first shaft-receiving portion 470*a* and the second shaft-receiving portion 470*b* are provided with a neck portion 470*a*2 and a neck portion 470*b*2, respectively, which protrude upward from the first end sides of the base portions 470*a*1 and 470*b*1, respectively, and a head portion 470*a*3 and a head portion 470*b*3, respectively, which are provided above the neck portions 470*a*2 and 470*b*2, respectively, and protrude inwardly.

In the lever shaft receiver 470, a shaft hole 472*a* is drilled in the head portion 470*a*3, and a shaft hole 472*b* is drilled in the head portion 470*b*3. Furthermore, the lever 414 is rotatably secured to the shaft holes 472*a* and 472*b* as described later.

Moreover, two supporting portions 470*a*4 separated by a predetermined distance are provided in the lower end portion on the first end side of the base portion 470*a*1 of the first shaft-receiving portion 470*a*. Similarly, two supporting portions 470*b*4 separated by a predetermined distance are provided in the lower end portion on the first end side of the base portion 470*b*1 of the second shaft-receiving portion 470*b*.

In the base plate 418, the substantially entire portion, except for the peripheral edges of a metal plate having a rectangular shape in a plan view and for the vicinity of an attaching hole 418*a* provided in the four corners of the metal plate, is swelled from the bottom side toward the plane side, whereby the strength is increased and an accommodation space for an urging member 500 described later is provided. In addition, each of the first shaft-receiving portion 470*a*, the second shaft-receiving portion 470*b*, and the pivot receivers 460, 462, 464, and 466 is formed into a predetermined shape by bending and curling, from the bottom side toward the plane side, a region partitioned by a punched slit formed in advance.

Moreover, when the substantially entire portion of the base plate 418 is swelled, portions to be swelled and portions not to be swelled are partitioned by a punched slit provided in advance in the base plate 418 in order to form urging member-attaching portions 418*b*, and the partitioned regions are bent or not bent to form the urging member-attaching portions 418*b* in the base plate 418.

The supporting portions 470*a*4 and 470*b*4 are formed by bending the lower portions of the base portion 470*a*1 of the first shaft-receiving portion 470*a* and the base portion 470*b*1 of the second shaft-receiving portion 470*b*, respectively, from the bottom side toward the plane side.

As shown in FIG. 28, the first shaft-receiving portion 470*a* and the second shaft-receiving portion 470*b* are formed into a pair of swirl-like shapes in the single-plate-like base plate 418. Thus, the first shaft-receiving portion 470*a* and the second shaft-receiving portion 470*b* are formed from the single-plate-like base plate 418 by punching and bending.

Specifically, in the single-plate-like base plate 418, the neck portion 470*a*2 of the first shaft-receiving portion 470*a* and the head portion 470*b*3 of the second shaft-receiving portion 470*b* are formed so as to be adjacent to each other, and the neck portion 470*b*2 of the second shaft-receiving portion 470*b* and the head portion 470*a*3 of the first shaft-receiving portion 470*a* are formed so as to be adjacent to each other. Furthermore, the shaft holes 472*a* and 472*b* drilled in the head portion 470*a*3 of the first shaft-receiving portion 470*a* and the head portion 470*b*3 of the second shaft-receiving portion 470*b*, respectively, are formed such that the centers thereof are aligned along a line orthogonal to the lengthwise direction of the single-plate-like base plate 418.

Moreover, the curved portion 436 of the first ring member 420 and the curved portion 456 of the second ring member 440 are disposed on the inner side of the first shaft-receiving portion 470*a* and the second shaft-receiving portion 470*b*.

The lever 414 includes a substantially linear lever body 480, a rod member 482 which protrudes from the upper end (the far side) of the lever body 480 and is bent upward, and a substantially L-shaped operation portion 484 which is provided on the free end side of the rod member 482, is bent upward at the lower end (the near side) of the lever body 480, and protrudes in a direction orthogonal to the lever body 480.

The lever 414 is arranged such that, when the lever 414 is rotationally moved to an opened position, the first ring member 420 and the second ring member 440 having the binding rings 412 are opened simultaneously and that, when the lever 414 is rotationally moved to a closed position, the first ring member 420 and the second ring member 440 having the binding rings 412 are closed simultaneously. A shaft hole 482*a* is drilled in the rod member 482.

The lever 414 is configured so as to be capable of rotatably moving in a direction orthogonal to the opening-closing direction of the binding rings 412 in the first ring member 420 and the binding rings 412 in the second ring member 440 through a pivot member 485 secured to the end of the rod member 482.

The lever 414 is secured at an end of the lever body (the end opposite to the operation portion 484) to the pivot member 485 intervening between the first shaft-receiving portion 470*a* and the second shaft-receiving portion 470*b*. The pivot member 485 is secured to the shaft holes 472*a* and 472*b* in the lever shaft receiver 470 through a pivot 490.

In the pivot member 485, a synthetic resin-made substantially disc-like main body 485*c* is provided laterally with a planar left-side portion 485*a* and a planar right-side portion 485*b* which are joined to the first shaft-receiving portion 470*a* and the second shaft-receiving portion 470*b*, respectively, so as to be sandwiched therebetween. In addition, a lever attaching portion 485*d* is provided on the near side of the substantially disc-like main body 485*c*. Furthermore, a left-right pair of rolling portions 485*e* and 485*f* are continuously provided on the far side of the substantially disc-like main body 485*c*, i.e., on the side opposite to the lever attaching portion 485*d*, so as to extend from the lower portion to the upper portion of the substantially disc-like main body 485*c*. Each of the rolling portions 485*e* and 485*f* has an appropriate width (corresponding to the shape and position of the curved portions 436 and 456 in the state in which the binding rings 412 are closed) from the side edge of the planar left-side portion 485*a* or the side edge of the planar right-side portion 485*b*.

The left-right pair of the rolling portions 485*e* and 485*f* are configured to have the same route so that they follow the same trajectory when rotationally moved from the position in a closed state of the binding rings 412 to the position in an opened state of the binding rings 412 or vice versa.

The upper portion of each of the rolling portions 485*e* and 485*f* is lowered toward the pivot 490 side in order to prevent the curved portion 436 of the first ring member 420 and the curved portion 456 of the second ring member 440 from being pushed down when the lever 414 is brought into the opened position, i.e., the lever 414 is rotationally moved to open the binding rings 412 and in order to maintain the first ring member 420 and the second ring member 440 in the opened state. Furthermore, the distance (L1) with the pivot 490 is short. Meanwhile, the lower portion of the rolling portions 485*e* and 485*f* is made long from the pivot 490 side, so that, when the lever 414 is brought into the closed position, i.e., the lever 414 is rotationally moved to close the binding rings 412, the lower portion pushes down the curved portion 436 of the first ring member 420 and the curved portion 456 of the second ring member 440 to secure the first ring member 420 and the second ring member 440 in a closed state. Furthermore, the distance (L2) with the pivot 490 is long.

Figure 29:
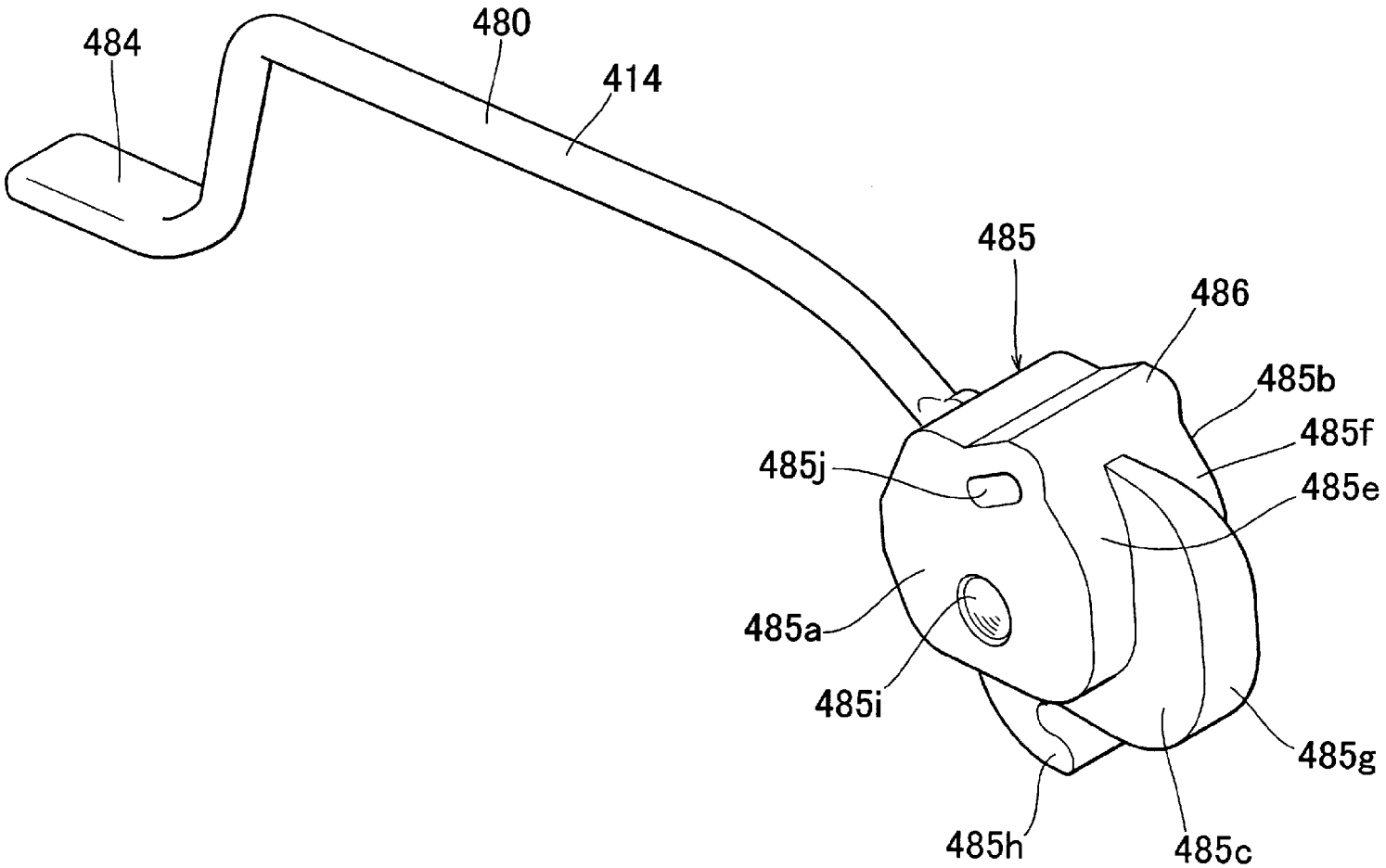
FIG. 29 is a perspective view of a pivot member.

As shown in FIG. 29, a first securing portion 486 is provided so as to protrude downward from the final end of the rolling portions 485*e* and 485*f*, i.e., from the lower portion on a perpendicular line passing through a pivot hole 485*i* provided at the substantial center of the substantially disc-like main body 485*c*. The first securing portion 486 is provided for securing the upper surface of the curved portion 436 of the first ring member 420 and the upper surface of the curved portion 456 of the second ring member 440 by the pivot member 485 which rotates when the lever 414 is rotationally moved to open-close the binding rings 412.

The first securing portion 486 is configured to have an arc-shaped cross-section as viewed from the side so that the end thereof presses and secures a projection 436*a* of the curved portion 436 and a projection 456*a* of the curved portion 456.

When the first ring member 420 and the second ring member 440 are in a completely closed state, the first securing portion 486 is located beyond the projections 436*a* and 456*a* and engages with the inclined surface of each of the projections 436*a* and 456*a*, i.e., the upper surface on the side (the far side) on which the lever 414 is positioned when the first ring member 420 and the second ring member 440 are opened.

A restricting portion 485*g* is provided so as to protrude between the rolling portions 485*e* and 485*f*. When the lever 414 is rotationally moved to the far side to bring the upper binding ring portion 422 and the lower binding ring portion 424 into the opened state, the restricting portion 485*g* is inserted between the curved portion 436 of the first ring member 420 and the curved portion 456 of the second ring member 440. Therefore, the restricting portion 485*g* is provided for securing the first ring member 420 and the second ring member 440 in an opened state in order to prevent the opened first ring member 420 and the opened second ring member 440 from being closed.

The restricting portion 485*g* is configured in a tapered protruding shape, as viewed from the front, in which the width thereof increases toward the curved portion 436 side and the curved portion 456 side as the position approaches the upper portion. In this manner, when the lever 414 is rotationally moved to start opening the binding rings 412, the restricting portion 485*g* starts entering the gap between the curved portion 436 of the first ring member 420 and the curved portion 456 of the second ring member 440. Furthermore, when the lever is further rotationally moved, the gap between the curved portion 436 of the first ring member 420 and the curved portion 456 of the second ring member 440 is forced to be gradually widened to allow the lever 414 to rotationally move.

The restricting portion 485*g* is provided along the rolling portions 485*e* and 485*f* on the rotation trajectory of the pivot member 485. Therefore, even when the first ring member 420 and the second ring member 440 are operated in the closing direction, the restricting portion 485*g* enters the gap between the curved portion 436 of the first ring member 420 and the curved portion 456 of the second ring member 440, so that the first ring member 420 and the second ring member 440 can be prevented from being closed.

The restricting portion 485*g* is configured in a tapered protruding shape, as viewed from the front, in which the width thereof is increased as the position approaches the upper portion, so that, as the lever 414 is rotationally moved, the restricting portion 485*g* gradually enters the gap at the curved portion 436 of the first ring member 420 and is rotationally moved while widening the gap. Therefore, when the pivot member 485 is rotationally moved, the tapered restricting portion 485*g* gradually enters the gap between the first ring member 420 and the second ring member 440 as if a wedge is inserted into the gap, whereby the widening of the gap between the first ring member 420 and the second ring member 440 is facilitated.

The restricting portion 485*g* is further continuously formed up to the upper portion of the substantially disc-like main body 485*c* (in the state in which the first ring member 420 and the second ring member 440 are closed). An engaging portion 485*h* having a goose-neck like shape as viewed from the side is provided in the uppermost portion of the restricting portion 485*g* in a protruding manner.

The engaging portion 485*h* is provided in the upper portion on a perpendicular line passing through the pivot hole 485*i* provided at the substantial center of the substantially disc-like main body 485*c*.

The curved portion 436 of the first ring member 420 and the curved portion 456 of the second ring member 440 are arranged such that the rolling portions 485*e* and 485*f* roll on the upper surface thereof when the lever 414 is opened or closed, i.e., the lever 414 is rotationally moved to open or close the binding rings 412. Furthermore, the upwardly swelling projections 436*a* and 456*a* are provided near a portion below the shaft holes 472 of the lever shaft receiver 470 such that the first securing portion 486 of the lever 414 climbs over the change point of the lever mechanism when lowered to the lowermost position.

The first securing portion 486 of the lever 414 is configured so as to roll on the curved portion 436 of the first ring member 420 and on the curved portion 456 of the second ring member 440 and is also configured so as to be rotationally moved about the pivot 490 from a horizontal state (the closed state of the binding rings 412) in a direction orthogonal to the opening-closing direction of the binding rings 412.

An absorbing hole portion 485*j* is in the upper portion of the first securing portion 486 in the pivot member 485. The absorbing hole portion 485*j* is provided for absorbing a force of the first securing portion 486 for pushing the curved portion 436 of the first ring member 420 and the curved portion 456 of the second ring member 440 when the first ring member 420 and the second ring member 440 are secured.

The opening-closing mechanism 416 is provided with an urging member 500 which urges the binding rings 412 in an opening direction.

The urging member 500 has a pushing-up portion 506 having a substantially rectangular U-shape in a plan view and securing portions 504*a* and 504*b* having a substantially L-shape in a plan view and provided so as to protrude outward from the respective opposed ends of the pushing-up portion 506. The securing portions 504*a* and 504*b* are secured on the rear surface of the base plate 418, more specifically, on the rear surface near the pivot receivers 462 and 466, through the urging member-attaching portions 418*b* formed in the base plate 418. At the substantial center of the base plate 418, the pushing-up portion 506 protrudes inwardly from the space between the connection portion 434 of the first ring member 420 and the connection portion 454 of the second ring member 440. Hence, the pushing-up portion 506 pushes up the curved portions 436 and 456 from the lower sides of the curved portions 436 and 456 and urges the first ring member 420 and the second ring member 440 to open them.

Specifically, the urging member 500 abuts on the lower portion of the curved portion 436 of the first ring member 420 (a portion lower than the change point of the lever (a portion on the near side)) and also on the lower portion of the curved portion 456 of the second ring member 440 (a portion lower than the change point of the lever (a portion on the near side)) and urges the curved portions 436 and 456 upward in a pushing-up manner.

The first ring member 420 is opened about the pivot portions 426 and 430 in a counterclockwise direction (as viewed from the front) by the urging force of the urging member 500, and the second ring member 440 is opened about the pivot portions 446 and 450 in a clockwise direction (as viewed from the front) by the urging force.

An end portion 506*a* at the free end of the pushing-up portion 506 is provided at a position at which the end portion 506*a* is engaged with the engaging portion 485*h* of the pivot member 485 which is rotated so as to open the binding rings 412 by rotationally moving the lever 414. Thus, the engaging portion 485*h* of the pivot member 485 is secured to the end portion 506*a* of the pushing-up portion 506, whereby the lever 414 is firmly secured such that the opened state of the binding rings 412 is maintained.

The urging member 500 is secured near the base of pushing-up portion 506 and near the pushing-up portion 506 side of each of the securing portions 504*a* and 504*b* through the urging member-attaching portions 418*b* formed at the substantial widthwise center of the base plate 418. In addition, the urging member 500 is secured at the end (free end) of each of the securing portions 504*a* and 504*b* by the urging member-attaching portions 418*b* near the lengthwise center in the left and right edges of the base plate 418.

Figure 21:
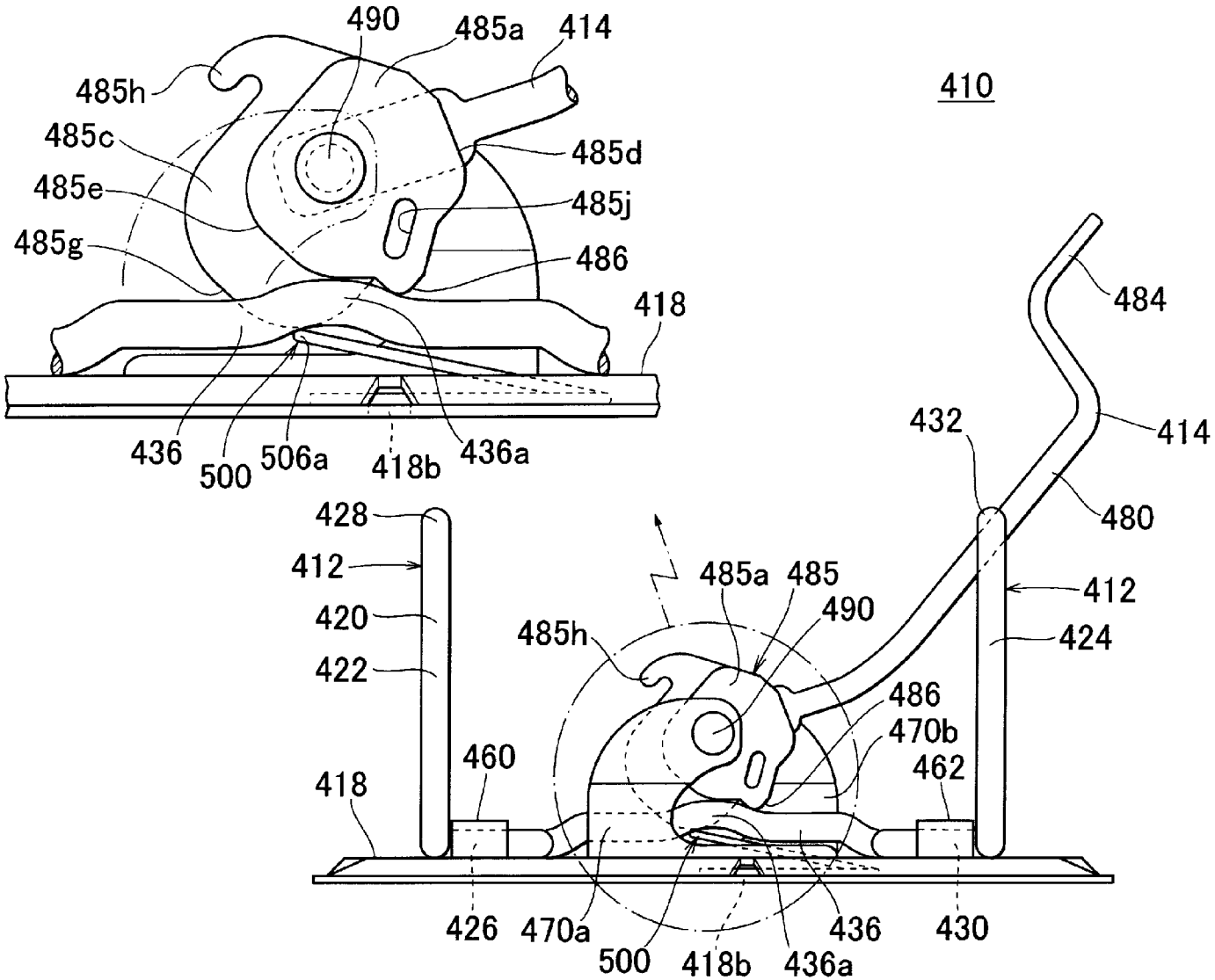
FIG. 21 is a set of left side views illustrating the operating state of the binding device (in a state in which the binding rings start opening) shown in FIG. 17.

In a state in which the binding rings 412 in the first ring member 420 and the second ring member 440 are closed (see FIG. 20), the lever 414 is moved upward as shown in FIG. 21, and the first securing portion 486 rolls on the curved portion 436 of the first ring member 420 and the curved portion 456 of the second ring member 440 and moves toward the lower side (the near side). Therefore, the first securing portion 486 does not push down the curved portion 436 of the first ring member 420 and the curved portion 456 of the second ring member 440. Furthermore, the curved portion 436 of the first ring member 420 and the curved portion 456 of the second ring member 440 are pushed upward by the urging force of the urging member 500.

Figure 22:
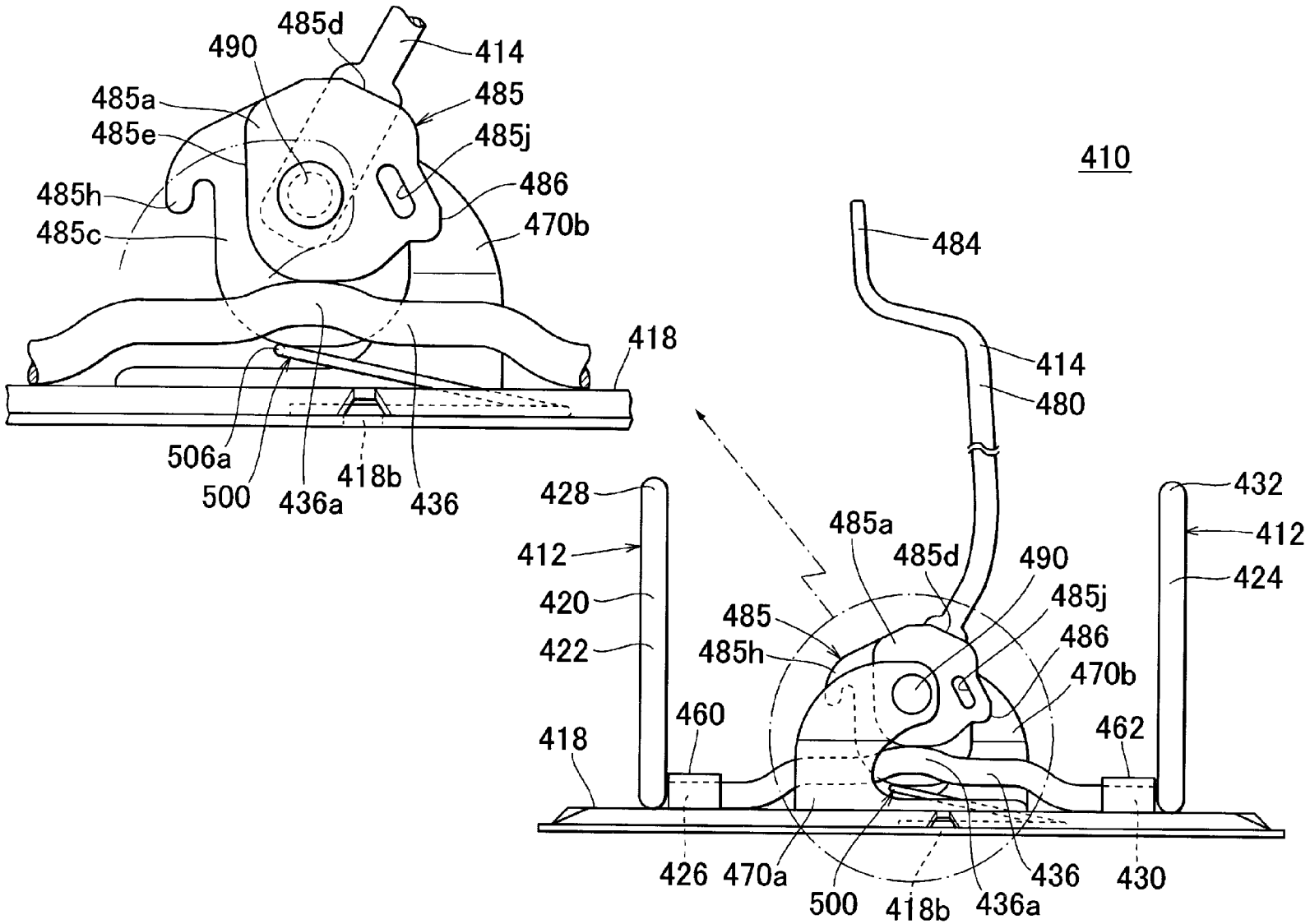
FIG. 22 is a set of left side views illustrating the operating state of the binding device (in a state in which a lever is rotated to a midpoint) shown in FIG. 17.

Thus, as shown in FIG. 21, when the lever 414 is rotationally moved to the upper side (the far side), the restricting portion 485*g* of the pivot member 485, which has a tapered shape, starts entering the gap between the curved portion 436 of the first ring member 420 and the curved portion 456 of the second ring member 440 like a wedge (see FIG. 24). Furthermore, as shown in FIG. 22, as the lever 414 is rotationally moved, the restricting portion 485*g* forces the gap between the curved portion 436 of the first ring member 420 and the second ring portion 456 to be gradually widened (see FIG. 25).

In this manner, the junction 428 of the first ring member 420 and the junction 448 of the second ring member 440 are moved in mutually separating directions, and the junction 432 of the first ring member 420 and the junction 452 of the second ring member 440 are moved in mutually separating directions. The binding rings 412 in the first ring member 420 are opened about 20 degrees from a perpendicular line passing through the pivot portions 426 and 430, and the binding rings 412 in the second ring member 440 are opened about 20 degrees from a perpendicular line passing through the pivot portions 446 and 450. Specifically, the first ring member 420 is opened by being rotated in a counterclockwise direction (as viewed from the front), and the second ring member 440 is opened by being rotated in a clockwise direction (as viewed from the front).

Figure 23:
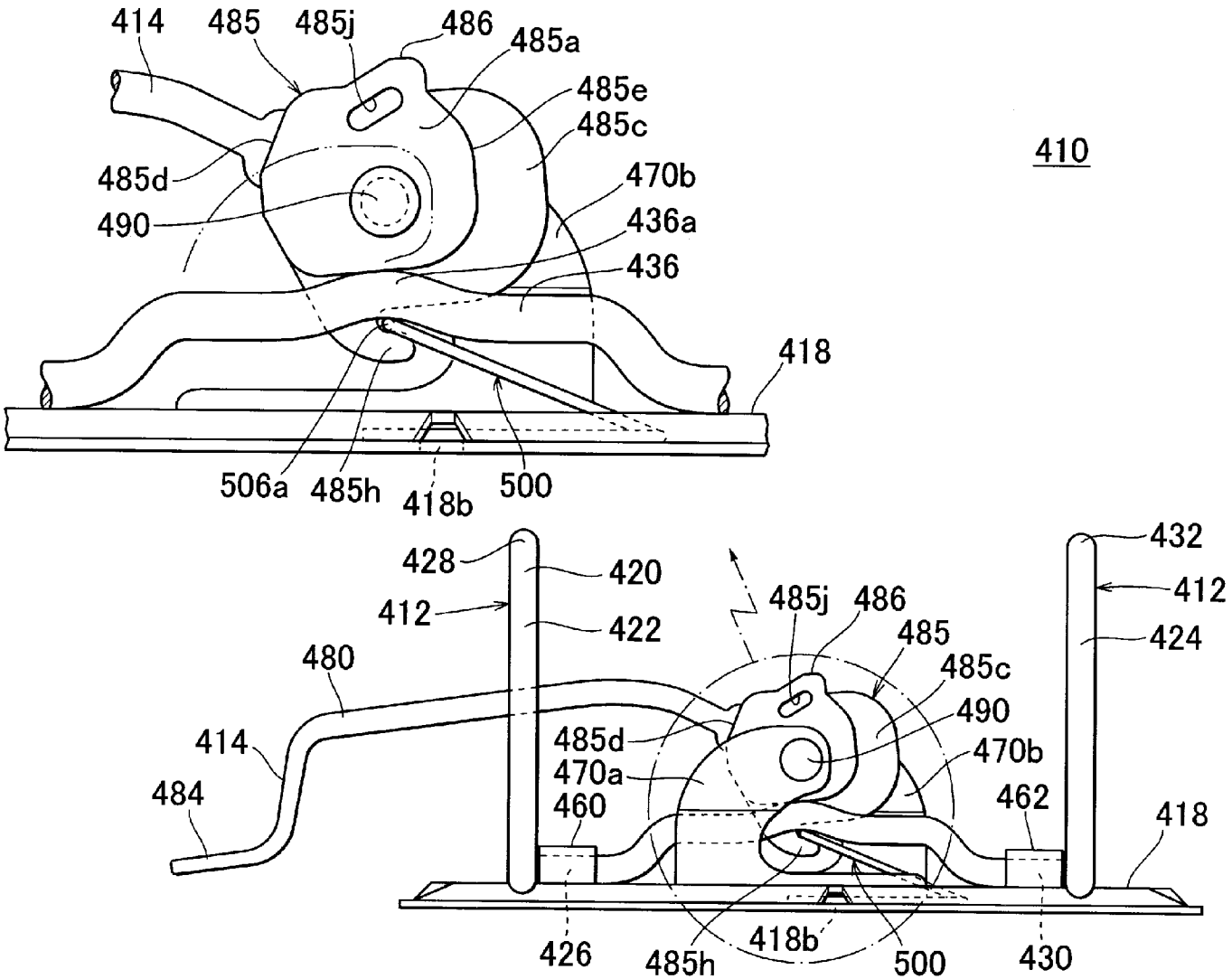
FIG. 23 is a set of left side views illustrating the operating state of the binding device (in a state in which the binding rings are opened) shown in FIG. 17.

When the upper binding ring portion 422 and the lower binding ring portion 424 of the first ring member 420 and the upper binding ring portion 442 and the lower binding ring portion 444 of the second ring member 440 are opened, an operation area for the lever 414 is opened. Then, the lever 414 can pass between the binding rings 412 in the first ring member 420 and the second ring member 440 and can be rotationally moved until reaching the far side of the base plate 418. Thus, as shown in FIG. 23, the lever 414 can be secured in a horizontal state in which the lever 414 comes close to the upper surface of the base plate 418.

Moreover, the rolling portions 485*e* and 485*f* of the pivot member 485 exert an effect of pressing down the curved portion 436 of the first ring member 420 and the curved portion 456 of the second ring member 440, respectively. The engaging portion 485*h* of the pivot member 485 is secured to the end portion 506*a* at the free end of the pushing-up portion 506, so that a downward force which is exerted by the curved portion 436 of the first ring member 420 and the curved portion 456 of the second ring member 440 when the first ring member 420 and the second ring member 440 are moved in the closing direction is held by the engaging portion 485*h* of the pivot member 485 through the end portion 506*a* at the free end of the pushing-up portion 506. Therefore, the engaging portion 485*h* acts so as to maintain the opened state of the lever 414 (the state in which the binding rings 412 are opened).

Therefore, the upper binding ring portion 442 of the second ring member 440 and the lower binding ring portion 444 of the second ring member 440 can be inserted into binding holes of an object to be bound such as a paper sheet without being disturbed by the lever 414, whereby the object to be bound can be inserted.

Moreover, even when an inward force is applied to the first ring member 420 and the second ring member 440 from the left side and the right side, respectively, the first ring member 420 and the second ring member 440 are prevented from being easily closed.

After the object to be bound is inserted, when the lever 414 is rotationally moved toward the lower side (the near side), the first securing portion 486 again pushes down the curved portion 436 of the first ring member 420 and the curved portion 456 of the second ring member 440. Then, when the lever 414 is pushed down against the urging force of the urging member 500, the lever 414 is secured in a position beyond the change point, and the binding rings 412 in the first ring member 420 and the second ring member 440 are secured in place. Furthermore, in order to prevent the first securing portion 486 from pushing the curved portion 436 of the first ring member 420 and the curved portion 456 of the second ring member 440 by an excessively large force, the absorbing hole portion 485*j* exerts an effect of absorbing the pressing force of the first securing portion 486.

When the force for pressing the curved portion 436 of the first ring member 420 and the curved portion 456 of the second ring member 440 by the first securing portion 486 is weakened by providing the absorbing hole portion 485*j*, the absorbing hole portion 485*j* may not be provided.

This binding device 410 is attached to a spine $C_1$ of a cover C of a file by inserting rivets or other suitable fasteners through respective four attaching holes provided in the base plate 418.

The distance $D_5$ between the perpendicular plane $W_5$ passing through the left edge of the base plate 418 secured to the spine $C_1$ of the cover C of the file and a perpendicular plane $W_7$ passing through a folding line on the left edge of the spine $C_1$ of the cover C of the file is equal to the distance $D_6$ between a perpendicular plane $W_6$ passing through the right edge of the base plate 418 and a perpendicular plane $W_8$ passing through a folding line on the right edge of the spine $C_1$ of the cover C of the file.

Moreover, this invention can be modified as shown in FIGS. 30 to 43.

Figure 30:
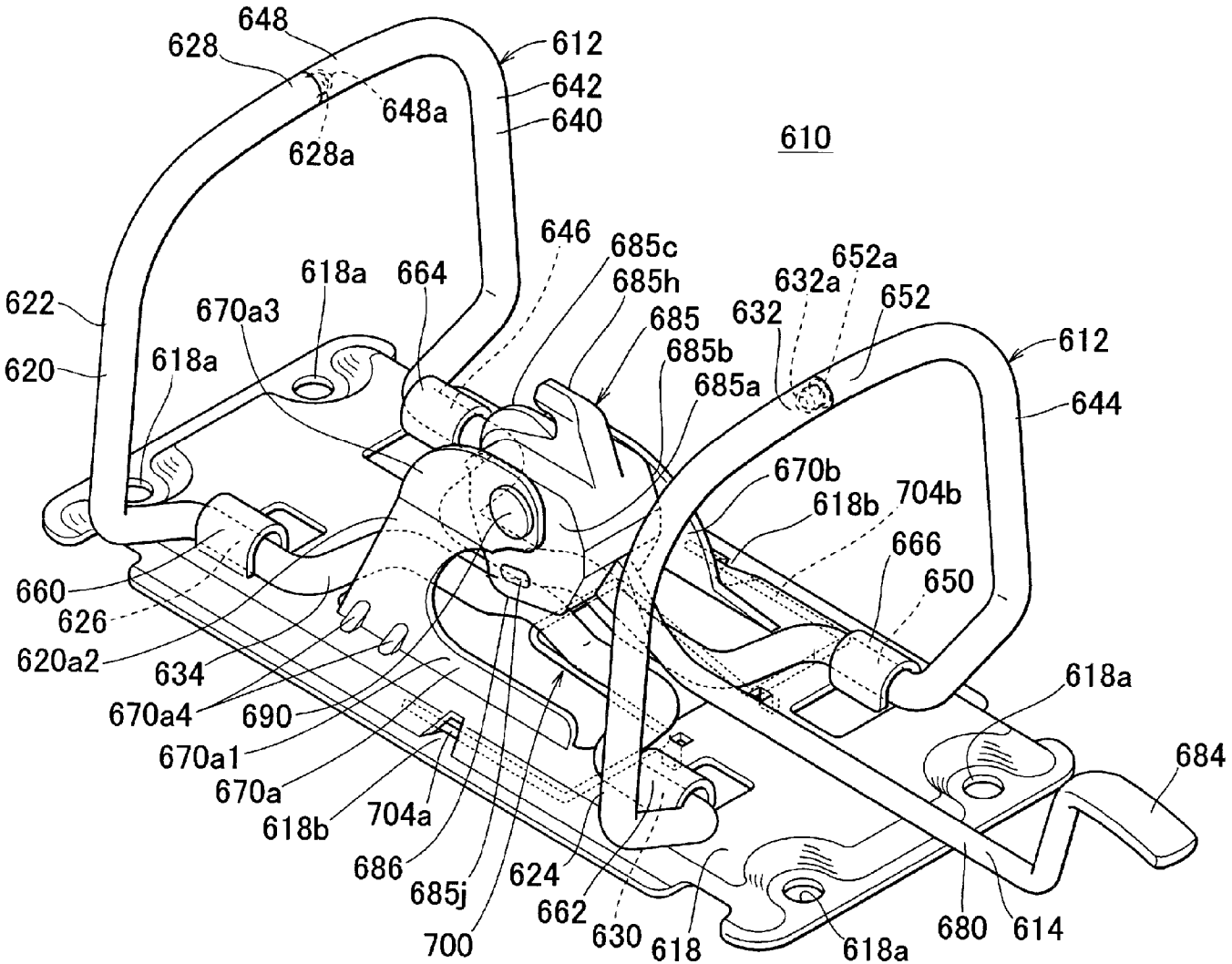
FIG. 30 is a perspective view of a binding device of another preferred embodiment of the present embodiment.

FIG. 30 is a perspective view of a binding device of another preferred embodiment.

Figure 31:
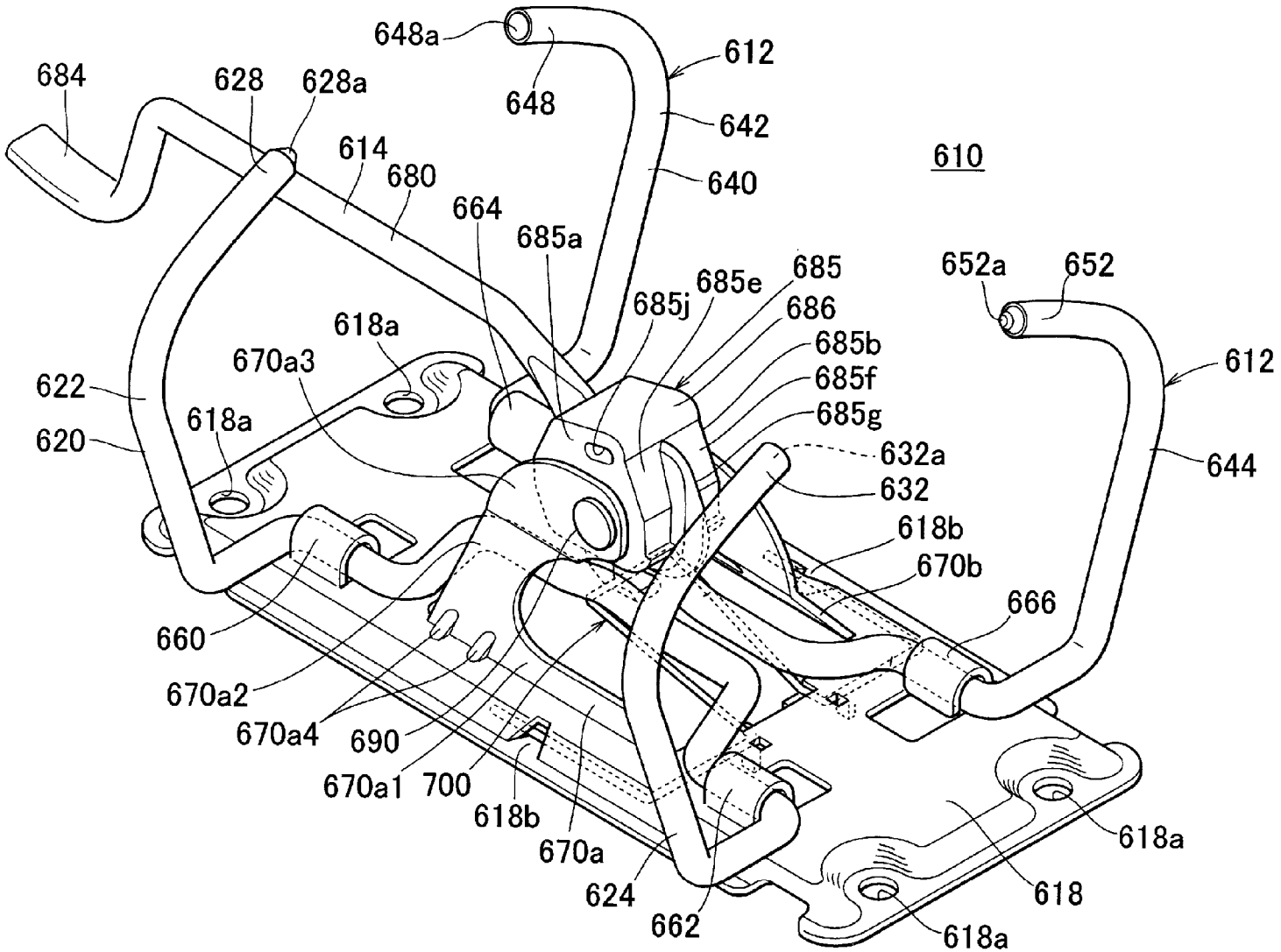
FIG. 31 is a perspective view illustrating an opened state of the binding rings of the binding device shown in FIG. 30.

FIG. 31 is a perspective view illustrating an opened state of the binding ring of the binding device shown in FIG. 30.

Figure 32:
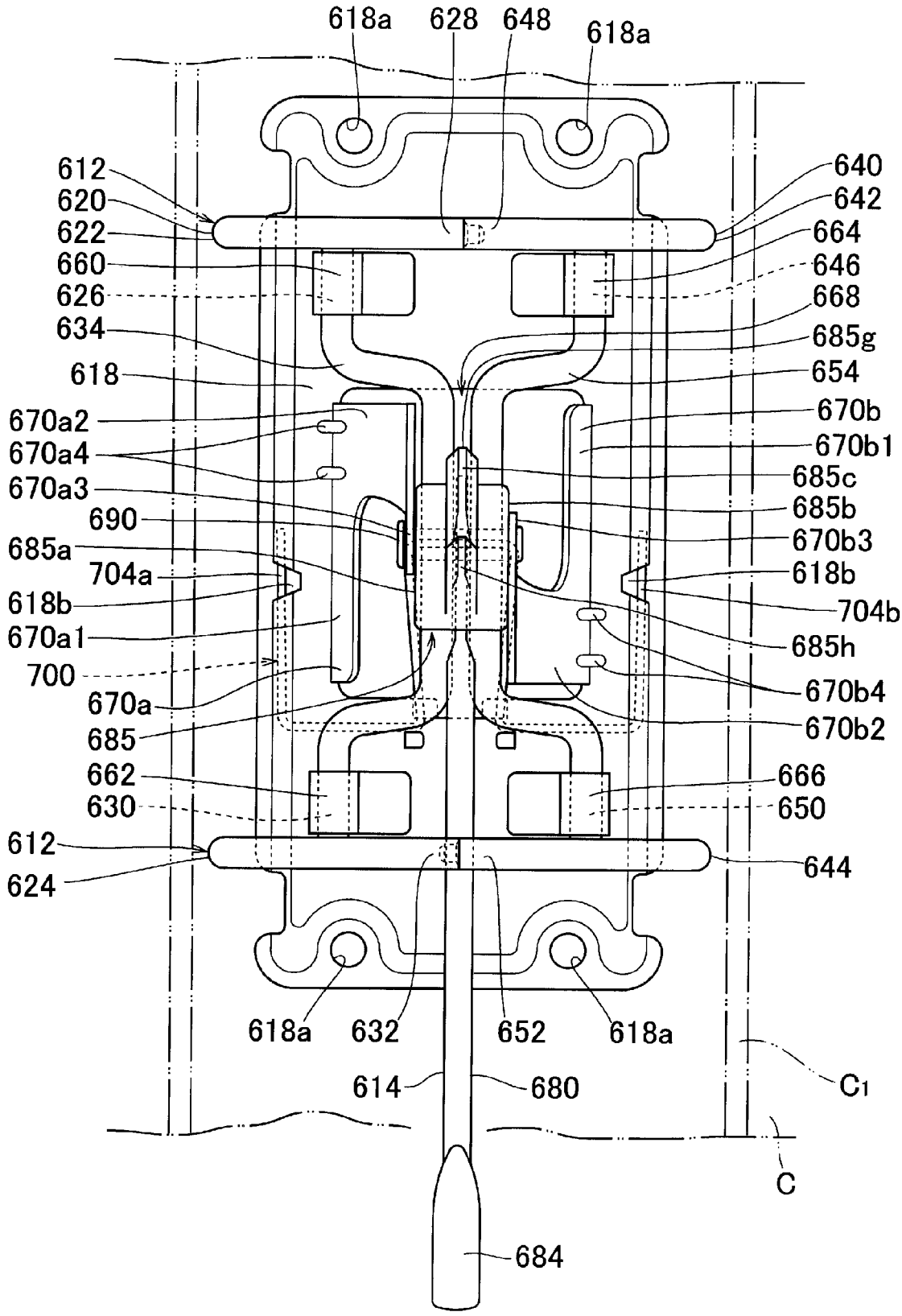
FIG. 32 is a plan view of the binding device shown in FIG. 30.

FIG. 32 is a plan view of the binding device shown in FIG. 30.

Figure 33:
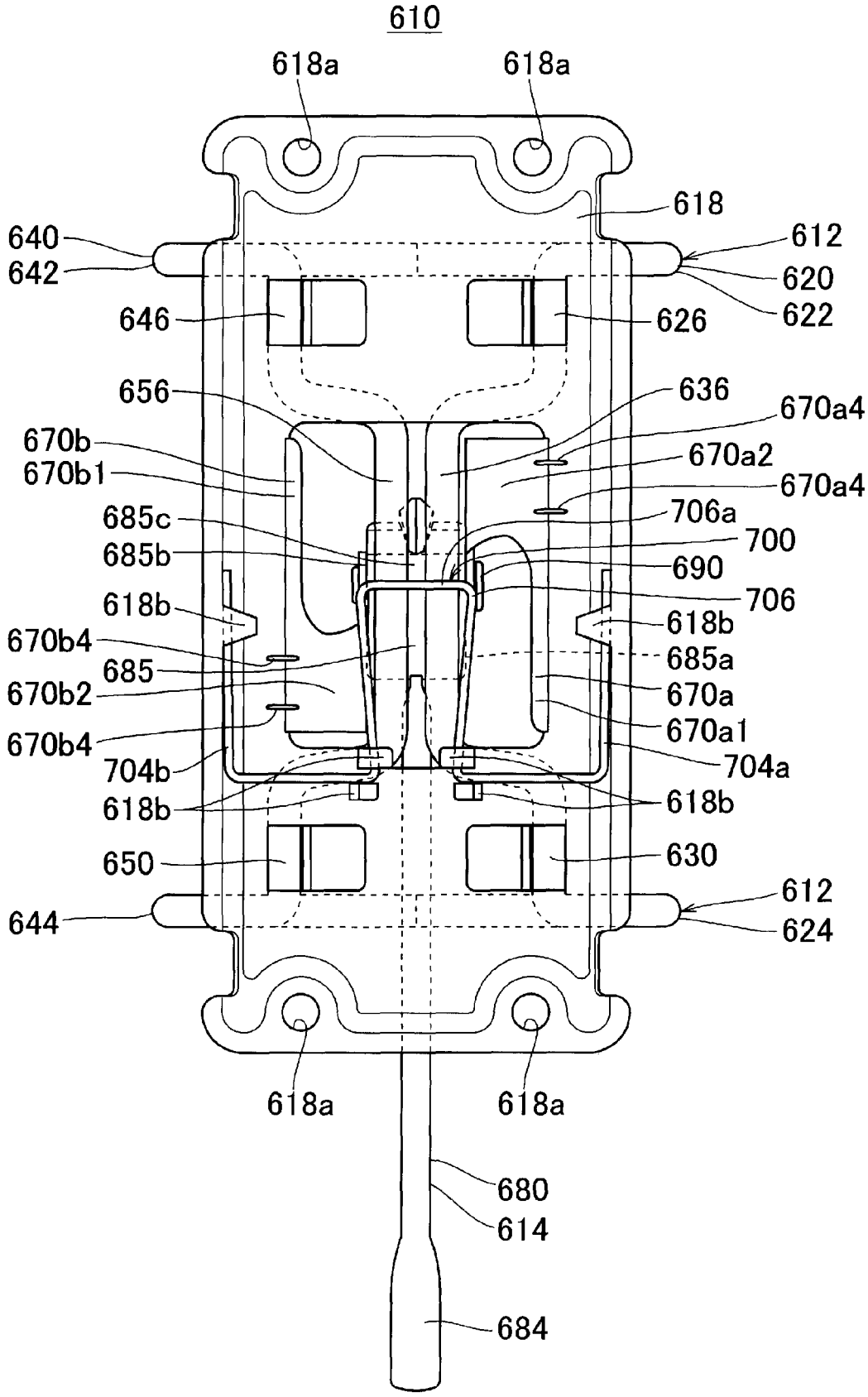
FIG. 33 is a rear view of the binding device shown in FIG. 30.

FIG. 33 is a rear view of the binding device shown in FIG. 30.

Figure 34:
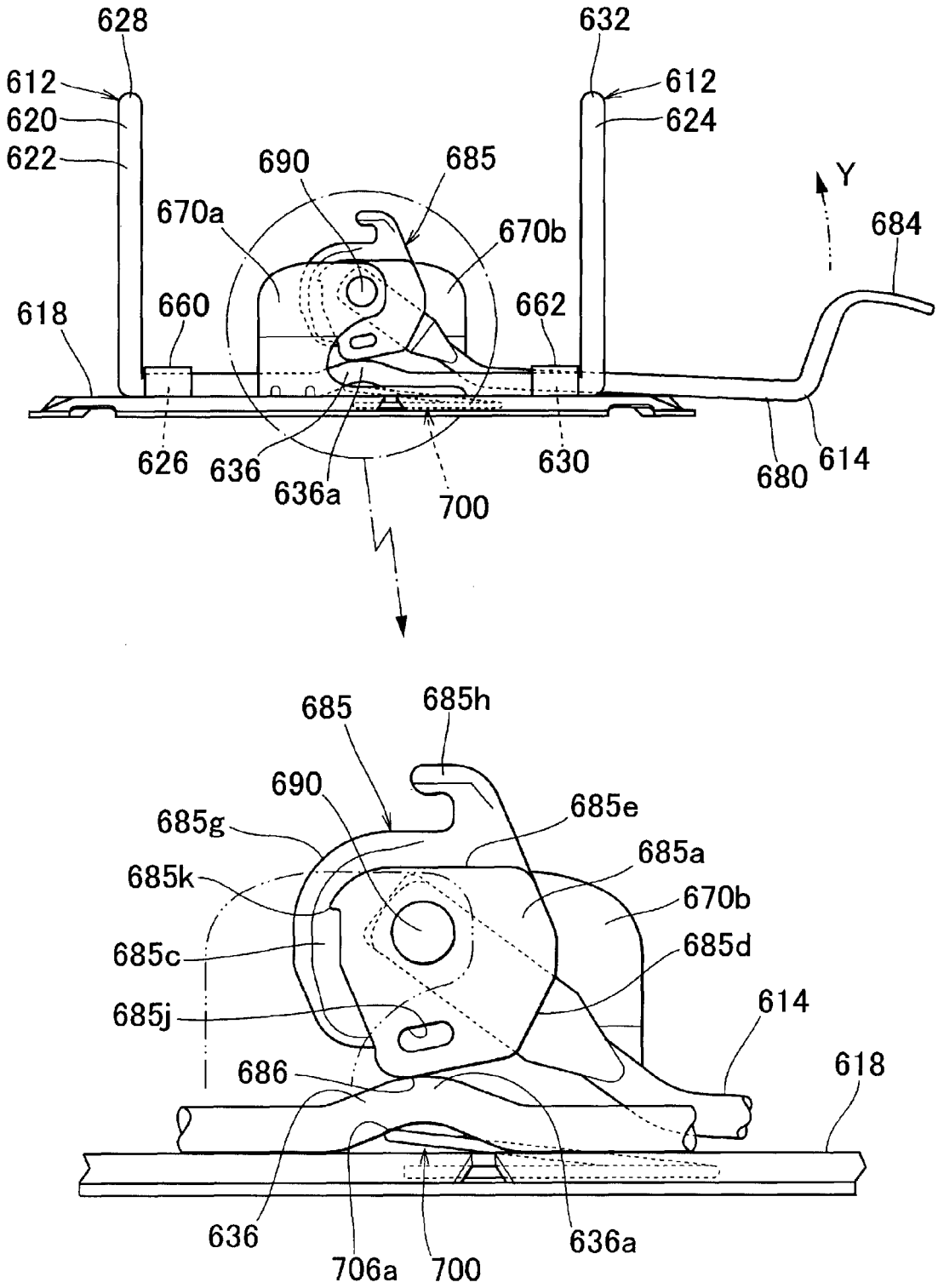
FIG. 34 is a set of left side views illustrating the operating state of the binding device (in a state in which binding rings are closed) shown in FIG. 30.
Figure 35:
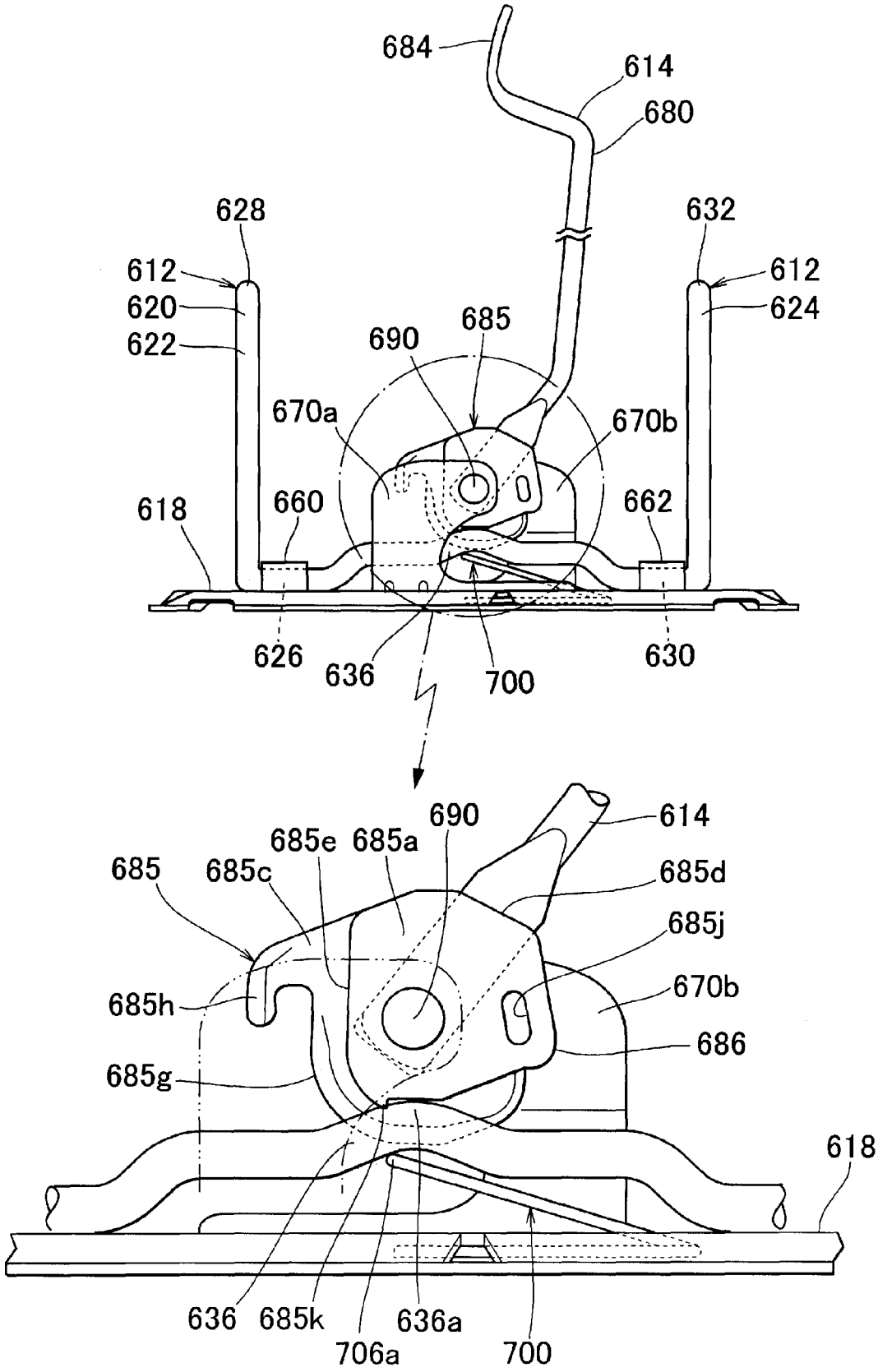
FIG. 35 is a set of left side views illustrating the operating state of the binding device (in a state in which the binding rings are half-opened) shown in FIG. 30.
Figure 36:
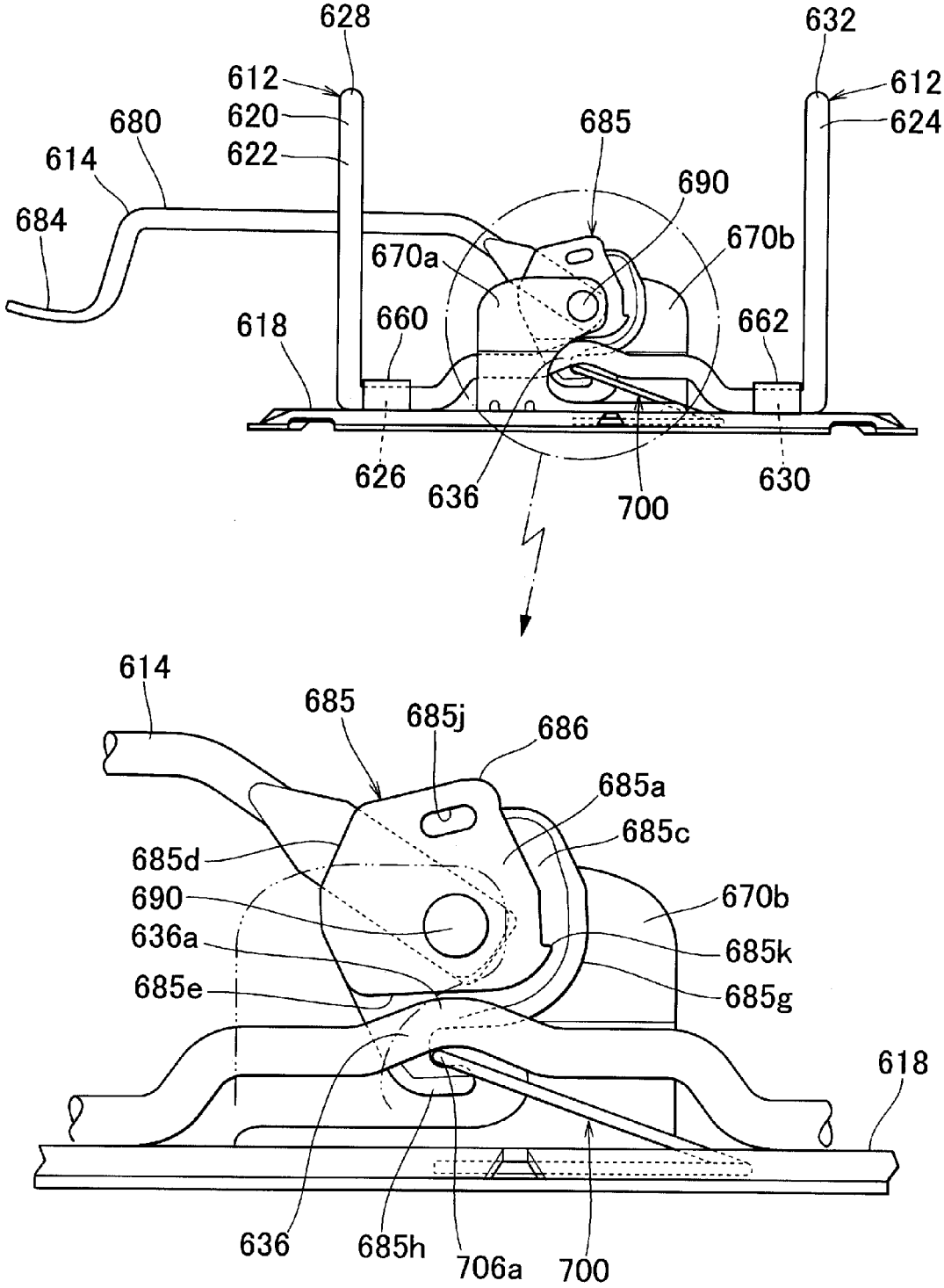
FIG. 36 is a set of left side views illustrating the operating state of the binding device (a state in which the binding rings are opened) shown in FIG. 30.

FIGS. 34 to 36 are left side views illustrating the operating state of the binding device shown in FIG. 30.

Figure 37:
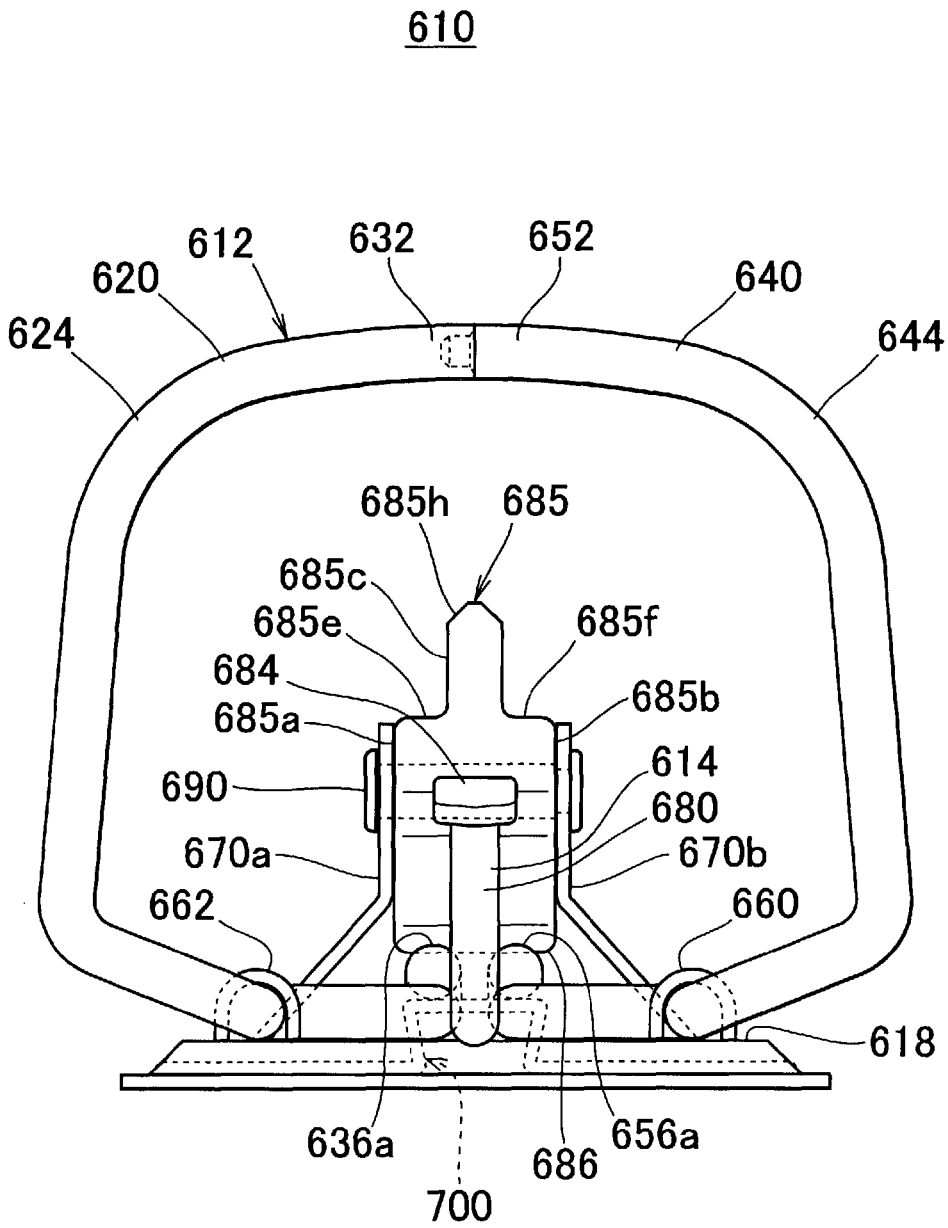
FIG. 37 is a front view illustrating the operating state of the binding device (in a state in which the binding rings are closed) shown in FIG. 30.
Figure 38:
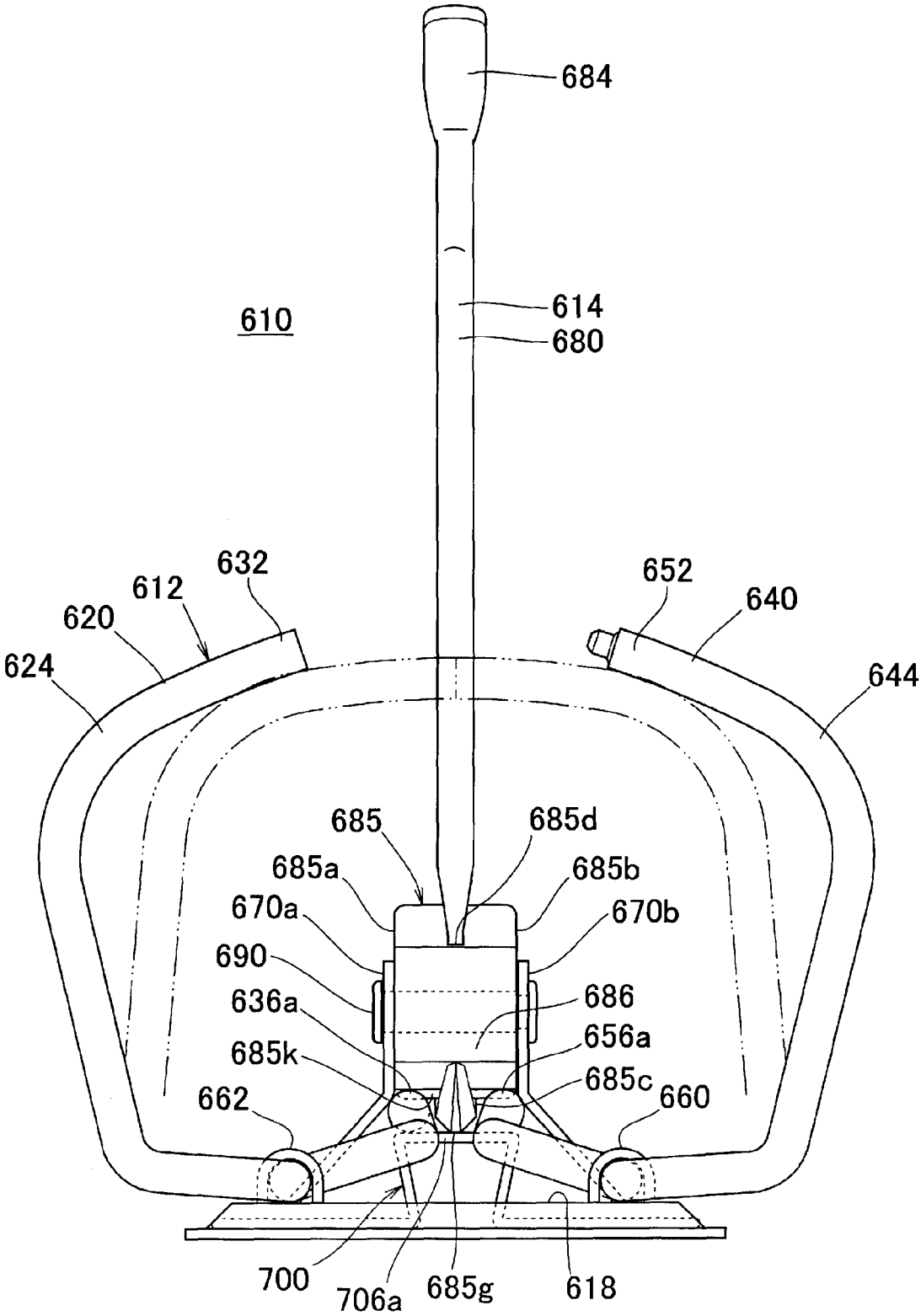
FIG. 38 is a front view illustrating the operating state of the binding device (in a state in which the binding rings are half-opened) shown in FIG. 30.
Figure 39:
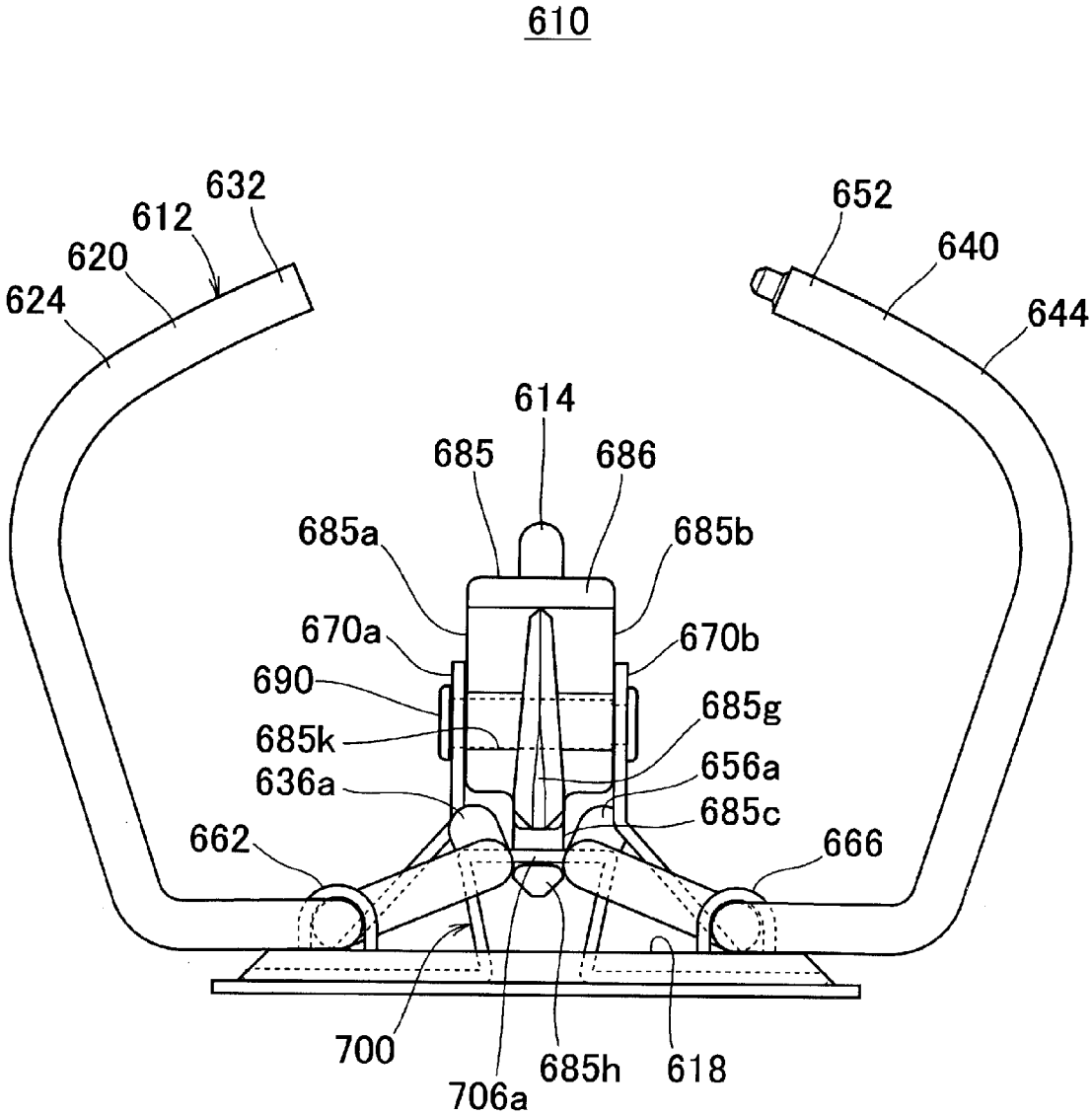
FIG. 39 is a front view illustrating the operating state of the binding device (in a state in which the binding rings are opened) shown in FIG. 30.

FIGS. 37 to 39 are front views illustrating the operating state of the binding device shown in FIG. 30.

Figure 40:
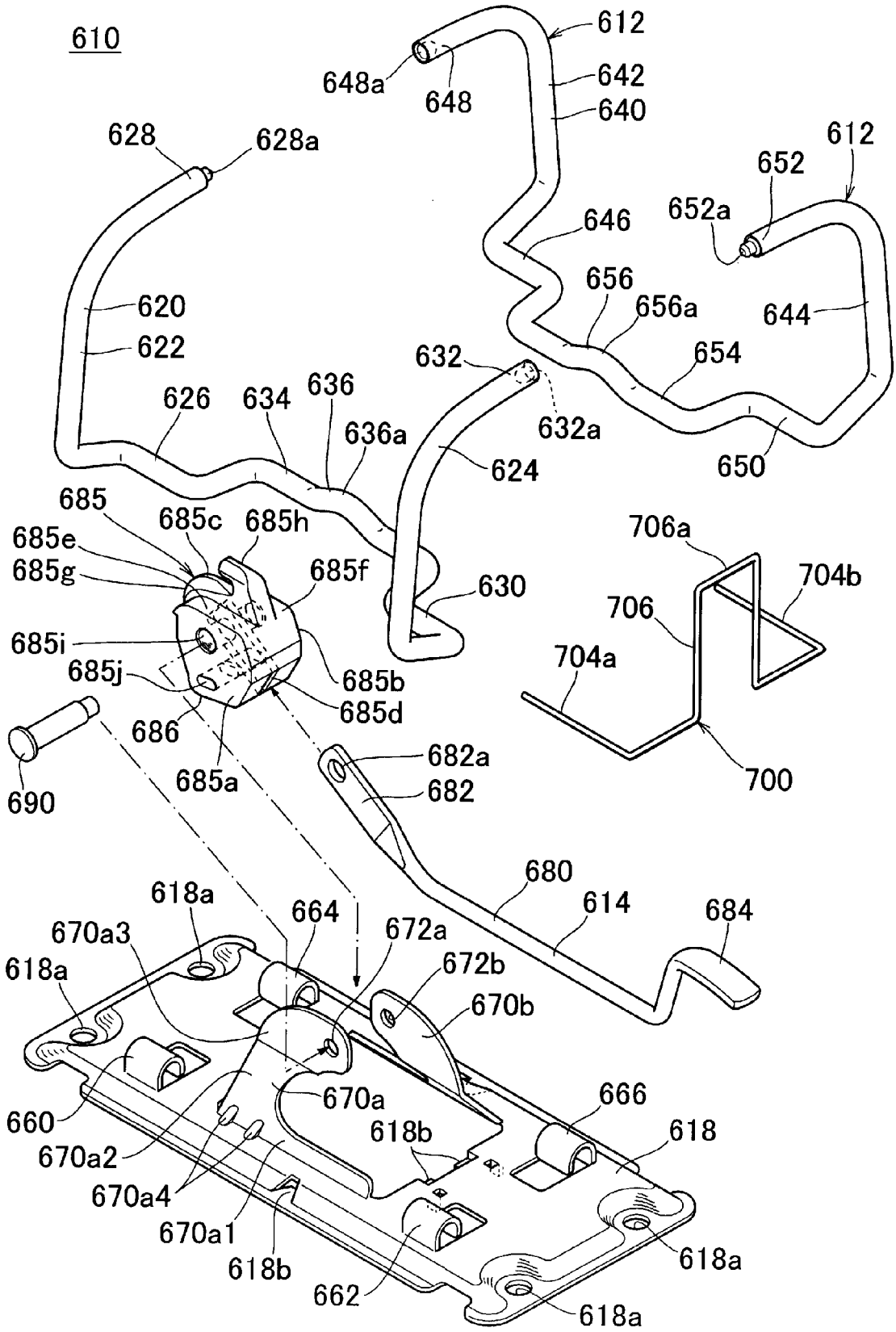
FIG. 40 is an exploded perspective view of the binding device shown in FIG. 30.

FIG. 40 is an exploded perspective view of the binding device shown in FIG. 30.

Figure 41:
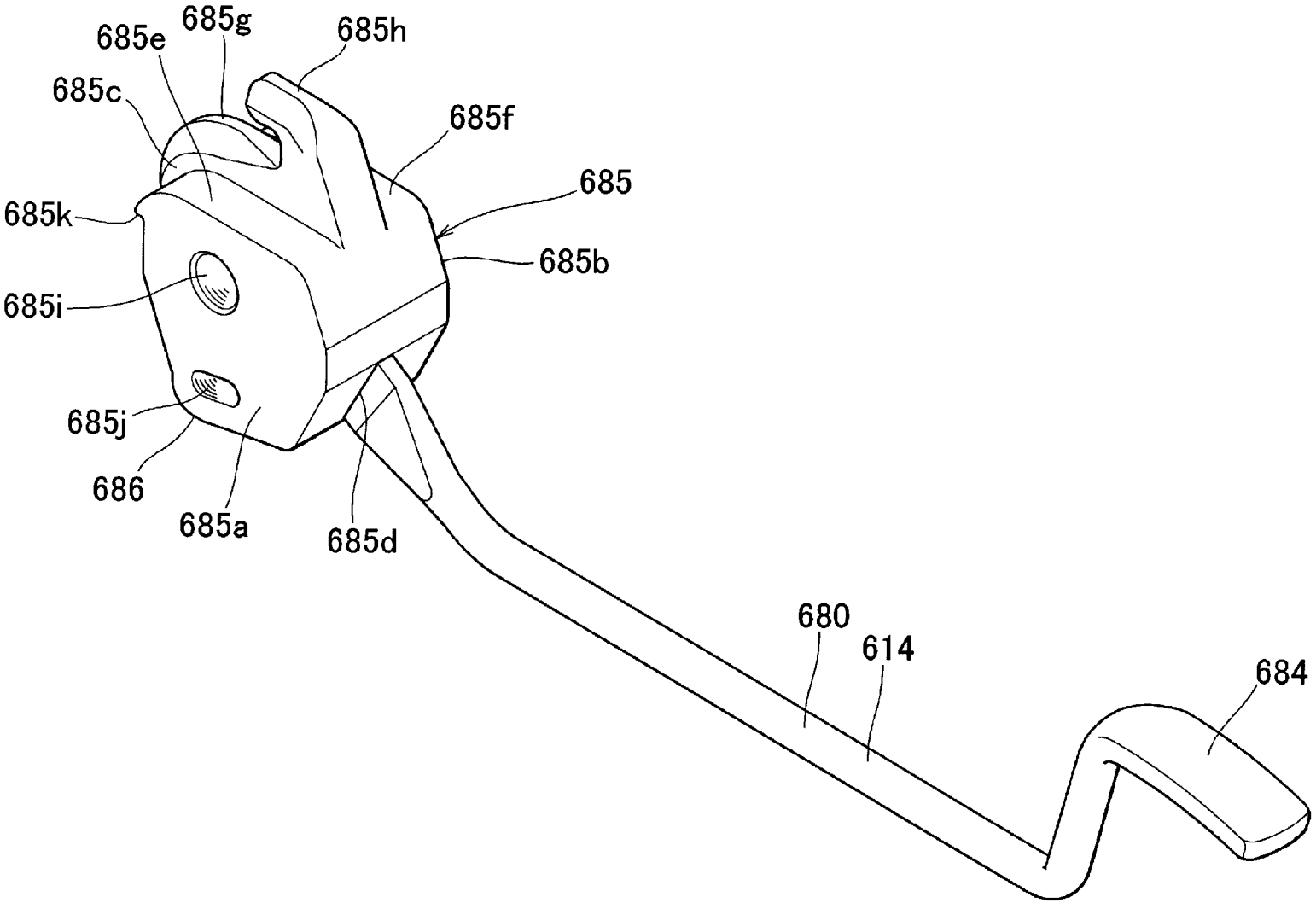
FIG. 41 is a perspective view illustrating a pivot member of the binding device shown in FIG. 30.
Figure 42:
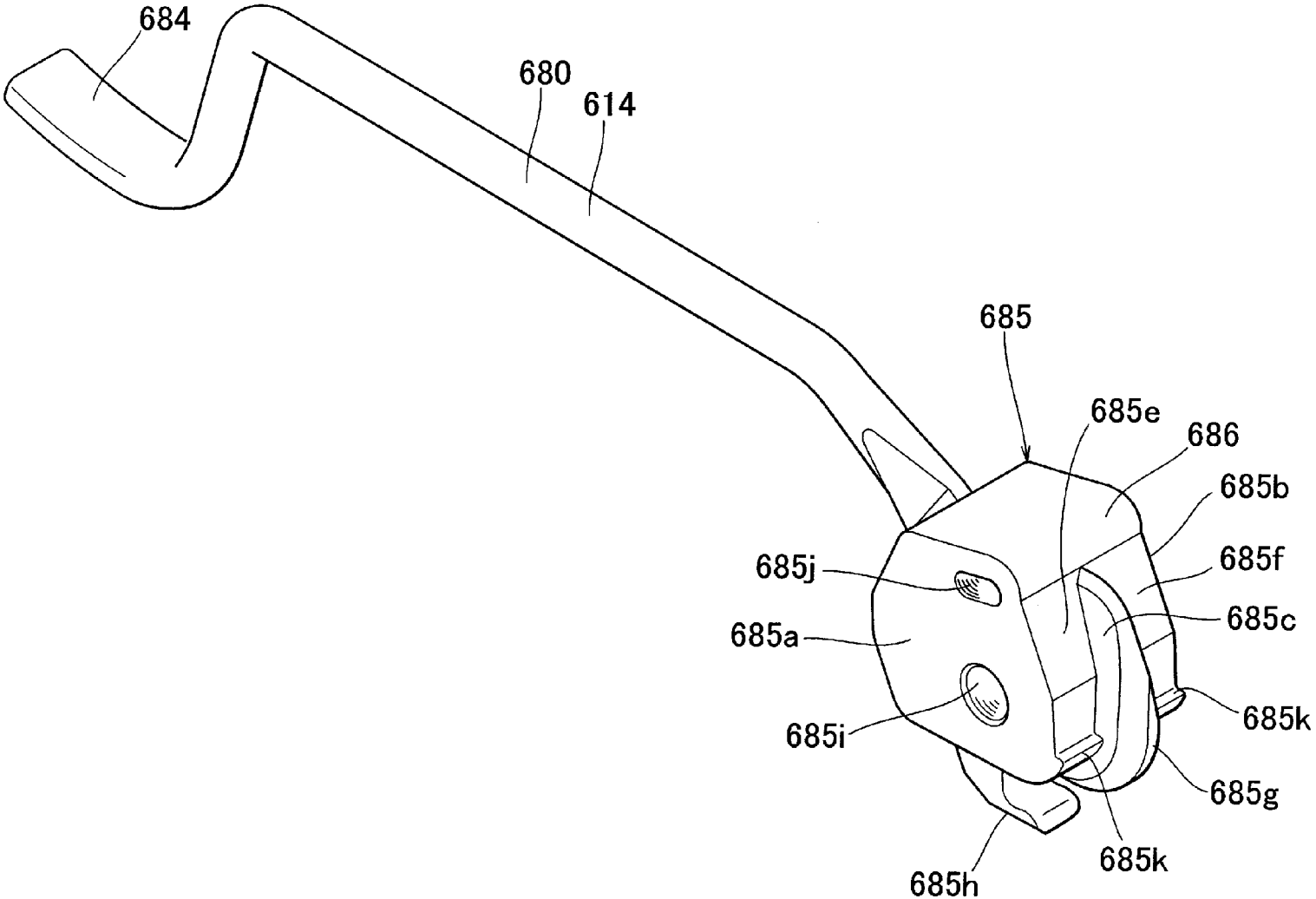
FIG. 42 is a perspective view illustrating the pivot member of the binding device shown in FIG. 30.

FIGS. 41 and 42 are perspective views illustrating a pivot member of the binding device shown in FIG. 30.

Figure 43:
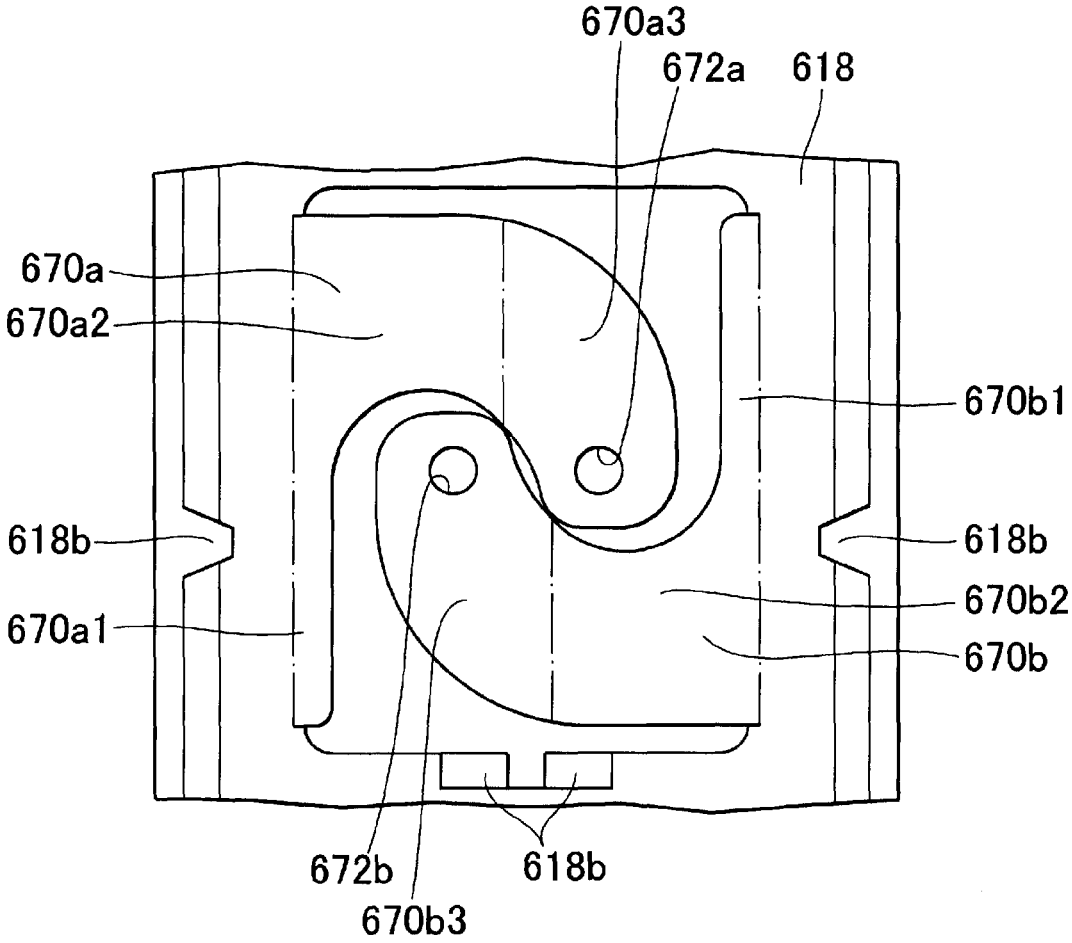
FIG. 43 is a front view of a base plate of the binding device shown in FIG. 30 before machining.
Figure 44:
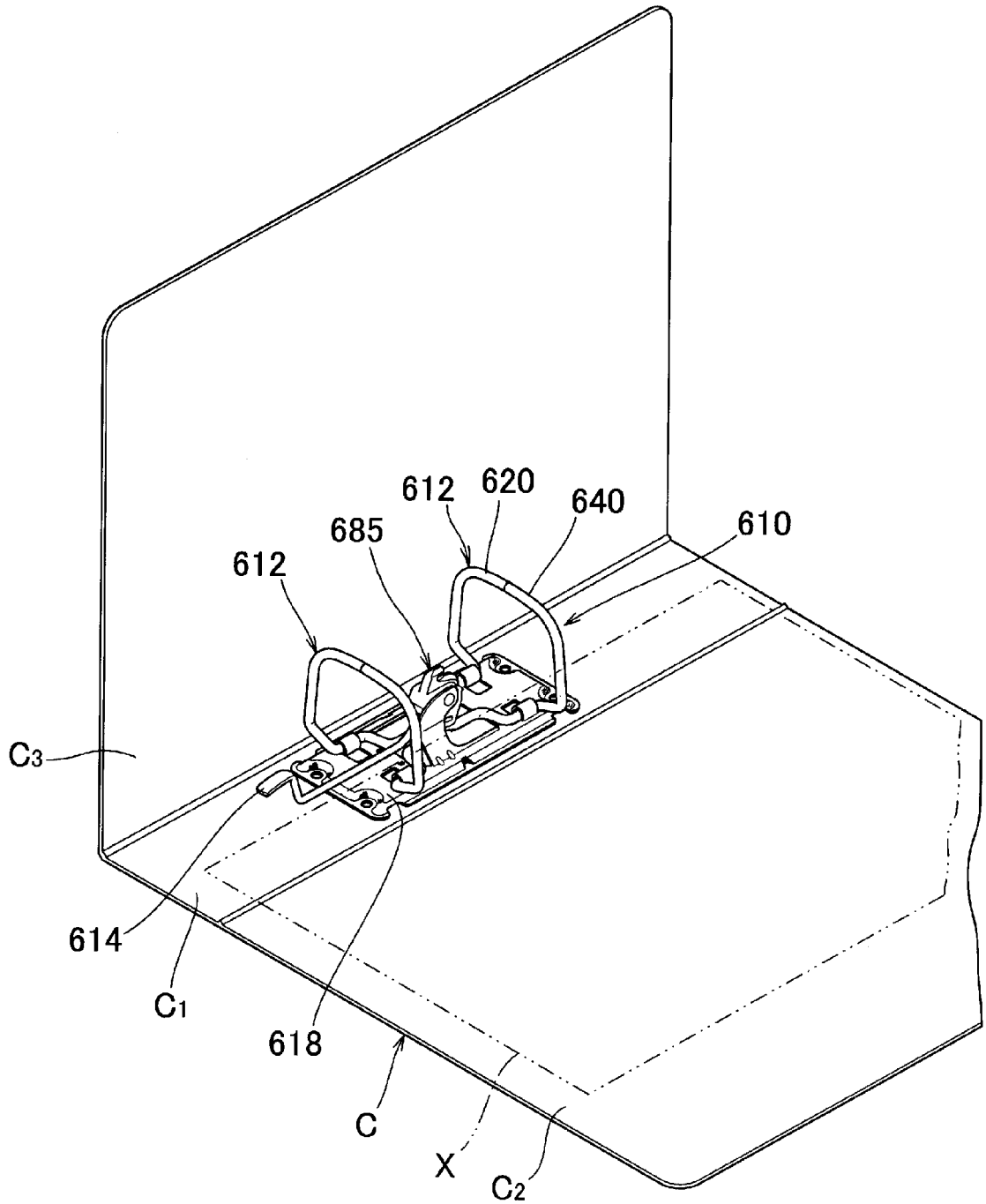
FIG. 44 is a perspective view illustrating the usage of the binding device shown in FIG. 30.
Figure 45:
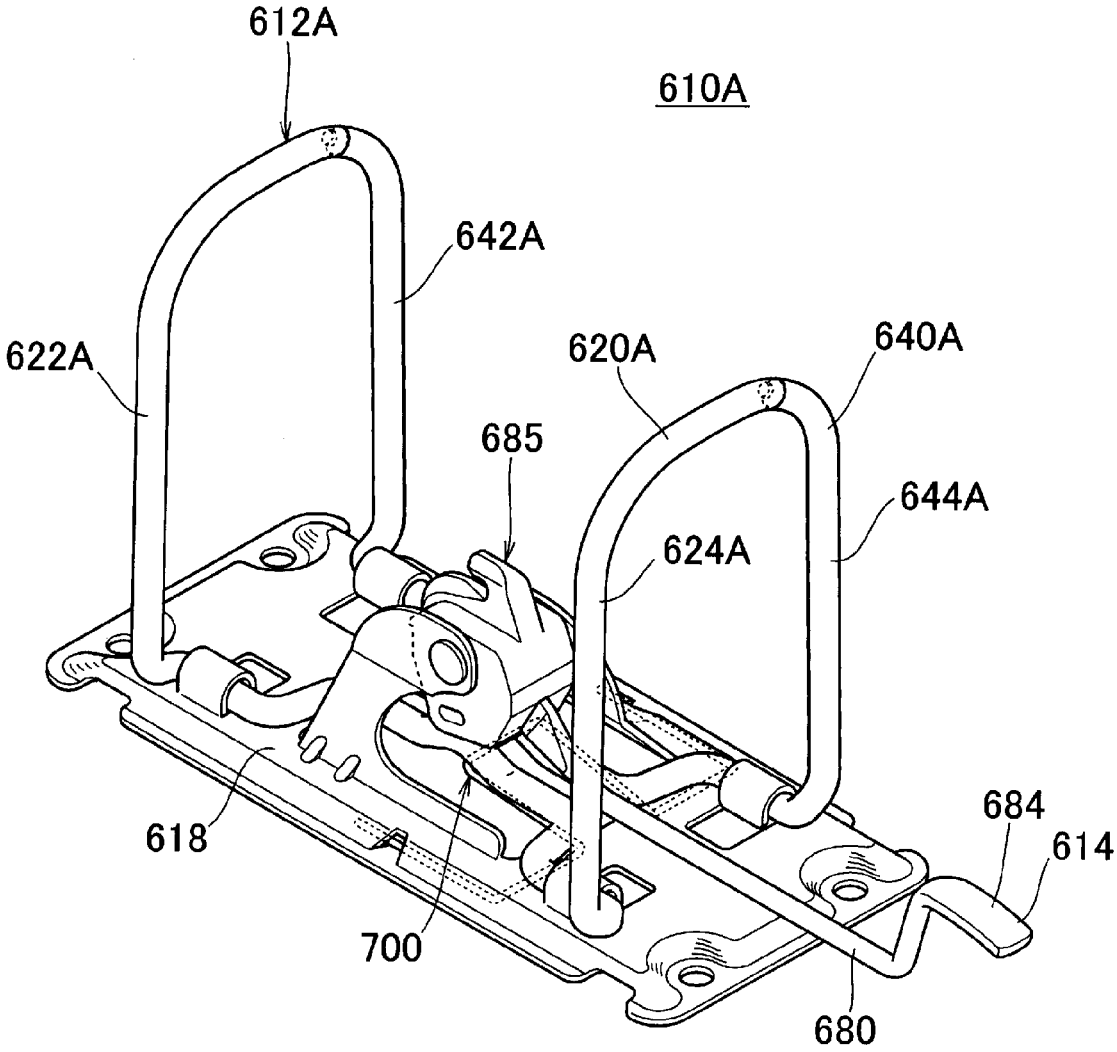
FIG. 45 is a perspective view of a binding device which is a modified example of the binding device shown in FIG. 30.
Figure 46:
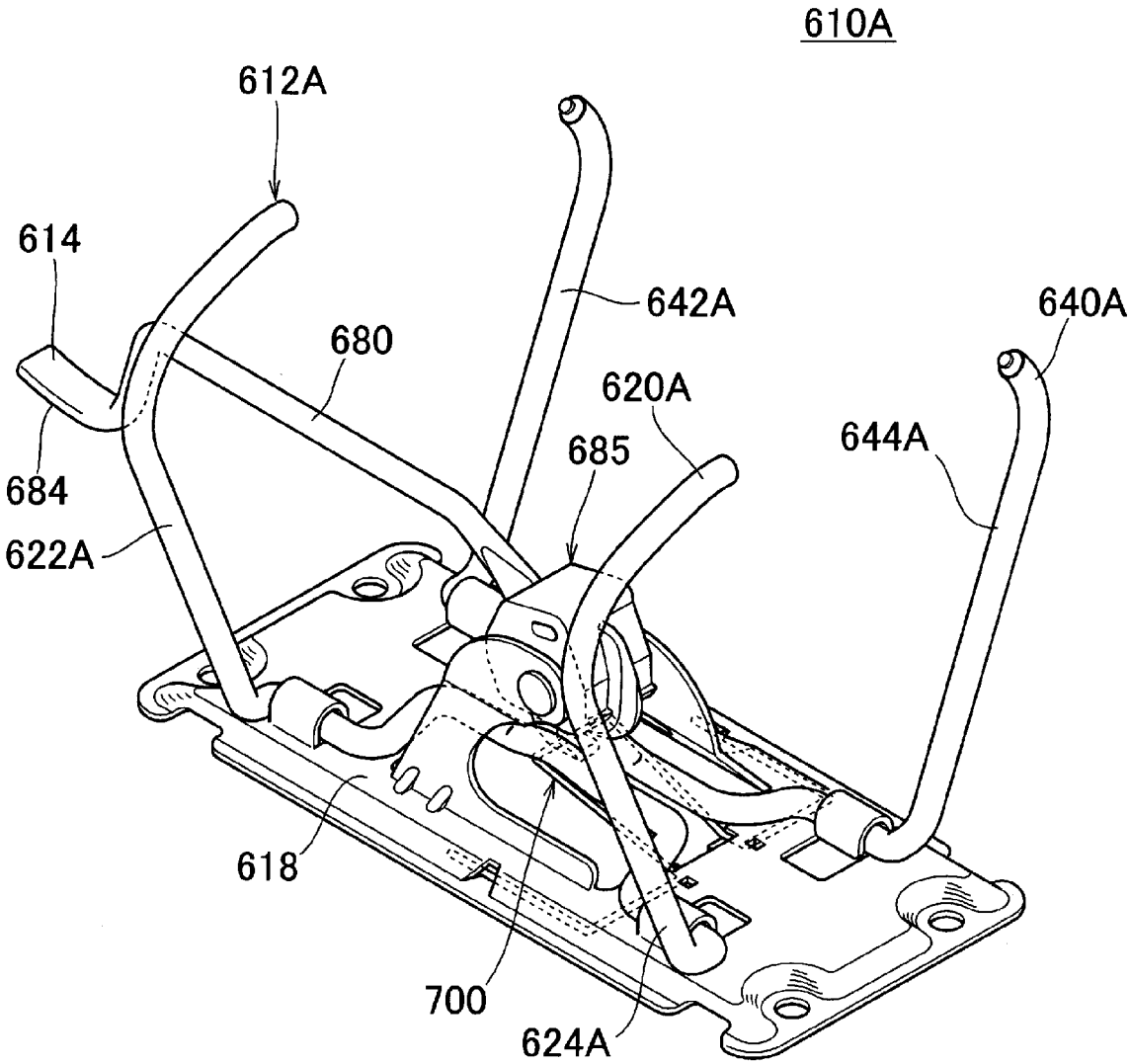
FIG. 46 is a perspective view illustrating the operating state of the binding device (in a state in which binding rings are opened) shown in FIG. 44.
Figure 47:
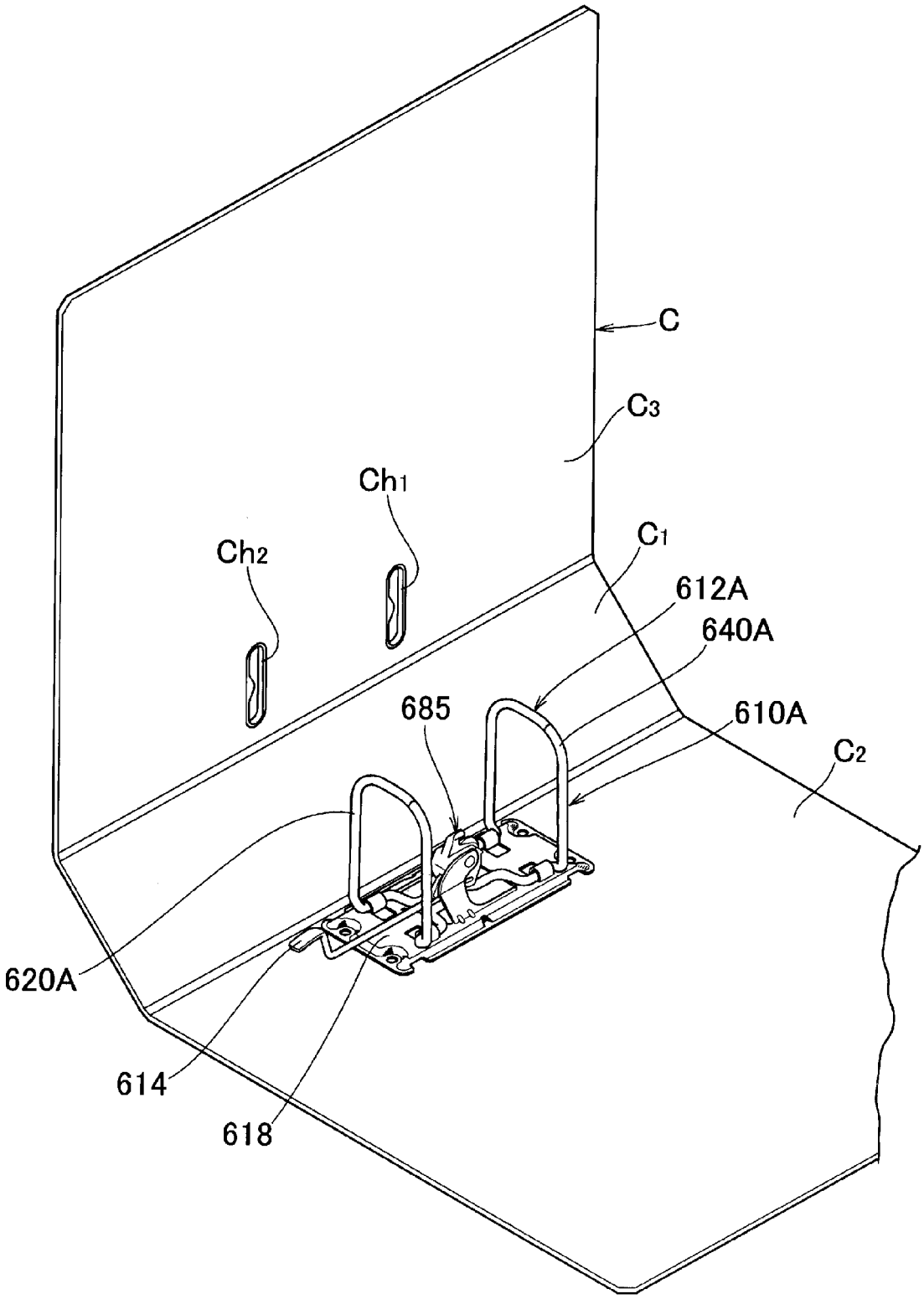
FIG. 47 is a perspective view illustrating the usage of the binding device shown in FIG. 45.

FIG. 43 is a front view of a base plate of the binding device shown in FIG. 30 before machining.

A binding device 610 is a binding device for files and binders, and in particular, is a binding device for use in A-Z files. In this binding device 610, binding rings 612 to be inserted into binding holes $X_1$ of an object X to be bound such as a paper sheet are openably and closeably secured to a base plate 618 so as to be rotationally opened and closed in its tangential direction about pivots near the base plate 618 by means of an opening-closing mechanism 616 including a rotationally movable lever 614.

The binding device 610 includes a pair of a first ring member 620 and a second ring member 640. The first ring member 620 and the second ring member 640 are each integrally formed by bending a cylindrical metal wire and are substantially symmetrical to one another.

The binding rings 612 in the first ring member 620 and the binding rings 612 in the second ring member 640 are rotationally moved along the tangential direction of the binding ring 612, so that they are moved in a direction from a closed position at which a closed loop is provided toward an opened position at which the loop is separated or in the opposite direction (an opening-closing direction).

The first ring member 620 has a semi-annular upper binding ring portion 622 defining the binding ring 612 and a semi-annular lower binding ring portion 624 defining the binding rings 612. A pivot portion 626 is provided at the lower end of the upper binding ring portion 622, and a junction 628 is provided at the upper end. A pivot portion 630 is provided at the lower end of the lower binding ring portion 624, and a junction 632 is provided at the upper end, as in the upper binding ring portion 622.

The junction 628 has a projection 628*a* provided at the end thereof, and the junction 632 has a recess 632*a* drilled in the end thereof.

The upper binding ring portion 622 and the lower binding ring portion 624 are connected so as to be opposed to each other through a connection portion 634 between the pivot portion 626 at the lower end of the upper binding ring portion 622 and the pivot portion 630 at the lower end of the lower binding ring portion 624.

Each of the pivot portions 626 and 630 is provided so as to protrude in a direction orthogonal to the opening-closing direction of the upper binding ring portion 622 and the lower binding ring portion 624. Specifically, the pivot portion 626 is provided so as to protrude toward the lower binding ring portion 624, and the pivot portion 630 is provided so as to protrude toward the upper binding ring portion 622.

The connection portion 634 is connected to the pivot portion 626 of the upper binding ring portion 622 and the pivot portion 630 of the lower binding ring portion 624. The connection portion 634 has a curved portion 636 which is configured so as to be curved and protrude toward the junction 628 of the upper binding ring portion 622 and the junction 632 of the lower binding ring portion 624 as the curved portion 636 approaches the center of the connection portion 634.

The curved portion 636 has irregularities formed on the upper surface thereof so as to be provided with the change point of the lever 614 of the opening-closing mechanism 616.

The second ring member 640 has a semi-annular upper binding ring portion 642 defining the binding ring 612 and a semi-annular lower binding ring portion 644 defining the binding ring 612. A pivot portion 646 is provided at the lower end of the upper binding ring portion 642, and a junction 648 is provided at the upper end. A pivot portion 650 is provided at the lower end of the lower binding ring portion 644, and a junction 652 is provided at the upper end of the lower binding ring portion 642, as in the upper binding ring portion 642.

The junction 648 has a recess 648*a* provided at the end thereof, and the junction 652 has a projection 652*a* projecting from the end thereof.

The upper binding ring portion 642 and the lower binding ring portion 644 are connected so as to be opposed to each other through a connection portion 654 between the pivot portion 646 at the lower end of the upper binding ring portion 642 and the pivot portion 650 at the lower end of the lower binding ring portion 644.

Each of the pivot portions 646 and 650 is provided so as to protrude in a direction orthogonal to the opening-closing direction of the upper binding ring portion 642 and the lower binding ring portion 644. Specifically, the pivot portion 646 is provided so as to protrude toward the lower binding ring portion 644, and the pivot portion 650 is provided so as to protrude toward the upper binding ring portion 642.

The connection portion 654 is connected to the pivot portion 646 of the upper binding ring portion 642 and the pivot portion 650 of the lower binding ring portion 644. The connection portion 654 has a curved portion 656 which is configured so as to be curved and protrude toward the junction 648 of the upper binding ring portion 642 and the junction 652 of the lower binding ring portion 644 as the curved portion 656 approaches the center of the connection portion 654.

The curved portion 656 has irregularities provided on the upper surface thereof so as to be provided with the change point of the lever 614 of the opening-closing mechanism 616.

The upper binding ring portion 622 and the lower binding ring portion 624 of the first ring member 620 have the pivot portions 626 and 630, respectively, provided near the left edge of the base plate 618. Furthermore, the upper binding ring portion 622 and the lower binding ring portion 624 have the junctions 628 and 632, respectively, which are provided at the respective ends opposite to the pivot portions 626 and 630, respectively, and which are provided near the center in the width direction of the base plate 618. Moreover, the upper binding ring portion 642 and the lower binding ring portion 644 of the second ring member 640 have the pivot portions 646 and 650, respectively, provided near the right edge of the base plate 618. The upper binding ring portion 642 and the lower binding ring portion 644 have the junctions 648 and 652, respectively, which are provided at the respective ends opposite to the pivot portions 646 and 650, respectively, and which are provided near the center in the width direction of the base plate 618.

$D_1$ is the length between a perpendicular plane $W_1$ which passes through the pivot portions 626 and 630 and a perpendicular plane $W_0$ which passes through the connected junctions 648 and 652. $D_2$ is the length between a perpendicular plane $W_2$ which passes through the junctions 628 and 632 and the perpendicular plane $W_0$ which passes through the connected junctions 648 and 652. The length $D_1$ is equal to the length $D_2$.

$D_3$ is the length between a perpendicular plane $W_3$ which passes through the leftmost edge of the upper binding ring portion 622 and the lower binding ring portion 624 and the perpendicular plane $W_1$ which passes through the pivot portions 626 and 630. $D_4$ is the length between a perpendicular plane $W_4$ which passes through the rightmost edge of the upper binding ring portion 642 and the lower binding ring portion 644 and the perpendicular plane $W_2$ which passes through the pivot portions 646 and 650. The length $D_3$ is equal to the length $D_4$.

The length between the perpendicular plane $W_3$ which passes through the leftmost edge of the upper binding ring portion 622 and the lower binding ring portion 624 and a perpendicular plane $W_5$ which passes through the leftmost edge of the base plate 618 is equal to the length between the perpendicular plane $W_4$ which passes through the rightmost edge of the upper binding ring portion 642 and the lower binding ring portion 644 and a perpendicular plane $W_6$ which passes through the rightmost edge of the base plate 618.

The binding rings 612 in the first ring member 620 and the second ring member 640 are each configured into a horizontally elongated ellipsoidal ring shape. Specifically, in the central portion between the pivot portions 626 and 630 of the first ring member 620 and the pivot portions 646 and 650 of the second ring member 640, i.e., near the widthwise center of the base plate 618, the junction 628 of the first ring member 620 is joined to the junction 648 of the second ring member 640, and the projection 628*a* is engaged with the recess 648*a*, whereby a horizontally elongated ellipsoidal ring shape is provided which defines a closed loop. In addition to this, the junction 632 of the first ring member 620 is joined to the junction 652 of the second ring member 640, and the recess 632*a* is engaged with the projection 652*a*, whereby a horizontally elongated ellipsoidal ring shape is provided which defines the closed loop.

Specifically, in the binding rings 612, the upper binding ring portion 622 and the upper binding ring portion 642 define a downwardly opened C-shaped ring, and the lower binding ring portion 624 and the lower binding ring portion 644 define a downwardly opened C-shaped ring, whereby a vertical pair of binding rings are provided.

The curved portion 636 of the connection portion 634 of the first ring member 620 and the curved portion 656 of the connection portion 654 of the second ring member 640 come close to each other near the central portion of the base plate 618 and are arranged in substantially parallel to each other. In addition, the curved portion 636 and the curved portion 656 are bent such that a gap portion 668 is provided therebetween. The curved portion 636 and the curved portion 656 extend substantially parallel to each other in the lengthwise direction of the base plate 618, and an appropriate gap for disposing the opening-closing mechanism 616 is provided between the connection portion 634 of the first ring member 620 and the connection portion 654 of the second ring member 640.

Pivot receivers 660 and 662 for pivotally supporting the pivot portions 626 and 630, respectively, of the first ring member 620 and pivot receivers 664 and 666 for pivotally supporting the pivot portions 646 and 650, respectively, of the second ring member 640 are provided in respective four corners of the base plate 618.

Specifically, the pivot portion 626, the junction 628, the pivot portion 630, and the junction 632 are provided in the base plate 618 such that the junction 648 and the junction 652 are joined on the perpendicular plane $W_0$ which passes through the center between the perpendicular plane $W_5$ passing through the left edge of the base plate 618 and the perpendicular plane $W_6$ passing through the right edge of the base plate 618.

In the base plate 618 of this preferred embodiment, each of the pivot receivers 660, 662, 664, and 666 is formed by punching the base plate 618 to form a substantially rectangular U-shaped tongue, bending the punched tongue upwardly from the lower side of the base plate 618, and curling the bent tongue.

The opening-closing mechanism 616 for the binding rings 612 is provided in the center of the base plate 618.

In this preferred embodiment, the opening-closing mechanism 616 is provided with a lever shaft receiver 670 including a left-right pair of opposed shaft receivers formed by punching the base plate 618 in the substantial center thereof and bending the punched portions upward so as to be arranged in parallel to each other.

The lever shaft receiver 670 is defined by an erected arch shaped first shaft-receiving portion 670*a* and an erected arch shaped second shaft-receiving portion 670*b* which stand on the base plate 618 in parallel to each other. The first shaft-receiving portion 670*a* and the second shaft-receiving portion 670*b* are provided so as to be opposed to each other on parallel lines lying on the opposite side-edge sides of the lengthwise centerline (corresponding to $W_0$) of the single-plate-like base plate 618 with an appropriate distance from the lengthwise centerline. Furthermore, the first shaft-receiving portion 670*a* and the second shaft-receiving portion 670*b* are configured so as to be point symmetric with respect to the center of the centerline.

A more detailed description is given below. First and second ends of a base portion 670*a*1 of the first shaft-receiving portion 670*a* and first and second ends of a base portion 670*b*1 of the second shaft-receiving portion 670*b* are erected from the base plate 618 so as to be substantially equally spaced from the lengthwise centerline of the base plate 618 and to be separated by the same distance from the lengthwise center of the base plate 618. In the first shaft-receiving portion 670*a* and the second shaft-receiving portion 670*b*, both the base portions 670*a*1 and 670*b*1 extend in the lengthwise direction. The first shaft-receiving portion 670*a* and the second shaft-receiving portion 670*b* are provided with a neck portion 670*a*2 and a neck portion 670*b*2, respectively, which protrude upward from the first end sides of the base portions 670*a*1 and 670*b*1, respectively, and a head portion 670*a*3 and a head portion 670*b*3, respectively, which are provided above the neck portions 670*a*2 and 670*b*2, respectively, and protrude inwardly.

In the lever shaft receiver 670, a shaft hole 672*a* is drilled in the head portion 670*a*3, and a shaft hole 672*b* is drilled in the head portion 670*b*3. Furthermore, the lever 614 is rotatably secured to the shaft holes 672*a* and 672*b* as described later.

Moreover, two supporting portions 670*a*4 separated by a predetermined distance are provided in the lower end portion on the first end side of the base portion 670*a*1 of the first shaft-receiving portion 670*a*. Similarly, two supporting portions 670*b*4 separated by a predetermined distance are provided in the lower end portion on the first end side of the base portion 670*b*1 of the second shaft-receiving portion 670*b*.

In the base plate 618, the substantially entire portion, except for the peripheral edges around a metal plate having a rectangular shape in a plan view and for the vicinity of an attaching hole 618*a* provided in the four corners of the metal plate, is swelled from the bottom side toward the plane side, whereby the strength is increased and an accommodation space for an urging member 700 described later is formed. In addition, each of the first shaft-receiving portion 670*a*, the second shaft-receiving portion 670*b*, and the pivot receivers 660, 662, 664, and 666 is formed into a predetermined shape by bending and curling, from the bottom side toward the plane side, a region partitioned by a punched slit provided in advance.

Moreover, when the substantially entire portion of the base plate 618 is swelled, portions to be swelled and portions not to be swelled are partitioned by a punched slit provided in advance in the base plate 618 in order to provide urging member-attaching portions 618*b*, and the partitioned regions are bent or not bent to define the urging member-attaching portions 618*b* in the base plate 618.

The supporting portions 670*a*4 and 670*b*4 are formed by bending the lower portions of the base portion 670*a*1 of the first shaft-receiving portion 670*a* and the base portion 670*b*1 of the second shaft-receiving portion 670*b*, respectively, from the bottom side toward the plane side.

As shown in FIG. 43, the first shaft-receiving portion 670*a* and the second shaft-receiving portion 670*b* are formed into a pair of swirl-like shape in the single-plate-like base plate 618. Thus, the first shaft-receiving portion 670*a* and the second shaft-receiving portion 670*b* are formed from the single-plate-like base plate 618 by punching and bending.

Specifically, in the single-plate-like base plate 618, the neck portion 670*a*2 of the first shaft-receiving portion 670*a* and the head portion 670*b*3 of the second shaft-receiving portion 670*b* are formed so as to be adjacent to each other, and the neck portion 670*b*2 of the second shaft-receiving portion 670*b* and the head portion 670*a*3 of the first shaft-receiving portion 670*a* are formed so as to be adjacent to each other. Furthermore, the shaft holes 672*a* and 672*b* drilled in the head portion 670*a*3 of the first shaft-receiving portion 670*a* and the head portion 670*b*3 of the second shaft-receiving portion 670*b*, respectively, are arranged such that the centers thereof are aligned along a line orthogonal to the lengthwise direction of the single-plate-like base plate 618.

Moreover, the curved portion 636 of the first ring member 620 and the curved portion 656 of the second ring member 640 are disposed on the inner side of the first shaft-receiving portion 670*a* and the second shaft-receiving portion 670*b*.

The lever 614 includes a substantially linear lever body 680, a rod member 682 which protrudes from the upper end (the far side) of the lever body 680 and is bent upward, and a substantially L-shaped operation portion 684 which is provided on the free end side of the rod member 682, is bent upward at the lower end (the near side) of the lever body 680, and protrudes in a direction orthogonal to the lever body 680. The lever 614 is configured such that, when the lever 614 is rotationally moved to an opened position, the first ring member 620 and the second ring member 640 having the binding rings 612 are opened simultaneously and that, when the lever 614 is rotationally moved to a closed position, the first ring member 620 and the second ring member 640 having the binding rings 612 are closed simultaneously. A shaft hole 682*a* is drilled in the rod member 682.

The lever 614 is configured so as to be capable of rotatably moving in a direction orthogonal to the opening-closing direction of the binding rings 612 in the first ring member 620 and the binding rings 612 in the second ring member 640 through a pivot member 685 secured to the end of the rod member 682.

The lever 614 is secured at an end of the lever body (the end opposite to the operation portion 684) to the pivot member 685 intervening between the first shaft-receiving portion 670*a* and the second shaft-receiving portion 670*b*. The pivot member 685 is secured to the shaft holes 672*a* and 672*b* in the lever shaft receiver 670 through a pivot 690.

In the pivot member 685, a synthetic resin-made substantially disc-like main body 685*c* is provided laterally with a planar left-side portion 685*a* and a planar right-side portion 685*b* which are joined to the first shaft-receiving portion 670*a* and the second shaft-receiving portion 670*b*, respectively, so as to be sandwiched therebetween. In addition, a lever attaching portion 685*d* is provided on the near side of the substantially disc-like main body 685*c*. Furthermore, a left-right pair of rolling portions 685*e* and 685*f* are continuously provided on the far side of the substantially disc-like main body 685*c*, i.e., on the side opposite to the lever attaching portion 685*d*, so as to extend from the lower portion to the upper portion of the substantially disc-like main body 685*c*. Each of the rolling portions 685*e* and 685*f* has an appropriate width (corresponding to the shape and position of the curved portions 636 and 656 in the state in which the binding rings 612 are closed) from the side edge of the planar left-side portion 685*a* or the side edge of the planar right-side portion 685*b*.

The left-right pair of the rolling portions 685*e* and 685*f* are configured to have substantially the same route so that they follow substantially the same trajectory when rotationally moved from the position in a closed state of the binding rings 612 to the position in an opened state of the binding ring 612*s* or vice versa.

The upper portion of each of the rolling portions 685*e* and 685*f* is lowered toward the pivot 690 side in order to prevent the curved portion 636 of the first ring member 620 and the curved portion 656 of the second ring member 640 from being pushed down when the lever 614 is brought into the open position, i.e., the lever 614 is rotationally moved to open the binding rings 612 and in order to maintain the first ring member 620 and the second ring member 640 in the opened state. Furthermore, the distance (L1) with the pivot 690 is short. Meanwhile, the lower portion of the rolling portions 685*e* and 685*f* is made long from the pivot 690 side, so that, when the lever 614 is brought into the closed position, i.e., the lever 614 is rotationally moved to close the binding rings 612, the lower portion pushes down the curved portion 636 of the first ring member 620 and the curved portion 656 of the second ring member 640 to secure the first ring member 620 and the second ring member 640 in a closed state. Furthermore, the distance (L2) with the pivot 690 is long.

A first securing portion 686 is provided so as to protrude downward from the final end of the rolling portions 685*e* and 685*f*, i.e., from the lower portion on a perpendicular line passing through a pivot hole 685*i* provided at the substantial center of the substantially disc-like main body 685*c*. The first securing portion 686 is provided for securing the upper surface of the curved portion 636 of the first ring member 620 and the upper surface of the curved portion 656 of the second ring member 640 by the pivot member 685 which rotates when the lever 614 is rotationally moved to open-close the binding rings 612.

The first securing portion 686 has an arc-shaped cross-section as viewed from the side so that the end thereof presses and secures projections of the curved portions 636 and 656.

When the first ring member 620 and the second ring member 640 are in a completely closed state, the first securing portion 686 is located beyond the projections 636*a* and 656*a* and engages with the inclined surface of each of the projections 636*a* and 656*a*, i.e., the upper surface on the side (the far side) on which the lever 614 is positioned when the first ring member 620 and the second ring member 640 are opened.

A restricting portion 685*g* is provided so as to protrude between the rolling portions 685*e* and 685*f*. When the lever 614 is rotationally moved to the far side to bring the upper binding ring portion 622 and the lower binding ring portion 624 into the opened state, the restricting portion 685*g* is inserted between the curved portion 636 of the first ring member 620 and the curved portion 656 of the second ring member 640. Therefore, the restricting portion 685*g* is provided for securing the first ring member 620 and the second ring member 640 in an opened state in order to prevent the opened first ring member 620 and the opened second ring member 640 from being closed.

The restricting portion 685*g* has a tapered protruding shape, as viewed from the front, in which the width thereof increases toward the curved portion 636 side and the curved portion 656 side as the position approaches the upper portion. In this manner, when the lever 614 is rotationally moved to start opening the binding rings 612, the restricting portion 685*g* starts entering the gap between the curved portion 636 of the first ring member 620 and the curved portion 656 of the second ring member 640. Furthermore, when the lever is further rotationally moved, the gap between the curved portion 636 of the first ring member 620 and the curved portion 656 of the second ring member 640 is forced to be gradually widened to allow the lever 614 to rotationally move.

The restricting portion 685*g* is further continuously provided up to the upper portion of the substantially disc-like main body 685*c* (in the state in which the first ring member 620 and the second ring member 640 are closed). A first engaging portion 685*h* having a goose-neck like shape as viewed from the side is provided in the uppermost portion of the restricting portion 685*g* in a protruding manner.

The restricting portion 685*g* is provided along the rolling portions 685*e* and 685*f* on the rotation trajectory of the pivot member 685. Therefore, even when the first ring member 620 and the second ring member 640 are operated in the closing direction, the restricting portion 685*g* enters the gap between the curved portion 636 of the first ring member 620 and the curved portion 656 of the second ring member 640, so that the first ring member 620 and the second ring member 640 can be prevented from being closed.

The restricting portion 685*g* has a tapered protruding shape, as viewed from the front, in which the width thereof is increased as the position approaches the upper portion, so that, as the lever 614 is rotationally moved, the restricting portion 685*g* gradually enters the gap at the curved portion 636 of the first ring member 620 and is rotationally moved while widening the gap. Therefore, when the pivot member 685 is rotationally moved, the tapered restricting portion 685*g* gradually enters the gap between the first ring member 620 and the second ring member 640 as if a wedge is inserted into the gap, whereby the widening of the gap between the first ring member 620 and the second ring member 640 can be facilitated.

The first engaging portion 685*h* is opened in direction Y in which the first ring member 620 and the second ring member 640 are opened.

Moreover, a second engaging portion 685*k* having a hook portion protruding from the upper surface of each of the rolling portions 685*e* and 685*f* and an inclined portion provided continuously from the hook portion is provided so as to protrude at a position rotated by about 90° from the first engaging portion 685*h* in the direction Y in which the first ring member 620 and the second ring member 640 are opened.

The first engaging portion 685*h* is provided in the upper portion of a perpendicular line passing through the pivot hole 685*i* provided at the substantial center of a substantially disk-like main body 685*c*. Furthermore, the first engaging portion 685*h* reaches the lower portion when the first ring member 620 and the second ring member 640 are in the completely opened state and is engaged with an end portion 706*a* of the urging member 700.

As shown in FIG. 35, the second engaging portion 685*k* is configured so that, when the first ring member 620 and the second ring member 640 start opening by rotationally moving the lever 614 and the rear end of the lever 614 is slightly raised obliquely upward, the lever 614 is temporarily stopped at that position. The second engaging portion 685*k* has a hook portion protruding from the upper surface of each of the rolling portions 685*e* and 685*f* and an inclined portion formed continuously from the hook portion. Thus, the second engaging portion 685*k* is temporarily engaged with the projection 636*a* at a position before the lever 614 climbs over the projection 636*a*, i.e., on the side (the far side) on which the lever 614 is positioned when the first ring member 620 and the second ring member 640 are opened, whereby the rotation of the lever 614 is stopped.

The curved portion 636 of the first ring member 620 and the curved portion 656 of the second ring member 640 are configured such that the rolling portions 685*e* and 685*f* roll on the upper surface thereof when the lever 614 is opened or closed, i.e., the lever 614 is rotationally moved to open or close the binding rings 612. Furthermore, the upwardly swelling projections 636*a* and 656*a* are provided near a portion below the shaft holes 672 of the lever shaft receiver 670 such that the first securing portion 686 of the lever 614 climbs over the change point the lever mechanism when lowered to the lowermost position.

The first securing portion 686 of the lever 614 is configured so as to roll on the curved portion 636 of the first ring member 620 and on the curved portion 656 of the second ring member 640 and is also configured so as to be rotationally moved about the pivot 690 from a horizontal state (the closed state of the binding rings 612) in a direction orthogonal to the opening-closing direction of the binding rings 612.

An absorbing hole portion 685*j* is provided in the upper portion of the first securing portion 686 in the pivot member 685. The absorbing hole portion 685*j* is provided for absorbing a force of the first securing portion 686 for pushing the curved portion 636 of the first ring member 620 and the curved portion 656 of the second ring member 640 when the first ring member 620 and the second ring member 640 are secured.

The opening-closing mechanism 616 is provided with an urging member 700 which urges the binding ring 612 in an opening direction.

The urging member 700 has a pushing-up portion 706 having a substantially rectangular U-shape in a plan view and securing portions 704*a* and 704*b* having a substantially L-shape in a plan view and provided so as to protrude outward from the respective opposed ends of the pushing-up portion 706. The securing portions 704*a* and 704*b* are secured on the rear surface of the base plate 618, more specifically on the rear surface near the pivot receivers 662 and 666, through the urging member-attaching portions 618*b* provided in the base plate 618. At the substantial center of the base plate 618, the pushing-up portion 706 protrudes inwardly from the space between the connection portion 634 of the first ring member 620 and the connection portion 654 of the second ring member 640. Thus, the pushing-up portion 706 pushes up the curved portions 636 and 656 from the lower sides of the curved portions 636 and 656 and urges the first ring member 620 and the second ring member 640 to open them.

Specifically, the urging member 700 abuts on the lower portion of the curved portion 636 of the first ring member 620 (a portion lower than the change point of the lever (a portion on the near side)) and also on the lower portion of the curved portion 656 of the second ring member 640 (a portion lower than the change point of the lever (a portion on the near side)) and urges the curved portions 636 and 656 upward in a pushing-up manner.

The first ring member 620 is opened about the pivot portions 626 and 630 in a counterclockwise direction (as viewed from the front) by the urging force of the urging member 700, and the second ring member 640 is opened about the pivot portions 646 and 650 in a clockwise direction (as viewed from the front) by the urging force.

An end portion 706*a* at the free end of the pushing-up portion 706 is provided at a position at which the end portion 706*a* is engaged with the first engaging portion 685*h* of the pivot member 685 which is rotated so as to open the binding rings 612 by rotationally moving the lever 614. Thus, the first engaging portion 685*h* of the pivot member 685 is secured to the end portion 706*a* of the pushing-up portion 706, whereby the lever 614 is firmly secured such that the opened state of the binding ring 612 is maintained.

The urging member 700 is secured near the base of pushing-up portion 706 and near the pushing-up portion 706 side of each of the securing portions 704*a* and 704*b* through the urging member-attaching portions 618*b* provided at the substantial widthwise center of the base plate 618. In addition, the urging member 700 is secured at the end (free end) of each of the securing portions 704*a* and 704*b* by the urging member-attaching portions 618*b* near the lengthwise center in the left and right edges of the base plate 618.

In a state where the binding rings 612 in the first ring member 620 and the second ring member 640 are closed (see FIGS. 34 and 37), the lever 614 is moved upward as shown in FIG. 35, and the first securing portion 686 rolls on the curved portion 636 of the first ring member 620 and the curved portion 656 of the second ring member 640 and moves toward the lower side (the near side). Therefore, the first securing portion 686 does not push down the curved portion 636 of the first ring member 620 and the curved portion 656 of the second ring member 640. Furthermore, the curved portion 636 of the first ring member 620 and the curved portion 656 of the second ring member 640 are pushed upward by the urging force of the urging member 700.

As shown in FIGS. 35 and 38, when the first ring member 620 and the second ring member 640 start opening by rotationally moving the lever 614 and the rear end of the lever 614 is slightly raised obliquely upward, the second engaging portion 685*k* is temporarily engaged with the projection 636*a* at a position before the lever 614 climbs over the projection 636*a*, i.e., on the side (the far side) on which the lever 614 is positioned when the first ring member 620 and the second ring member 640 are opened, whereby the rotation of the lever 614 is stopped. At this time, the binding ring 612 is secured in a half-opened state.

Thus, as shown in FIGS. 35 and 38, when the lever 614 is rotationally moved to the upper side (the far side), the restricting portion 685*g* of the pivot member 685, which has a tapered shape, starts entering the gap between the curved portion 636 of the first ring member 620 and the curved portion 656 of the second ring member 640 like a wedge (see FIG. 38). Furthermore, as shown in FIG. 35, as the lever 614 is rotationally moved, the restricting portion 685*g* forces the gap between the curved portion 636 of the first ring member 620 and the second ring portion 656 to be gradually widened (see FIG. 39).

In this manner, the junction 628 of the first ring member 620 and the junction 648 of the second ring member 640 are moved in mutually separating directions, and the junction 632 of the first ring member 620 and the junction 652 of the second ring member 640 are moved in mutually separating directions. The binding rings 612 in the first ring member 620 are opened about 20 degrees from a perpendicular line passing through the pivot portions 626 and 630, and the binding rings 612 in the second ring member 640 are opened about 20 degrees from a perpendicular line passing through the pivot portions 646 and 650. Specifically, the first ring member 620 is opened by being rotated in a counterclockwise direction (as viewed from the front), and the second ring member 640 is opened by being rotated in a clockwise direction (as viewed from the front).

When the upper binding ring portion 622 and the lower binding ring portion 624 of the first ring member 620 and the upper binding ring portion 642 and the lower binding ring portion 644 of the second ring member 640 are opened, an operation area for the lever 614 is opened. Then, the lever 614 can pass between the binding rings 612 in the first ring member 620 and the second ring member 640 and can be rotationally moved until reaching the far side of the base plate 618. Hence, as shown in FIGS. 36 and 39, the lever 614 can be secured in a horizontal state in which the lever 614 comes close to the upper surface of the base plate 618.

Moreover, the rolling portions 685*e* and 685*f* of the pivot member 685 exert an effect of pressing down the curved portion 636 of the first ring member 620 and the curved portion 656 of the second ring member 640, respectively. The first engaging portion 685*h* of the pivot member 685 is secured to the end portion 706*a* at the free end of the pushing-up portion 706, so that a downward force which is exerted by the curved portion 636 of the first ring member 620 and the curved portion 656 of the second ring member 640 when the first ring member 620 and the second ring member 640 are moved in the closing direction is held by the first engaging portion 685*h* of the pivot member 685 through the end portion 706*a* at the free end of the pushing-up portion 706. Therefore, the first engaging portion 685*h* acts so as to maintain the state in which the lever 614 is opened (the state in which the binding rings 612 are opened).

Therefore, the upper binding ring portion 642 of the second ring member 640 and the lower binding ring portion 644 of the second ring member 640 can be inserted into binding holes of an object to be bound such as a paper sheet without being disturbed by the lever 614, whereby the object to be bound can be inserted.

Moreover, even when an inward force is applied to the first ring member 620 and the second ring member 640 from the left side and the right side, respectively, the first ring member 620 and the second ring member 640 are prevented from being easily closed.

After the object to be bound is inserted, when the lever 614 is rotationally moved toward the lower side (the near side), the first securing portion 686 again pushes down the curved portion 636 of the first ring member 620 and the curved portion 656 of the second ring member 640. Then, when the lever 614 is pushed down against the urging force of the urging member 700, the lever 614 is secured in a position beyond the change point, and the binding rings 612 in the first ring member 620 and the second ring member 640 are secured in place. Furthermore, in order to prevent the first securing portion 686 from pushing the curved portion 636 of the first ring member 620 and the curved portion 656 of the second ring member 640 by an excessively large force, the absorbing hole portion 685*j* exerts an effect of absorbing the pressing force of the first securing portion 686.

When the force for pressing the curved portion 636 of the first ring member 620 and the curved portion 656 of the second ring member 640 by the first securing portion 686 is weakened by providing the absorbing hole portion 685*j*, the absorbing hole portion 685*j* may not be provided.

This binding device 610 is attached to a spine $C_1$ of a cover C of a file by inserting rivets or other suitable fasteners through respective four attaching holes provided in the base plate 618.

The distance $D_5$ between the perpendicular plane $W_5$ passing through the left edge of the base plate 618 secured to the spine $C_1$ of the cover C of the file and a perpendicular plane $W_7$ passing through a folding line on the left edge of the spine $C_1$ of the cover C of the file is equal to the distance $D_6$ between a perpendicular plane $W_6$ passing through the right edge of the base plate 618 and a perpendicular plane $W_8$ passing through a folding line on the right edge of the spine $C_1$ of the cover C of the file.

The binding device according to the present invention is not limited to the above-described preferred embodiments, and various modifications may be made.

For example, as shown in FIGS. 44 to 47, the binding rings 12, 212, 412, and 612 may have a D-ring shape.

A binding ring 612A as shown in FIGS. 44 to 47 is defined by a substantially arc-shaped semi-annular first ring member 620A (including an upper binding ring portion 622A and a lower binding ring portion 624A) and a substantially L-shaped semi-annular second ring member 640A (including an upper binding ring portion 642A and a lower binding ring portion 644A). When the first ring member 620A and the second ring member 640A are closed, a substantially D-shaped ring shape is provided.

When secured to a cover C, this binding device 610A is secured to the inner surface (the third surface) of a right rear cover (side B) $C_2$ defining the cover C using a lock or a rivet, in contrast to the above-described binding device 610.

Figure 48:
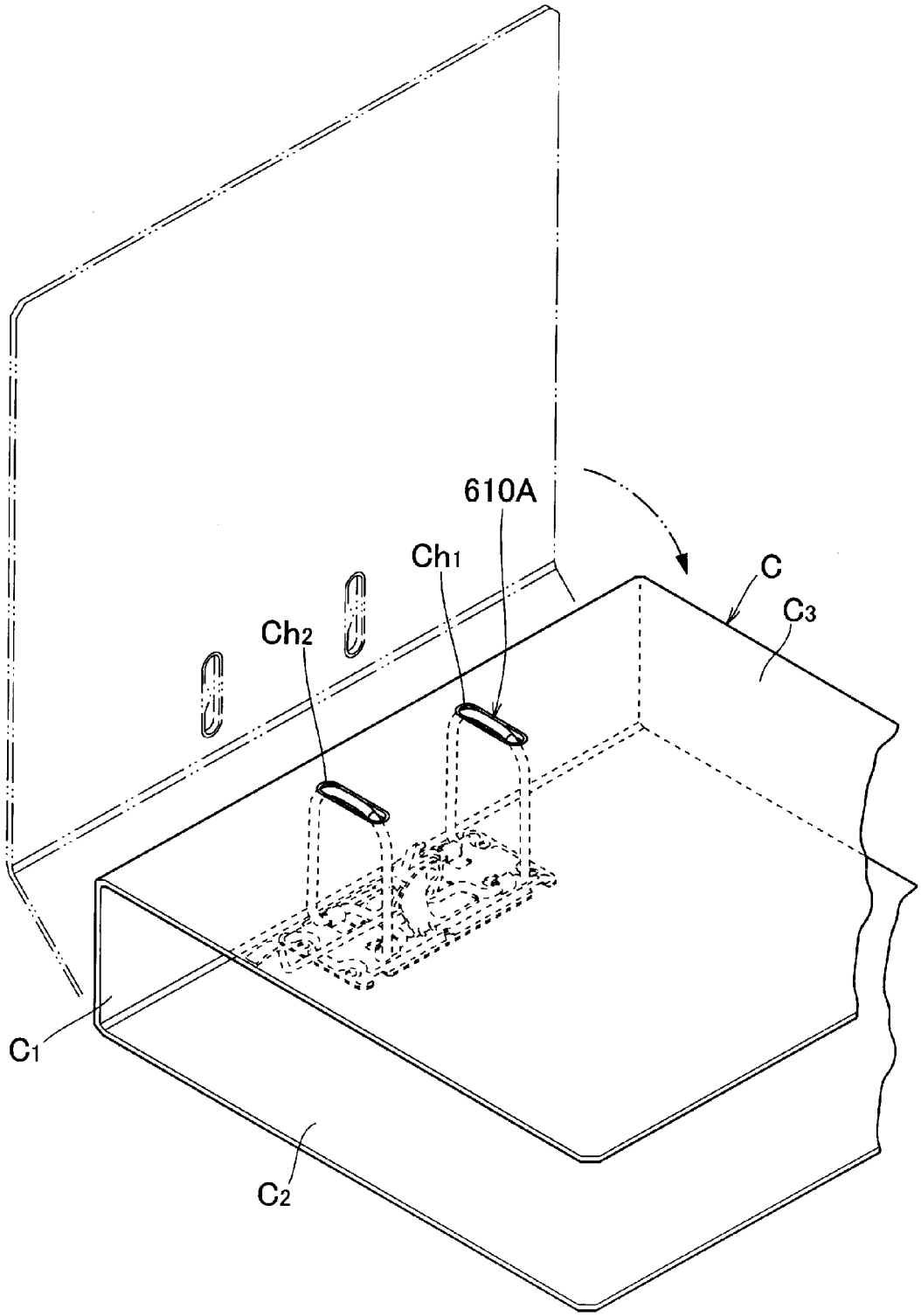
FIG. 48 is a perspective view illustrating a state in which a cover is closed in the usage example in FIG. 47.
Figure 49:
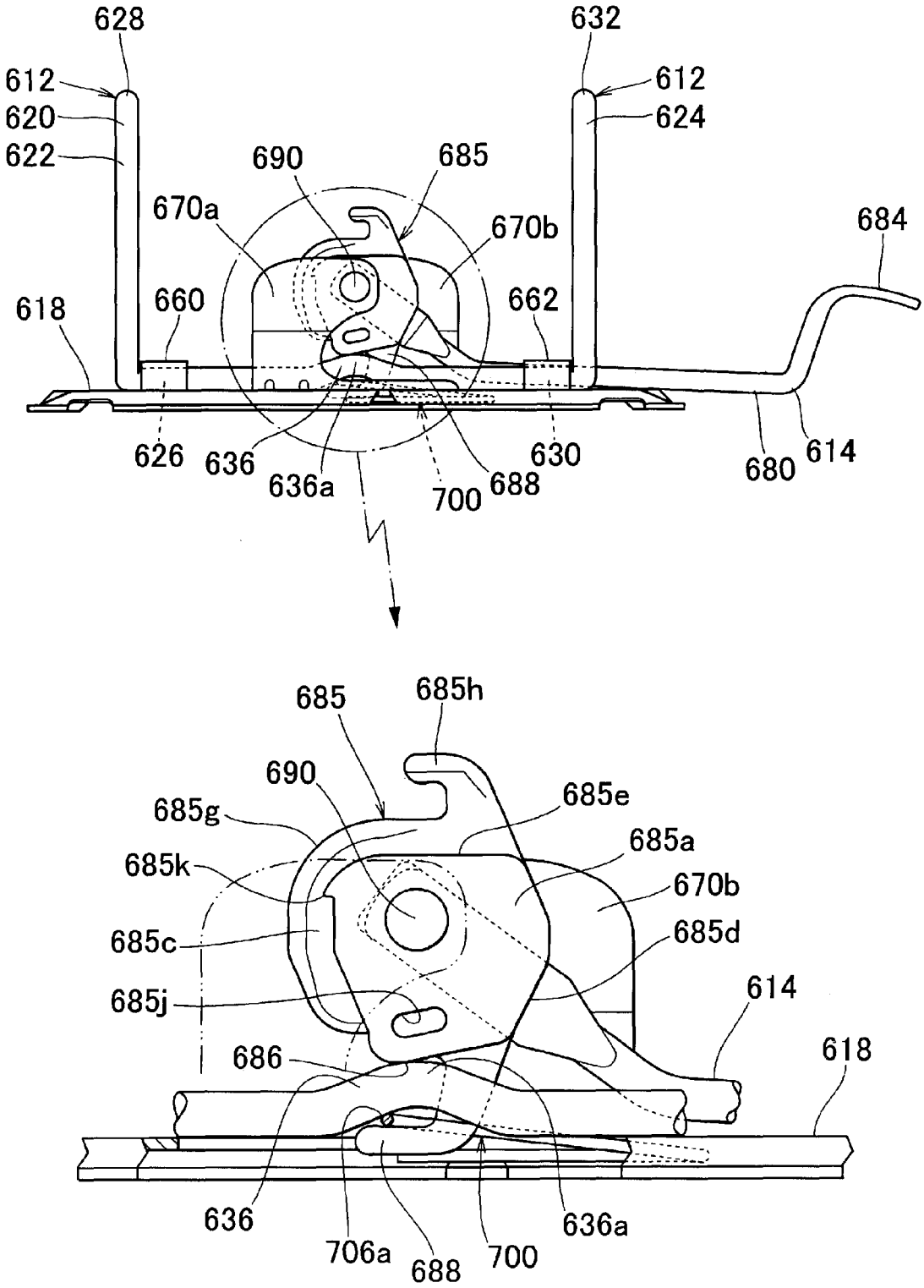
FIG. 49 is a set of front views illustrating the binding device (in a state in which binding rings are closed) which is a modified example of the binding device shown in FIG. 30.
Figure 50:
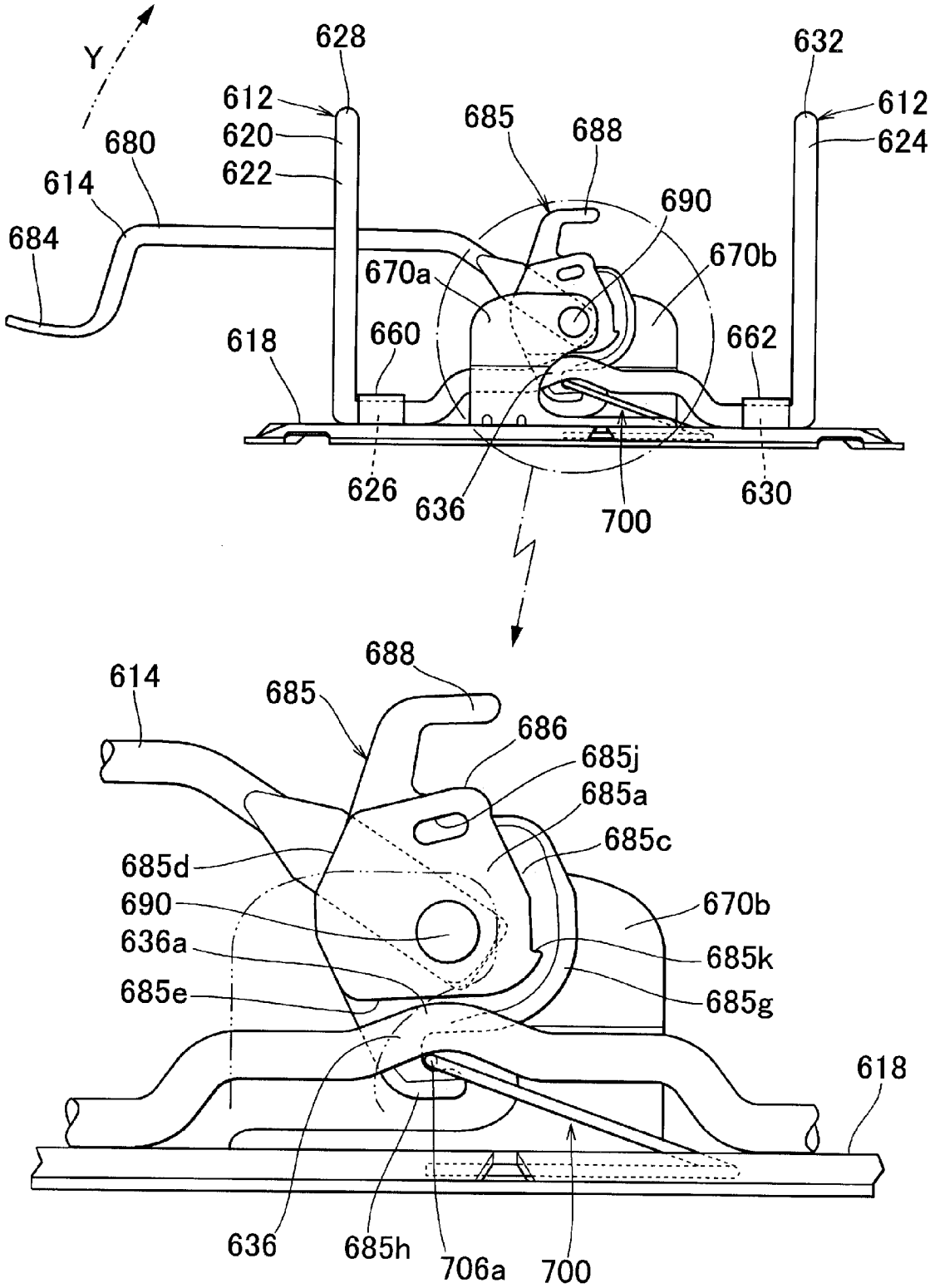
FIG. 50 is a set of front views illustrating a binding device (in a state in which the binding rings are opened) which is the modified example of the binding device shown in FIG. 30.

The first ring member 620A (the upper binding ring 622A and the lower binding ring 624A) is configured so as to be fitted into securing through holes $Ch_1$ and $Ch_2$ provided in a left front cover (side A) $C_3$ when the cover C is closed. Moreover, as shown in FIGS. 48 and 49, the second securing portion 688 to be engaged with the end portion 706*a* of the urging member 700 may be provided in the pivot member 685 in order to reliably secure the pivot member 685 to the base plate 618 when the binding rings 612 are closed.

The second securing portion 688 has a substantially L-shape as viewed from the front and is opened in direction Y in which the first ring member 620 and the second ring member 640 are opened. Furthermore, when the lever 614 is rotated to close the binding rings 612, the second securing portion 688 is engaged with the end portion 706*a* of the urging member 700.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A binding device for files and binders in which two binding rings to be inserted into two binding holes of an object to be bound are openably and closeably secured to a base plate so as to be opened and closed by an opening-closing mechanism including a rotationally movable lever, each of the at least two binding rings comprising:

a first ring member having a semi-annular binding ring portion and a second ring member having a semi-annular binding ring portion, which define the binding ring, pivotally supported at respective pivot portions at respective lower ends thereof on the base plate;

a junction at an end opposite to the pivot portion of the binding ring portion of the first ring member and a junction at an end opposite to the pivot portion of the binding ring portion of the second ring member joined together at an approximate center between the pivot portions of the first ring member and the second ring member; wherein the binding ring portion of the first ring member and the binding ring portion of the second ring member provide a ring-like shape which defines a closed loop;

the first ring member and the second ring member are arranged to be interlocked with the opening-closing mechanism including the lever so as to be opened and closed about the respective pivot portions provided in the lower ends thereof by rotationally moving the lever;

the first ring member and the second ring member are secured in an opened state when opened;

the lever is secured such that the first ring member and the second ring member are maintained in the opened state;

the opening-closing mechanism includes a pivot member arranged to rotationally move the lever, the pivot member being provided with an engaging portion which is engaged on the base plate side when the lever is rotationally moved to a position at which the binding ring is opened;

an urging member is provided to rotationally move and simultaneously open the first ring member and the second ring member defining the binding ring; and the engaging portion is arranged to be engaged with the urging member to rotationally move and open the first ring member and the second ring member when the at least two binding rings are brought into the opened position.

2. The binding device for files and binders according to claim 1 in which the ring to be inserted into the binding hole of an object to be bound are openably and closeably secured to the base plate so as to be opened and closed by the opening-closing mechanism including the rotationally movable lever, wherein:

the first ring member having the semi-annular binding ring portion and the second ring member having the semi-annular binding ring portion, which define the binding ring, are pivotally supported at the respective pivot portions at the respective lower ends thereof on the base plate;

the junction at the end opposite to the pivot portion of the binding ring portion of the first ring member and the junction at the end opposite to the pivot portion of the binding ring portion of the second ring member are joined together at a position between the pivot portions of the first ring member and the second ring member, whereby the binding ring portion of the first ring member and the binding ring portion of the second ring member provide the ring-like shape which defines the closed loop; and the first ring member and the second ring member are arranged to be interlocked with the opening-closing mechanism including the lever so as to be opened and closed about the respective pivot portions provided in the lower ends thereof by rotationally moving the lever.

3. The binding device for files and binders according to claim 1, wherein at least one of the first ring member and the second ring member, and the opening-closing mechanism including the lever are arranged such that the first ring member and the second ring member are stopped in a state in which the first and second ring members are half-opened at a position between an opened position and a closed position.

4. The binding device for files and binders according to claim 1, wherein:

the engaging portion is provided in a surface of the opening-closing mechanism which is located on a lower side of the binding ring when the binding ring is brought into an opened position; and the engaging portion is arranged to be engaged with the urging member to rotationally move and open the first ring member and the second ring member when the binding ring is brought into the opened position.

5. The binding device for files and binders according to claim 1, wherein:

an upper binding ring portion and a lower binding ring portion each defining the binding ring portion are connected through a connection portion to each other at the respective pivot portions in the lower ends thereof so as to be opposed to each other;

each of the pivot portions is provided so as to protrude in a direction orthogonal to an opening-closing direction of the binding ring portion;

the connection portion is connected to the pivot portion of the upper binding ring portion and the pivot portion of the lower binding ring portion and has a curved portion which is configured so as to be curved toward the junction side as the curved portion approaches the approximate center of the connection portion;

the curved portion is provided with a change point of the lever of the opening-closing mechanism; and the pivot member of the opening-closing mechanism is arranged such that the lever is stopped at the change point when the lever is brought into a closed position of the binding ring and/or into a half-opened position of the binding ring.

6. The binding device for files and binders according to claim 1, wherein:

the pivot member of the opening-closing mechanism includes a securing portion arranged to be secured to the base plate and which is provided in a surface of the opening-closing mechanism which is located on a lower side of the binding ring when the binding ring is brought into a closed position; and the securing portion is arranged to be secured to the urging member for rotationally moving and opening the first ring member and the second ring member when the binding ring is brought into the closed position.

* * * * *